US008265521B2

(12) United States Patent
Okabe

(10) Patent No.: US 8,265,521 B2
(45) Date of Patent: Sep. 11, 2012

(54) TANDEM PHOTOSENSITIVE-MEMBER UNIT HAVING GRIP PART

(75) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/234,974

(22) Filed: Sep. 16, 2011

(65) Prior Publication Data

US 2012/0003001 A1 Jan. 5, 2012

Related U.S. Application Data

(60) Continuation of application No. 13/006,898, filed on Jan. 14, 2011, now Pat. No. 8,041,257, which is a continuation of application No. 12/698,200, filed on Feb. 2, 2010, now Pat. No. 8,027,615, which is a division of application No. 12/188,291, filed on Aug. 8, 2008, now Pat. No. 7,676,174, which is a division of application No. 11/502,388, filed on Aug. 11, 2006, now Pat. No. 7,426,355.

(30) Foreign Application Priority Data

Aug. 12, 2005 (JP) ..... 2005-234824
Dec. 27, 2005 (JP) ..... 2005-376111

(51) Int. Cl.
*G03G 21/18* (2006.01)
*G03G 15/01* (2006.01)

(52) U.S. Cl. ..... 399/110; 399/112

(58) Field of Classification Search ..... 399/110, 399/111, 112
See application file for complete search history.

(56) References Cited

U.S. PATENT DOCUMENTS

| | | | |
|---|---|---|---|
| 5,107,304 | A | 4/1992 | Haneda et al. |
| 5,282,012 | A | 1/1994 | Terada et al. |
| 5,327,208 | A | 7/1994 | Matsuo et al. |
| 5,812,910 | A | 9/1998 | Kim |
| 5,963,759 | A | 10/1999 | Kojima et al. |
| 6,041,203 | A | 3/2000 | Suzuki et al. |

(Continued)

FOREIGN PATENT DOCUMENTS

JP 59-033461 A 2/1984

(Continued)

OTHER PUBLICATIONS

Office Action in corresponding Japanese Application 2005-376111 mailed on Aug. 24, 2010.

(Continued)

*Primary Examiner* — Sophia S Chen
(74) *Attorney, Agent, or Firm* — Banner & Witcoff, Ltd.

(57) ABSTRACT

An image-forming device includes a main body and a tandem photosensitive-member unit. The tandem photosensitive-member unit includes a unit frame, a plurality of photosensitive members, a front-side grip part, and a rear-side grip. The unit frame is configured to be slidably installed to and removed from the main body in a predetermined direction. The unit frame has a leading side and a trailing side with respect to the predetermined direction. The plurality of photosensitive members is provided corresponding to a plurality of colors and is supported by the unit frame. The front-side grip part is provided at the leading side of the unit frame. The rear-side grip part is provided at the trailing side of the unit frame.

21 Claims, 34 Drawing Sheets

U.S. PATENT DOCUMENTS

| | | | | |
|---|---|---|---|---|
| 6,101,349 | A | 8/2000 | Ohashi et al. | |
| 6,738,590 | B2 | 5/2004 | Okimura et al. | |
| 6,978,103 | B2 | 12/2005 | Miura et al. | |
| 7,072,602 | B2 | 7/2006 | Hatori et al. | |
| 7,203,446 | B2 | 4/2007 | Miura et al. | |
| 2001/0055500 | A1 | 12/2001 | Katakabe et al. | |
| 2003/0053819 | A1 | 3/2003 | Nomura et al. | |
| 2003/0161656 | A1 | 8/2003 | Miura et al. | |
| 2004/0101328 | A1 | 5/2004 | Kimura et al. | |
| 2004/0136751 | A1 | 7/2004 | Sunada et al. | |
| 2004/0190932 | A1 | 9/2004 | Ishii | |
| 2005/0147432 | A1 | 7/2005 | Miura et al. | |
| 2006/0067734 | A1 * | 3/2006 | Igarashi et al. | 399/119 |
| 2007/0009282 | A1 | 1/2007 | Sato et al. | |

FOREIGN PATENT DOCUMENTS

| | | | |
|---|---|---|---|
| JP | 03-180861 | A | 8/1991 |
| JP | 05-323688 | A * | 12/1993 |
| JP | 08-220819 | A | 8/1996 |
| JP | 09-211976 | | 8/1997 |
| JP | 09-304994 | | 11/1997 |
| JP | 2003-050531 | | 2/2003 |
| JP | 2003-287992 | | 10/2003 |
| JP | 2003-316105 | | 11/2003 |
| JP | 2003-316233 | | 11/2003 |
| JP | 2004-109886 | | 4/2004 |
| JP | 2004-301944 | | 10/2004 |
| JP | 2005-107139 | | 4/2005 |
| JP | 2005-148411 | | 6/2005 |
| JP | 2005-181741 | | 7/2005 |

OTHER PUBLICATIONS

Office Action for corresponding Japanese Patent Application No. 2005-376111 mailed on Dec. 21, 2010.

* cited by examiner

TANDEM PHOTOSENSITIVE-MEMBER UNIT HAVING GRIP PART

CROSS REFERENCE TO RELATED APPLICATIONS

This application is a Continuation application of Ser. No. 13/006,898, filed Jan. 14, 2011, which is a Continuation application of Ser. No. 12/698,200, filed Feb. 2, 2010, which is a Divisional application of U.S. application Ser. No. 12/188,291, filed Aug. 8, 2008, now U.S. Pat. No. 7,676,174, which is a Divisional application U.S. application Ser. No. 11/502,388, filed Aug. 11, 2006, now U.S. Pat. No. 7,426,355, which claims priority to Japanese Patent Application No. 2005-234824 filed on Aug. 12, 2005, and Japanese Patent Application No. 2005-376111 filed Dec. 27, 2005. The entire contents of each of these are incorporated herein by reference.

TECHNICAL FIELD

The disclosure relates to an image-forming device, such as a laser printer, and a tandem photosensitive-member unit that is detachably mounted in the image-forming device.

BACKGROUND

Tandem type image-forming devices such as color printers are well known in the art. This type of image-forming device includes a plurality of developer units and photosensitive drums and forms color images by sequentially forming toner images in each color on the respective photosensitive drums and subsequently transferring and superimposing the toner images in each color on paper. Conventional tandem image-forming devices require the user to replace the developer units and photosensitive drums for each color, thereby placing a great burden on the user.

One such image-forming device disclosed in U.S. Pat. No. 6,738,590 (corresponding to Japanese patent application publication No. 2003-50531) employs a method of replacing all of the developer units and photosensitive drums together by providing the developer units and photosensitive drums in a single integrated image-forming unit, whereby the image-forming unit is mounted in and removed from the main body of the image-forming device through the top thereof.

SUMMARY

However, when replacing the image-forming unit in this image-forming device, the user must support an image-forming unit that is much larger and heavier than a single developer unit and photosensitive drum, increasing the risk that the image-forming unit may be dropped.

In view of the foregoing, it is an object of the invention to provide a tandem photosensitive-member unit that facilitates mounting and removing operations for the tandem photosensitive-member unit. It is another object of the invention to provide an image-forming device in which such tandem photosensitive-member unit is detachably mounted.

In order to attain the above and other objects, according to one aspect, the invention provides an image-forming device. The image-forming device includes a main body and a tandem photosensitive-member unit. The tandem photosensitive-member unit includes a unit frame, a plurality of photosensitive members, a front-side grip part, and a rear-side grip. The unit frame is configured to be slidably installed to and removed from the main body in a predetermined direction. The unit frame has a leading side and a trailing side with respect to the predetermined direction. The plurality of photosensitive members is provided corresponding to a plurality of colors and is supported by the unit frame. The front-side grip part is provided at the leading side of the unit frame. The rear-side grip part is provided at the trailing side of the unit frame.

According to another aspect, the invention also provides a tandem photosensitive-member unit. The tandem photosensitive-member unit includes a unit frame, a plurality of photosensitive members, a front-side grip part, and a rear-side grip part. The unit frame is configured to be slidably installed to and removed from a main body of an image-forming device in a predetermined direction. The unit frame has a leading side and a trailing side with respect to the predetermined direction. The plurality of photosensitive members is provided corresponding to a plurality of colors and is supported by the unit frame. The front-side grip part is provided at the leading side of the unit frame. The rear-side grip part is provided at the trailing side of the unit frame.

BRIEF DESCRIPTION OF THE DRAWINGS

Illustrative aspects in accordance with the invention will be described in detail with reference to the following figures wherein.

DETAILED DESCRIPTION

Figure 1:
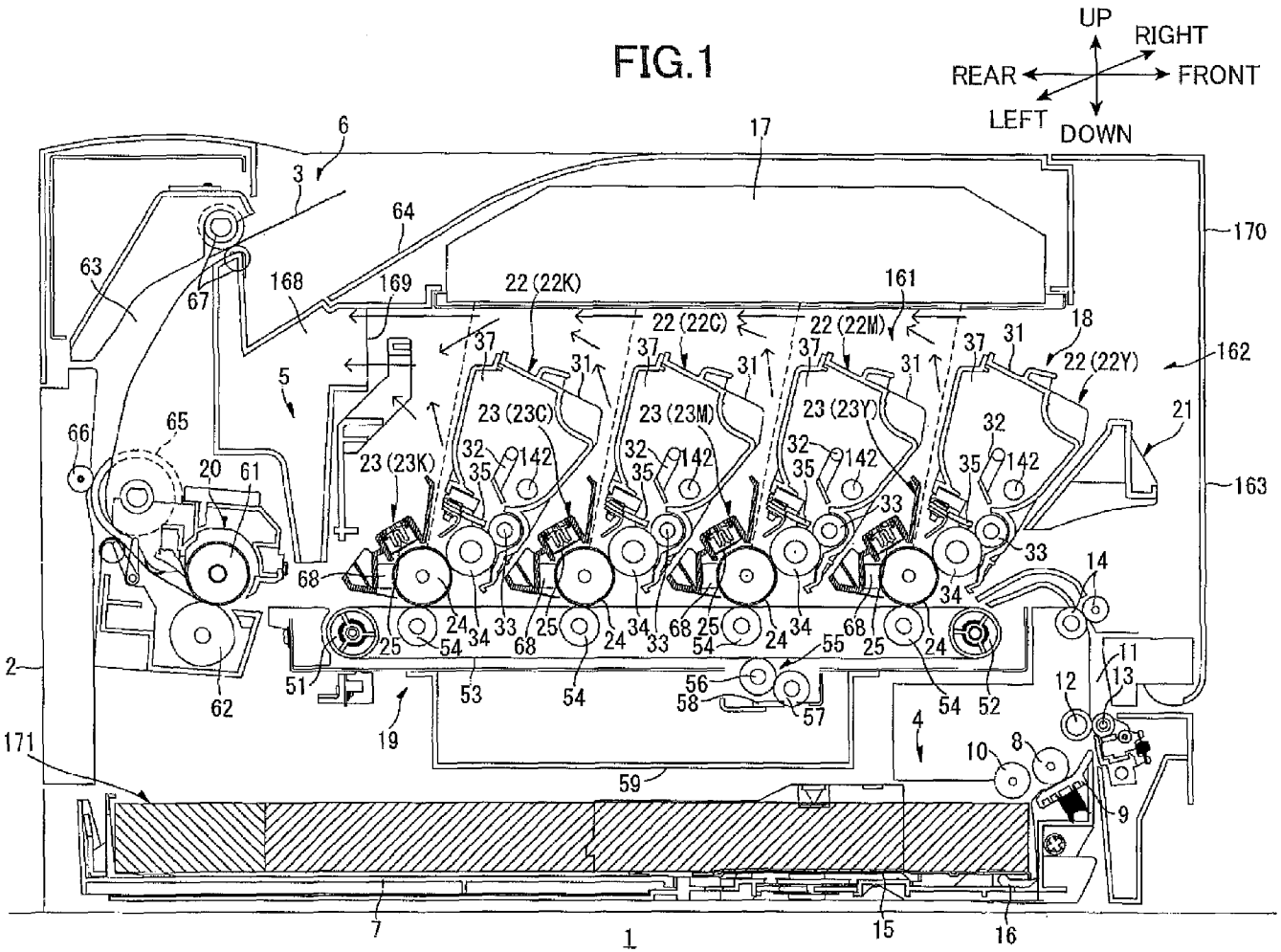
FIG. 1 is a side cross-sectional view showing a color laser printer as an aspect of the image-forming device of the invention.

A tandem photosensitive-member unit for an image-forming device according to some aspects of the invention will be described while referring to the accompanying drawings wherein like parts and components are designated by the same reference numerals to avoid duplicating description.

1. General Structure of a Color Laser Printer

Figure 2:
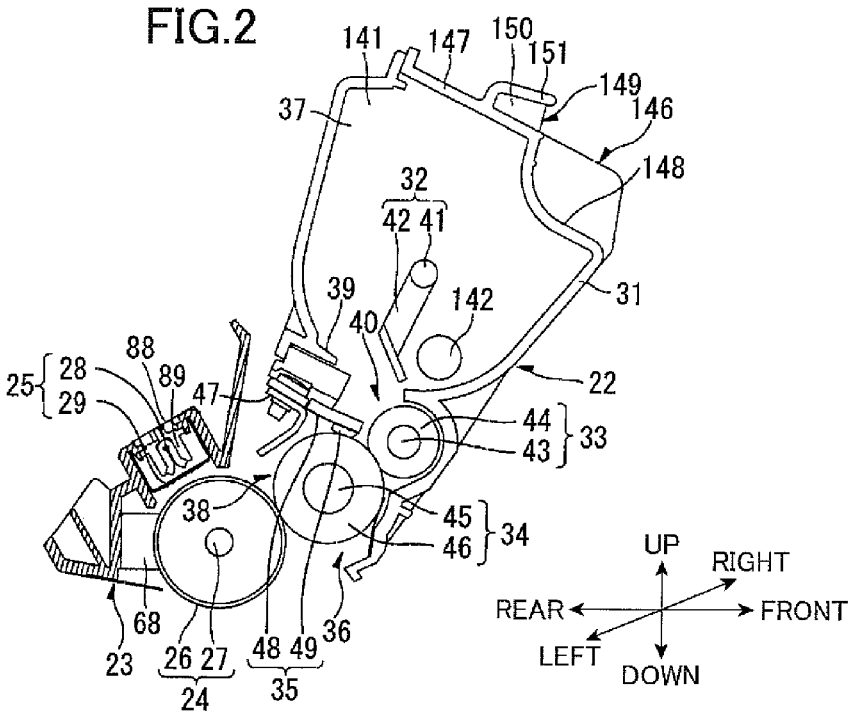
FIG. 2 is a side cross-sectional view of a drum subunit provided in the color laser printer of FIG. 1 on which a developer cartridge is mounted.
Figure 3:
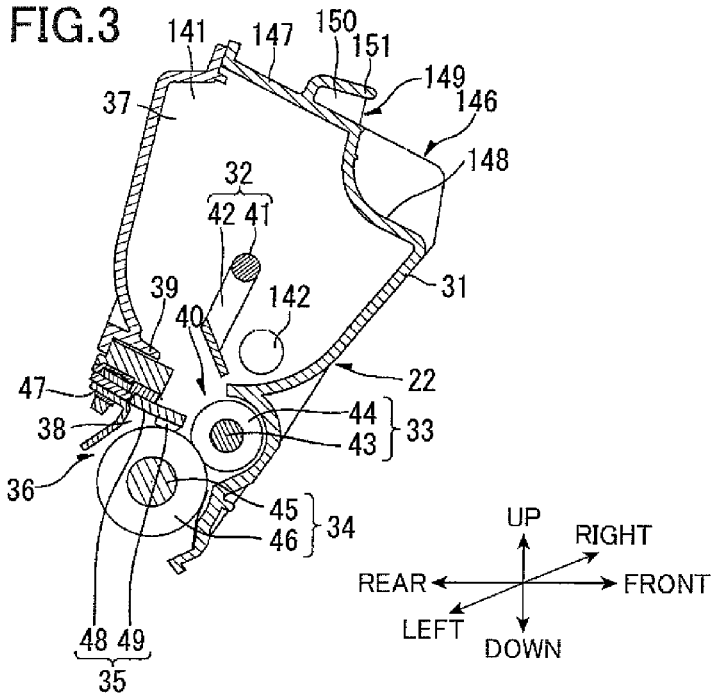
FIG. 3 is a side cross-sectional view of the developer cartridge shown in FIG. 2.

FIG. 1 is a side cross-sectional view showing a color laser printer 1 as an aspect of the image-forming device of the invention. FIG. 2 is a side cross-sectional view of a drum subunit provided in the color laser printer 1 of FIG. 1 on which a developer cartridge 22 is mounted. FIG. 3 is a side cross-sectional view of the developer cartridge 22 shown in FIG. 2.

As shown in FIG. 1, a color laser printer 1 is a horizontal tandem-type printer having a plurality of drum subunits 23 juxtaposed in a horizontal direction. The printer 1 includes a main casing 2 and, within the main casing 2, a feeding unit 4 for supplying sheets of a paper 3, an image-forming unit 5 for forming images on the paper 3 supplied from the feeding unit 4, and a discharge unit 6 for discharging the paper 3 after an image has been formed thereon.

In the following description, the right side of the printer 1 in FIG. 1 (side of the main casing 2 in which a drum access opening 162 is formed) will be referred to as the "front side," while the left side of the printer 1 in FIG. 1 will be referred to as the "rear side." Further, the near side in FIG. 1 with respect to the paper width direction will be referred to as the "left side," while the far side in FIG. 1 will be referred to as the "right side."

Unless otherwise stated below, directions in the following description of a drum unit 21 and developer cartridges 22 will conform to the state in which the drum unit 21 and developer cartridges 22 are mounted in the main casing 2.

(1) Feeding Unit

The feeding unit 4 includes a paper tray 7 for accommodating the paper 3 that can be slid into or removed from a tray-accommodating section 171, described later, in a lower section of the main casing 2 in a front-to-rear direction; a separating roller 8 and a separating pad 9 disposed above a front end of the paper tray 7 and in confrontation with each other; and a feeding roller 10 disposed on the rear side of the separating roller 8.

The feeding unit 4 includes a feeding-end paper-conveying path 11 for guiding the paper 3 conveyed from the paper tray 7. The feeding-end paper-conveying path 11 is substantially U-shaped in a side view for initially guiding the paper 3 forward and subsequently reversing directions toward the rear. The feeding-end paper-conveying path 11 has an upstream end positioned on the lower side of the U-shape adjacent to the separating roller 8, and a downstream end positioned on the upper side of the U-shape adjacent to a conveying belt 53 described later.

The feeding unit 4 also includes a paper dust roller 12 and a pinch roller 13 disposed in confrontation with each other along the feeding-end paper-conveying path 11 and positioned above and forward of the separating roller 8; and a pair of registration rollers 14 also disposed on the feeding-end paper-conveying path 11 above the paper dust roller 12 and pinch roller 13.

A paper-pressing plate 15 is provided inside the paper tray 7 for supporting the paper 3 in a stacked state. The paper-pressing plate 15 is pivotably supported on the rear end thereof, so that the front end can pivot downward to a resting position in which the paper-pressing plate 15 rests on a bottom plate of the paper tray 7 and can pivot upward to a feeding position in which the paper-pressing plate slopes upward from the rear end to the front end.

A lever 16 is provided in the lower front section of the paper tray 7 for lifting the front end of the paper-pressing plate 15 upward. The lever 16 is pivotably supported at a position below the front end of the paper-pressing plate 15 so that the front end of the lever 16 can move up and down.

By pivoting the lever 16, the lever 16 lifts the front end of the paper-pressing plate 15, shifting the paper-pressing plate 15 into the feeding position. When the paper-pressing plate 15 is in the feeding position, the topmost sheet of paper 3 stacked on the paper-pressing plate 15 is pressed against the feeding roller 10. When the feeding roller 10 rotates, the paper 3 is fed toward a position between the separating roller 8 and separating pad 9.

When the paper tray 7 is removed from the main casing 2, the paper-pressing plate 15 settles into the resting position. While the paper-pressing plate 15 is in the resting position, sheets of the paper 3 can be stacked on the paper-pressing plate 15. After the feeding roller 10 has fed the paper 3 to a position between the separating roller 8 and separating pad 9, the rotating separating roller 8 separates and conveys the paper 3 one sheet at a time. The sheet conveyed by the separating roller 8 passes between the paper dust roller 12 and pinch roller 13, at which time the paper dust roller 12 removes paper dust from the paper 3, and continues along the feeding-end paper-conveying path 11 toward the registration rollers 14.

After registering the paper 3, the registration rollers 14 convey the paper 3 to the conveying belt 53.

(2) Image-Forming Unit (2-1) Scanning Unit

The image-forming unit 5 includes a scanning unit 17, a process unit 18, a transfer unit 19, and a fixing unit 20. A single scanning unit 17 is disposed in the top section of the main casing 2. Although not shown in the drawings, the scanning unit 17 includes a laser light-emitting unit, a polygon mirror, and a plurality of lenses and reflecting mirrors. The laser light-emitting unit emits laser beams based on image data for each color. After passing through the lenses and reflecting off the reflecting mirrors, the laser beams irradiate respective photosensitive drums 24 corresponding to each color.

(2-2) Process Unit

The process unit 18 is disposed below the scanning unit 17 and above the feeding unit 4. As will be described later, the process unit 18 includes a single drum unit 21, and four developer cartridges 22 corresponding to the four colors.

(2-2-1) Drum Unit

As will be described in detail later, the drum unit 21 is detachably mounted in a drum-accommodating section 161 of the main casing 2 from the front side of the main casing 2 in a front-to-rear direction. The drum unit 21 includes four drum subunits 23 for each of the four colors. Specifically, the four drum subunits 23 are a yellow drum subunit 23Y, a magenta drum subunit 23M, a cyan drum subunit 23C, and a black drum subunit 23K.

The drum subunits 23 are disposed parallel to each other at intervals in the front-to-rear direction. Specifically, the drum subunits 23 are arranged from the front side to the rear side in the order yellow drum subunit 23Y, magenta drum subunit 23M, cyan drum subunit 23C, and black drum subunit 23K. As will be described later, each drum subunit 23 includes a pair of side frame sections 71, and a center frame section 72 spanning between the side frame sections 71 (see FIGS. 9 and 10).

As shown in FIG. 2, each drum subunit 23 holds the photosensitive drum 24, a Scorotron charger 25, and a cleaning brush 68.

The photosensitive drum 24 extends in a width direction (hereinafter, the width direction will denote a left-to-right direction orthogonal to the front-to-rear direction and the vertical direction). The photosensitive drum 24 includes a main drum body 26 that is cylindrical in shape and has a positive charging photosensitive layer formed of polycarbonate on its outer surface, and a drum shaft 27 disposed along the axis of the main drum body 26.

Both widthwise ends of the drum shaft 27 are inserted into the side frame sections 71 described later (see FIG. 10) and are positioned by side plates 121 described later (see FIG. 7).

Rotational support members 30 (see FIG. 12A) are fitted onto both axial ends of the main drum bodies 26 so as to be incapable of rotating relative to the same but capable of rotating relative to the drum shafts 27. With this structure, the main drum bodies 26 are rotatably supported on the drum shafts 27. During an image-forming process, the photosensitive drum 24 is rotated by a driving force transmitted from a motor (not shown) provided in the main casing 2.

As shown in FIG. 2, the charger 25 is supported on the center frame section 72 described later diagonally above and rearward of the photosensitive drum 24. The charger 25 opposes the photosensitive drum 24 at a distance. The charger 25 includes a discharge wire 28 disposed in opposition to but separated from the photosensitive drum 24, and a grid 29 provided between the discharge wire 28 and photosensitive drum 24.

The discharge wire 28 is connected to a wire electrode 80 (see FIG. 12B) described later. The grid 29 is connected to a grid electrode 81 (FIG. 12B) described later.

During an image-forming operation, a high-voltage circuit board (not shown) provided in the main casing 2 applies a high voltage to the discharge wire 28 via the wire electrode 80 to produce a corona discharge from the discharge wire 28. At the same time, a high-voltage circuit board (not shown) provided in the main casing 2 applies a high voltage to the grid via the grid electrode 81 to apply a uniform positive charge to the surface of the photosensitive drum 24 while controlling the amount of charge supplied thereto.

The cleaning brush 68 is supported on the center frame section 72 described later at a position rearward of the photosensitive drum 24 and opposes and is in contact with the photosensitive drum 24. During an image-forming operation, the high-voltage circuit board (not shown) provided in the main casing 2 applies a cleaning bias to the cleaning brush 68 via a cleaning electrode 83 described later (see FIG. 12B).

(2-2-2) Developer Cartridge

As shown in FIG. 1, the developer cartridges 22 are detachably mounted in correspondence to the drum subunits 23 for each color. Specifically, the developer cartridges 22 include a yellow developer cartridge 22Y detachably mounted on the yellow drum subunit 23Y, a magenta developer cartridge 22M detachably mounted on the magenta drum subunit 23M, a cyan developer cartridge 22C detachably mounted on the cyan drum subunit 23C, and a black developer cartridge 22K detachably mounted on the black drum subunit 23K.

As shown in FIG. 3, each developer cartridge 22 includes a developer frame 31 and, within the developer frame 31, an agitator 32, a supply roller 33, a developing roller 34, and a thickness-regulating blade 35.

The developer frame 31 is formed in a box shape having an opening 36 on the lower end. A partitioning wall 39 is provided midway in the developer frame 31 with respect to the vertical for partitioning the interior of the developer frame 31 into a toner-accommodating chamber 37 and a developing chamber 38. A through-hole 40 is formed in the partitioning wall 39 to allow communication between the toner-accommodating chamber 37 and developing chamber 38.

The toner-accommodating chamber 37 accommodates toner corresponding to one of the four colors. More specifically, the toner-accommodating chamber 37 of the yellow developer cartridge 22Y accommodates yellow toner, the toner-accommodating chamber 37 of the magenta developer cartridge 22M accommodates magenta toner, the toner-accommodating chamber 37 of the cyan developer cartridge 22C accommodates cyan toner, and the toner-accommodating chamber 37 of the black developer cartridge 22K accommodates black toner.

The toner of each color is a nonmagnetic, single-component toner having a positive charge. The polymerized toner is spherical in shape and is obtained by co-polymerizing a polymerized monomer using a well-known polymerization method such as suspension polymerization. The polymerized monomer may be, for example, a styrene monomer such as styrene or an acrylic monomer such as acrylic acid, alkyl (C1-C4) acrylate, or alkyl (C1-C4) meta acrylate. The base particle of the toner is formed primarily of a binding resin that is compounded with a coloring agent of the corresponding color, a charge-controlling agent, wax, and the like and further includes an additive for improving fluidity.

A coloring agent in yellow, magenta, cyan, and black is compounded to produce each of these colors. The charge-controlling agent is a charge-controlling resin obtained by co-polymerizing an ionic monomer having an ionic functional group, such as ammonium salt, with a monomer that can be co-polymerized with an ionic monomer, such as a styrene monomer or an acrylic monomer. The additive may be powder of a metal oxide, such as silica, aluminum oxide, titanium oxide, strontium titanate, cerium oxide, or magnesium oxide; or an inorganic powder, such as a carbide powder or metal salt powder.

Figure 8:
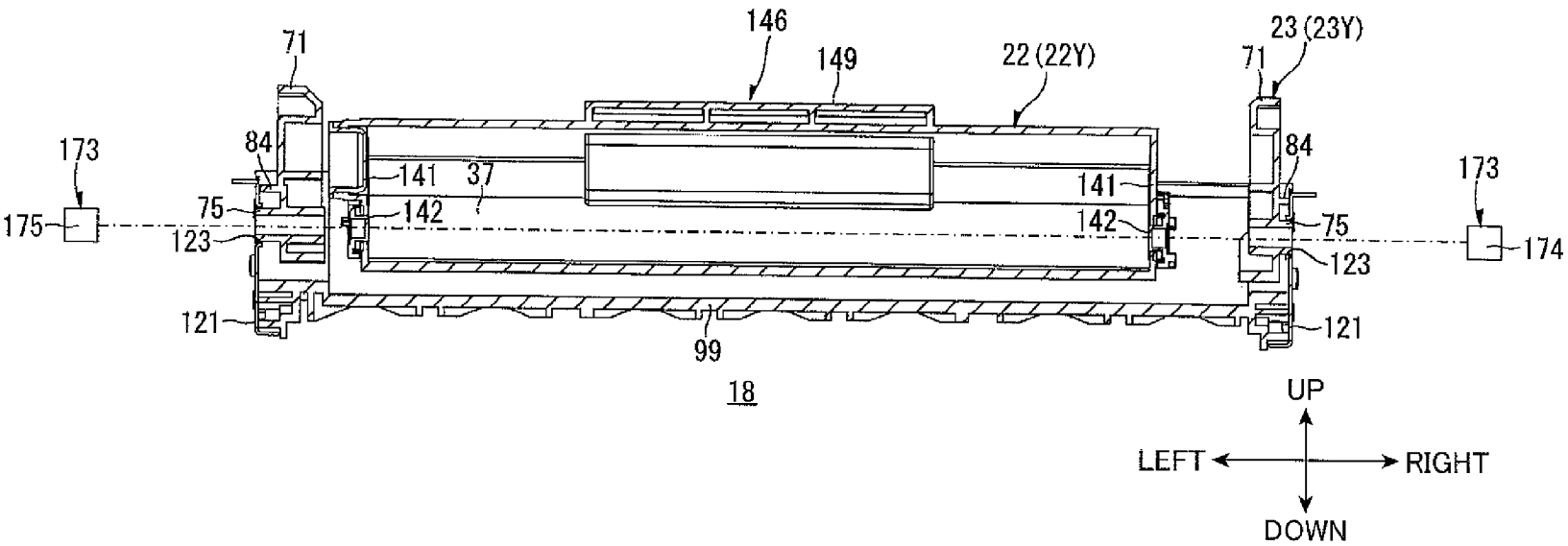
FIG. 8 is a cross-sectional view along a line VIII-VIII indicated in FIG. 7.

Windows 142 are also formed in the toner-accommodating chamber 37 for detecting the amount of toner remaining in the toner-accommodating chamber 37. The windows 142 are embedded in both side walls 141 of the developer frame 31 at positions opposing each other across the toner-accommodating chamber 37 (FIG. 8).

The agitator 32 is disposed in the toner-accommodating chamber 37 and includes a rotational shaft 41 rotatably supported in both side walls 141 of the developer frame 31, and an agitating member 42 provided on the rotational shaft 41 along the axial direction thereof and extending radially outward from the rotational shaft. During image formation, a driving force from a motor (not shown) provided in the main casing 2 is transmitted to the rotational shaft 41 via a passive coupling gear 144 (see FIG. 17), causing the agitating member 42 to move circularly within the toner-accommodating chamber 37.

The supply roller 33 is disposed inside the developing chamber 38 below the through-hole 40. The supply roller 33 includes a supply roller shaft 43 formed of metal that is rotatably supported in both side walls 141 of the developer frame 31, and a sponge roller 44 formed of an electrically conductive sponge material covering the periphery of the supply roller shaft 43. During image formation, a driving force from a motor (not shown) provided in the main casing 2 is transmitted to the supply roller shaft 43 via the passive coupling gear 144 to drive the supply roller 33 to rotate.

The developing roller 34 is disposed inside the developing chamber 38 diagonally below and rearward of the supply roller 33. The developing roller 34 includes a developing roller shaft 45 formed of metal and rotatably supported in both side walls 141 of the developer frame 31, and a rubber roller 46 formed of an electrically conductive rubber that covers the periphery of the developing roller shaft 45.

More specifically, the rubber roller 46 has a two layer structure including a rubber roller layer configured of an electrically conductive urethane rubber, silicon rubber, EPDM rubber, or the like containing fine carbon particles and the like; and a coating applied to the surface of the rubber roller layer and formed primarily of urethane rubber, urethane resin, polyimide resin, or the like. A developing roller electrode 82 described later (see FIG. 12B) is connected to the developing roller shaft 45.

The developing roller 34 is disposed against the supply roller 33 so as to generate pressure between the rubber roller 46 and sponge roller 44. The developing roller 34 is also exposed on the bottom of the developer cartridge 22 through the opening 36.

During image formation, a driving force from a motor (not shown) provided in the main casing 2 is transmitted to the developing roller shaft 45 via the passive coupling gear 144 (FIG. 17) for rotating the developing roller 34. A developing bias supplied from the high-voltage circuit board (not shown) provided in the main casing 2 is also applied to the developing roller 34 via the developing roller electrode 82.

The thickness-regulating blade 35 is disposed in the developing chamber 38 so as to press against the developing roller 34 from above. The thickness-regulating blade 35 includes a blade 48 configured of a metal leaf spring member, and a pressing part 49 provided on a distal end of the blade 48. The pressing part 49 is formed of an insulating silicon rubber and has a semicircular cross-section.

A base end of the blade 48 is fixed to the partitioning wall 39 by a fixing member 47, while the elastic force of the blade 48 causes the pressing part 49 on the distal end to contact the rubber roller 46 of the developing roller 34 from above.

(2-2-3) Developing Operation in the Process Unit

In each developer cartridge 22, toner of the corresponding color accommodated in the toner-accommodating chamber 37 shifts toward the through-hole 40 by its own weight. As the agitator 32 agitates the toner, some of the toner is discharged through the through-hole 40 into the developing chamber 38.

Toner discharged through the through-hole 40 into the developing chamber 38 is supplied onto the supply roller 33. As the supply roller 33 rotates, the toner borne on the supply roller 33 is supplied to the developing roller 34. At this time, the toner is positively tribocharged between the supply roller 33 and the developing roller 34 as a developing bias is applied to the developing roller 34.

As the developing roller 34 rotates, toner supplied to the surface of the developing roller 34 passes between the pressing part 49 of the thickness-regulating blade 35 and the rubber roller 46 of the developing roller 34, thereby maintaining a thin layer of uniform thickness on the surface of the rubber roller 46.

In the meantime, as shown in FIG. 2, the charger 25 in the drum subunit 23 corresponding to the developer cartridge 22 generates a corona discharge for charging the surface of the photosensitive drum 24 with a uniform positive polarity. As the photosensitive drum 24 continues to rotate, a laser beam emitted from the scanning unit 17 is scanned at a high speed over the positively charged surface of the photosensitive drum 24, forming an electrostatic latent image on the photosensitive drum 24 corresponding to an image that will be formed on the paper 3.

Next, positively charged toner borne on the surface of the developing roller 34 comes into contact with the photosensitive drum 24 as the developing roller 34 rotates and is supplied to areas on the surface of the positively charged photosensitive drum 24 that were exposed to the laser beam and, therefore, have a lower potential. In this way, the latent image on the photosensitive drum 24 is developed into a visible image according to a reverse development process so that the photosensitive drum 24 bears a toner image corresponding to the relevant color.

Toner remaining on the photosensitive drum 24 after the transfer operation is recovered by the developing roller 34.

Further, paper dust deposited on the photosensitive drum 24 from the paper 3 is removed by the cleaning brush 68.

(2-3) Transfer Unit

As shown in FIG. 1, the transfer unit 19 is disposed in the main casing 2 above the feeding unit 4 and extends in the front-to-rear direction beneath the process unit 18. The transfer unit 19 includes a drive roller 51, a follow roller 52, the conveying belt 53, transfer rollers 54, and a cleaning unit 55.

The drive roller 51 and follow roller 52 are disposed in opposition to each other across a distance in the front-to-rear direction. The drive roller 51 is disposed rearward of the black drum subunit 23K, while the follow roller 52 is disposed forward of the yellow drum subunit 23Y.

The conveying belt 53 is an endless belt formed of a synthetic resin film such as an electrically conductive polycarbonate or polyimide containing dispersed conductive particles such as carbon. The conveying belt 53 is looped around the drive roller 51 and follow roller 52.

During image formation, a driving force from a motor (not shown) provided in the main casing 2 is transferred to the drive roller 51 for rotating the same. When the drive roller 51 is driven to rotate, the conveying belt 53 travels in a circuit around the drive roller 51 and follow roller 52, while the follow roller 52 follows the movement of the conveying belt 53. The conveying belt 53 moves in the same direction as the surfaces of the photosensitive drums 24 at transfer positions in which the conveying belt 53 contacts the photosensitive drums 24 of the drum subunits 23.

The transfer rollers 54 are disposed inside the conveying belt 53 at positions opposing each photosensitive drum 24 with the conveying belt 53 interposed therebetween. The transfer rollers 54 are configured of a metal roller shaft covered with a rubber roller that is formed of an electrically conductive rubber. The transfer rollers 54 are rotatably provided so that the surfaces of the transfer rollers 54 move in the same direction as the conveying belt 53 at the transfer positions. During image formation, the high-voltage circuit board (not shown) provided in the main casing 2 applies a transfer bias to the transfer rollers 54.

The cleaning unit 55 is disposed below the conveying belt 53 and includes a primary cleaning roller 56, a secondary cleaning roller 57, a scraping blade 58, and a toner collector 59.

The primary cleaning roller 56 is disposed so as to contact the lower portion of the conveying belt 53 on the side opposite the upper portion of the conveying belt 53 that contacts the photosensitive drums 24 and transfer rollers 54. The primary cleaning roller 56 is configured to rotate in a direction that follows the circular movement of the conveying belt 53. During image formation, the high-voltage circuit board (not shown) provided in the main casing 2 applies a primary cleaning bias to the primary cleaning roller 56.

The secondary cleaning roller 57 is disposed below the primary cleaning roller 56 and in contact with the same and is configured to rotate so that the peripheral surface of the secondary cleaning roller 57 moves in the same direction as the primary cleaning roller 56 at the contact position. During image formation, the high-voltage circuit board (not shown) provided in the main casing 2 applies a secondary cleaning bias to the secondary cleaning roller 57.

The scraping blade 58 is disposed in contact with the secondary cleaning roller 57 from below.

The toner collector 59 is disposed below the primary cleaning roller 56 and secondary cleaning roller 57 for collecting toner that falls from the secondary cleaning roller 57.

The conveying belt 53 moving circuitously along the driving of the drive roller 51 and the following of the follow roller 52 conveys the paper 3 supplied from the feeding unit 4 toward the rear of the printer 1 so that the paper 3 sequentially passes transfer positions corresponding to each drum subunit 23. As the paper 3 is conveyed, toner images in each color borne on the photosensitive drums 24 of each drum subunit 23 are sequentially transferred onto the paper 3, forming a color image thereon.

For example, first the yellow toner image borne on the surface of the photosensitive drum 24 in the yellow drum subunit 23Y is transferred onto the paper 3 after which the magenta toner image borne on the surface of the photosensitive drum 24 in the magenta drum subunit 23M is transferred onto the paper 3 and superimposed over the yellow toner image already transferred. In the same way, the cyan toner image and black toner image borne on the surfaces of the photosensitive drums 24 in the cyan drum subunit 23C and black drum subunit 23K, respectively, are superimposed over the previously transferred toner images to form a color image on the paper 3.

Any toner deposited on the surface of the conveying belt 53 in the transfer operation described above is subsequently cleaned by the cleaning unit 55. First, the toner on the surface of the conveying belt 53 is transferred to the primary cleaning roller 56 by a primary cleaning bias and is subsequently transferred to the secondary cleaning roller 57 by a secondary cleaning bias. Next, the scraping blade 58 scrapes off toner that has been transferred onto the secondary cleaning roller 57. Toner scraped off the secondary cleaning roller 57 drops into the toner collector 59.

(2-4) Fixing Unit

The fixing unit 20 is disposed in the main casing 2, rearward of the black drum subunit 23K and opposite the transfer position in which the photosensitive drum 24 contacts the conveying belt 53 in the front-to-rear direction. The fixing unit 20 includes a heating roller 61 and a pressure roller 62.

The heating roller 61 is configured of a metal tube, the surface of which has been coated with a release layer. The metal tube accommodates a halogen lamp extending along the axial direction of the main casing 2 for heating the surface of the heating roller 61 to a fixing temperature.

The pressure roller 62 is disposed below and in confrontation with the heating roller 61. The pressure roller 62 presses against the heating roller 61 from the bottom thereof.

After a color image has been transferred onto a sheet of paper 3, the paper 3 is conveyed to the fixing unit 20. In the fixing unit 20, the color image is fixed to the paper 3 by heat as the paper 3 passes between the heating roller 61 and pressure roller 62.

(3) Discharge Unit

A discharge-end conveying path 63 is provided in the discharge unit 6. The discharge-end conveying path 63 is substantially U-shaped in a side view, with an upstream end positioned on the lower side adjacent to the fixing unit 20 and a downstream end positioned on the upper side adjacent to a discharge tray 64 formed on top of the main casing 2. Hence, the discharge-end conveying path 63 initially guides the paper 3 rearward, then reverses directions and discharges the paper 3 in a forward direction.

A transfer roller 65 and a pinch roller 66 are disposed in confrontation with each other along the discharge-end conveying path 63. Further, a pair of discharge rollers 67 is disposed on the downstream end of the discharge-end conveying path 63. The discharge tray 64 is formed on top of the main casing 2 as a depression that grows gradually deeper toward the rear side. The discharge tray 64 functions to support sheets of discharged paper 3 in a stacked state.

After the paper 3 passes through the fixing unit 20, the transfer roller 65 and pinch roller 66 convey the paper 3 along the discharge-end conveying path 63 toward the discharge rollers 67 and the discharge rollers 67 discharge the paper 3 onto the discharge tray 64.

2. Drum Unit

Figure 4:
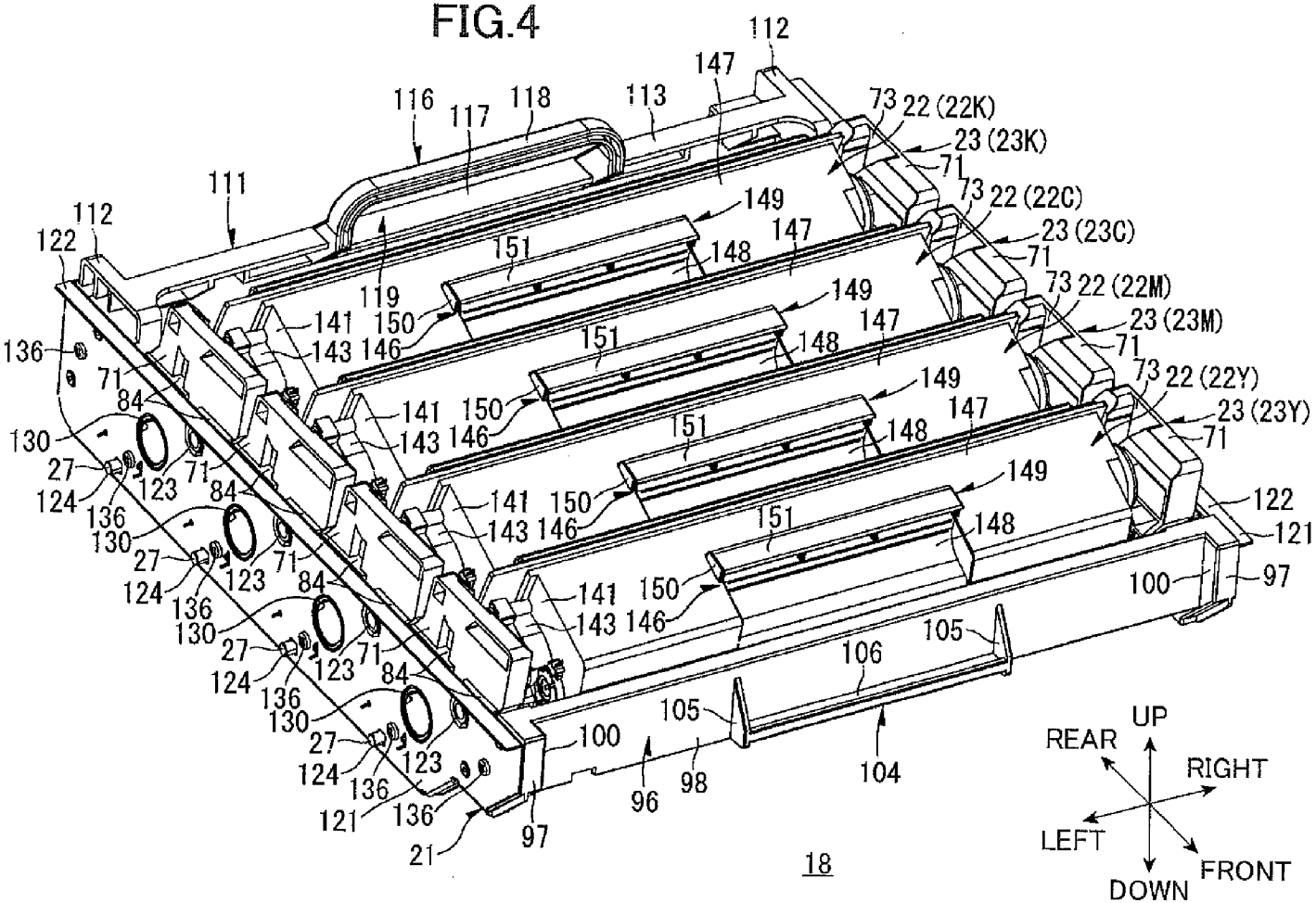
FIG. 4 is a perspective view from the left side of a drum unit in which the developer cartridges are mounted.
Figure 5:
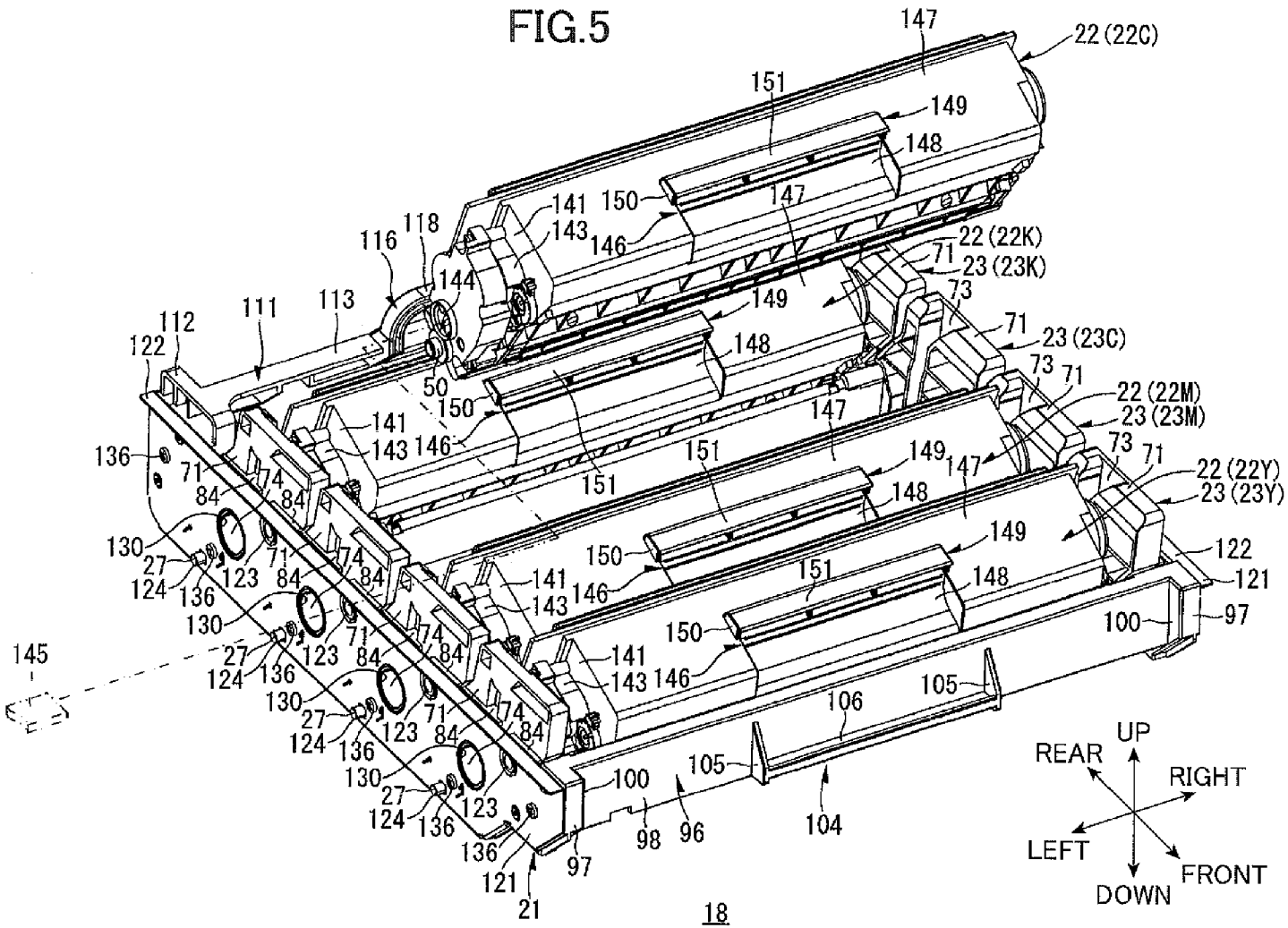
FIG. 5 is a perspective view from the left side of a drum unit in which one of the developer cartridges has been removed.
Figure 6:
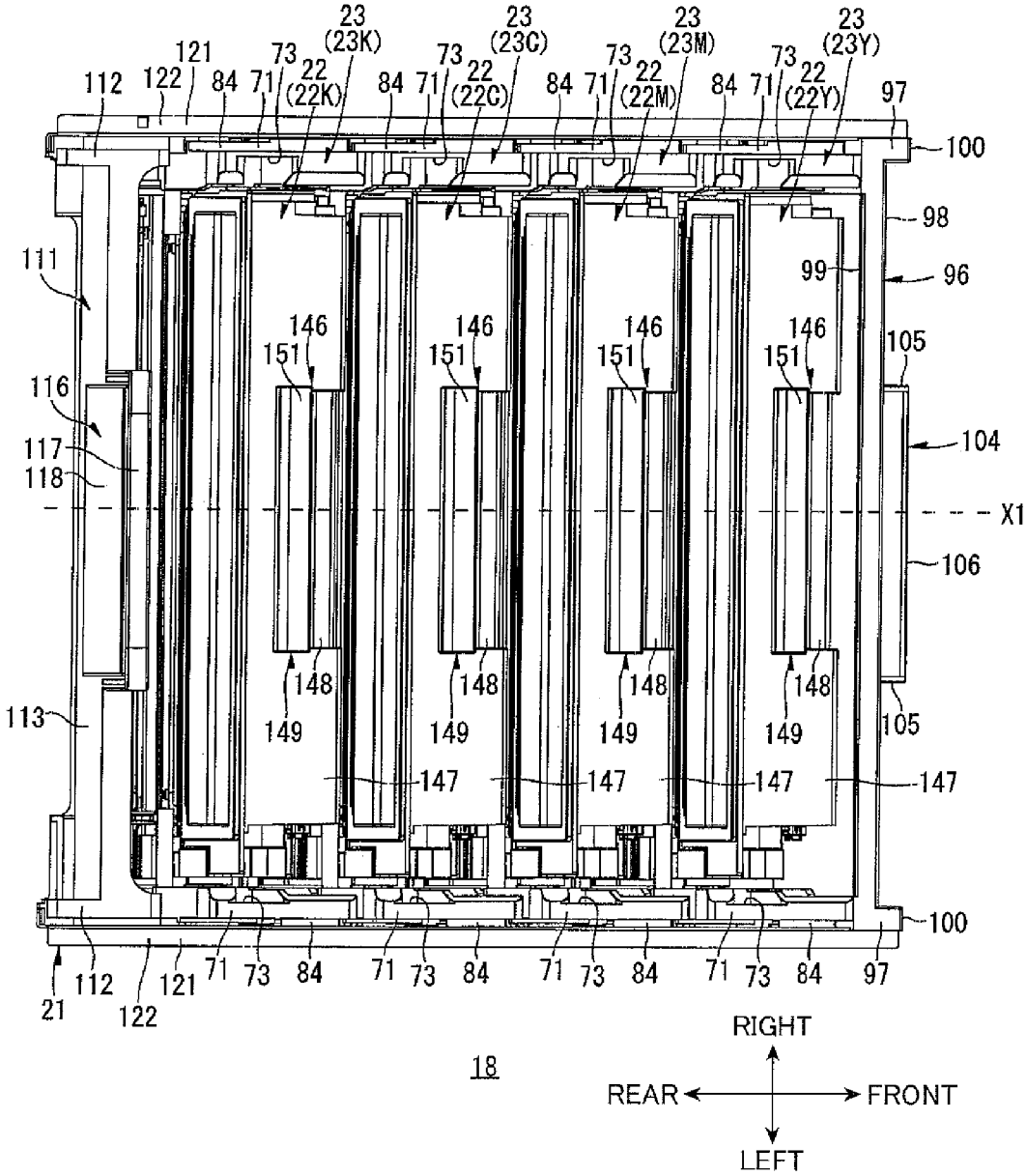
FIG. 6 is a plan view of the drum unit shown in FIG. 4.
Figure 9:
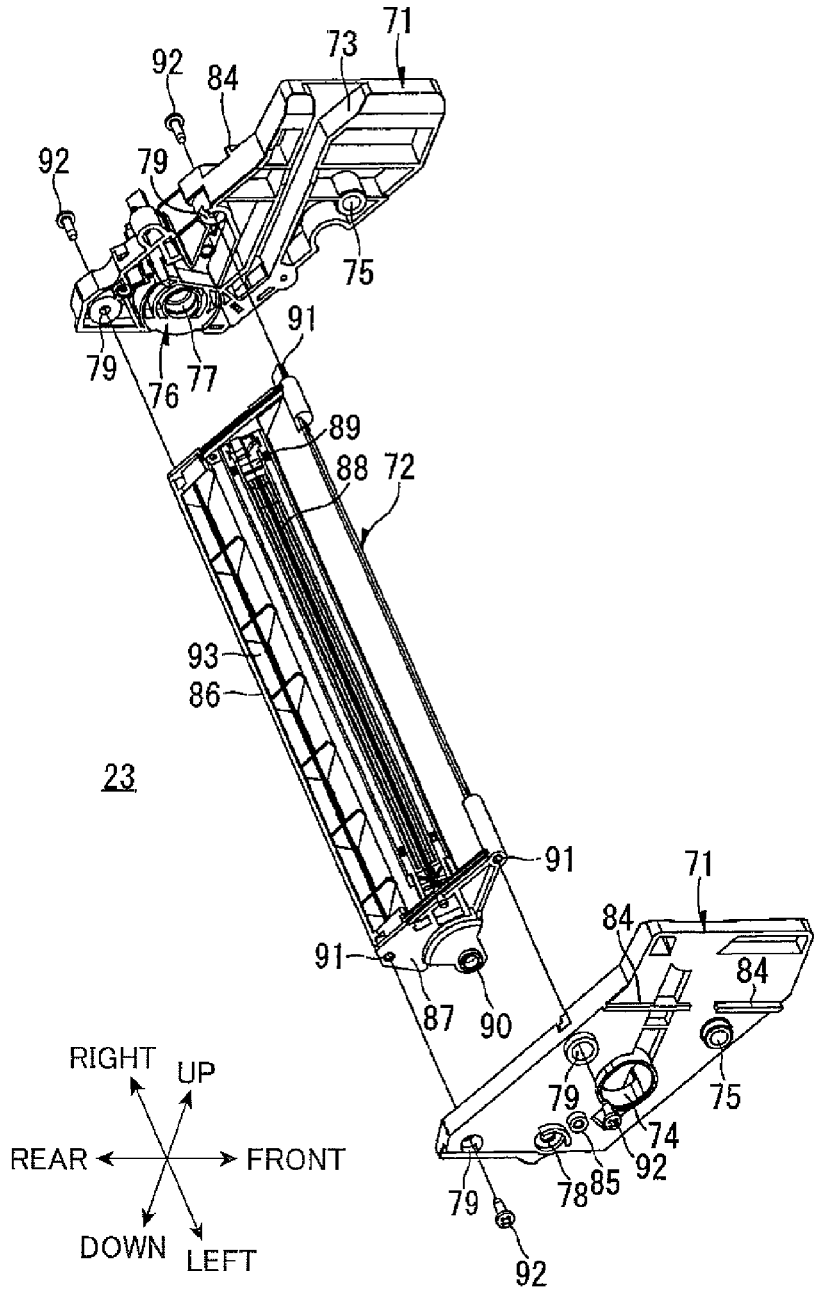
FIG. 9 is an exploded perspective view of the drum subunit.
Figure 10:
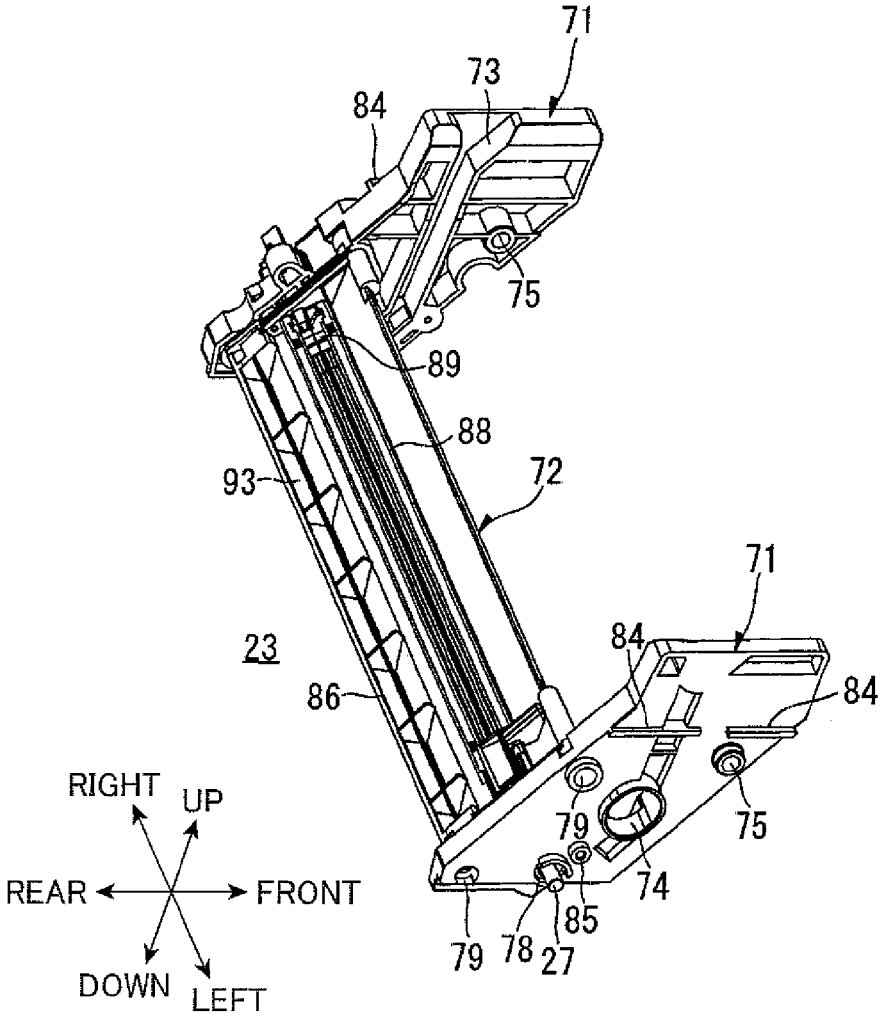
FIG. 10 is a perspective view of the drum subunit.
Figure 11:
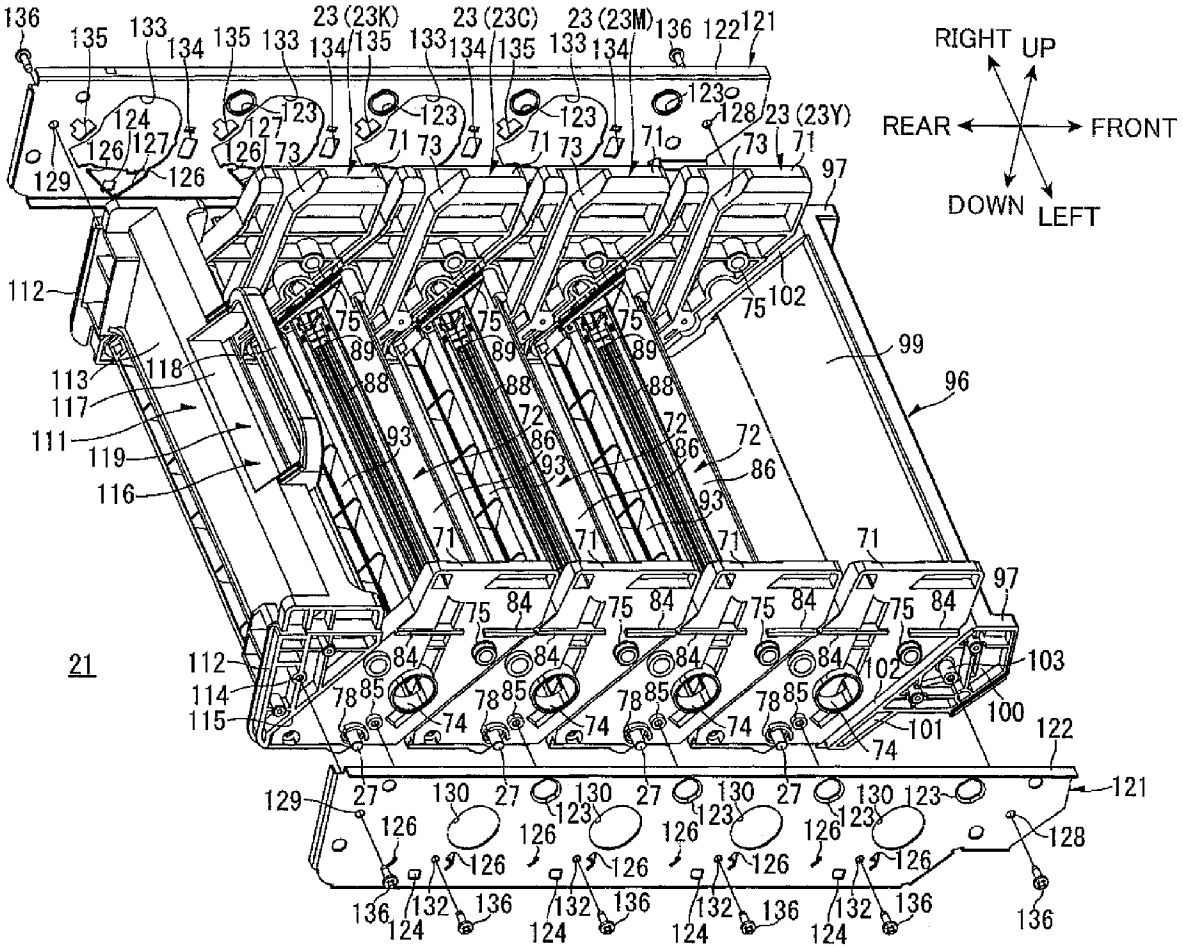
FIG. 11 is a perspective view from the left side illustrating the assembly of a pair of side plates to a front beam, four drum subunits, and a rear beam in a juxtaposed relationship.
Figure 12A:
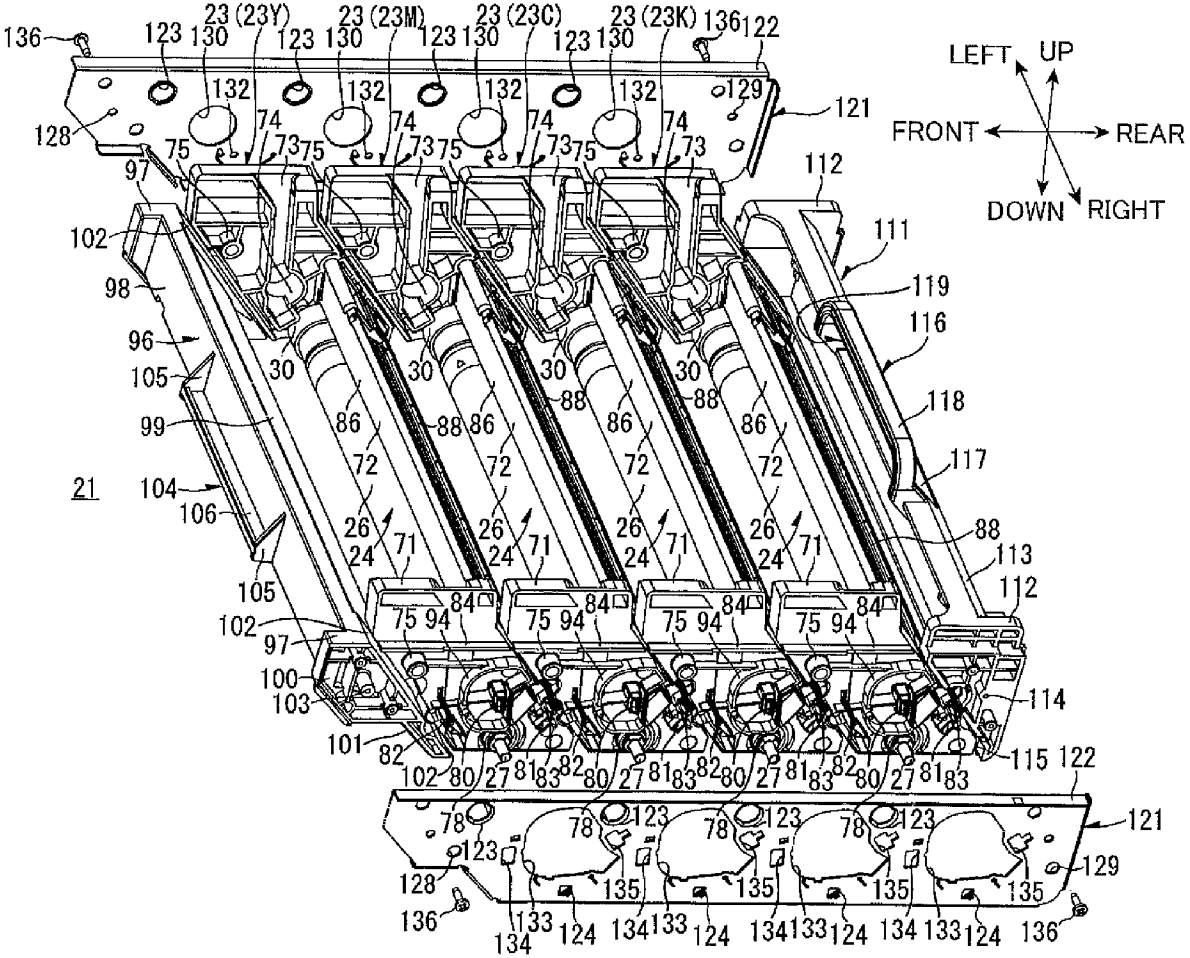
FIG. 12A is a perspective view from the right side illustrating the assembly of the pair of side plates to the front beam, four drum subunits, and rear beam in a juxtaposed relationship.
Figure 12B:
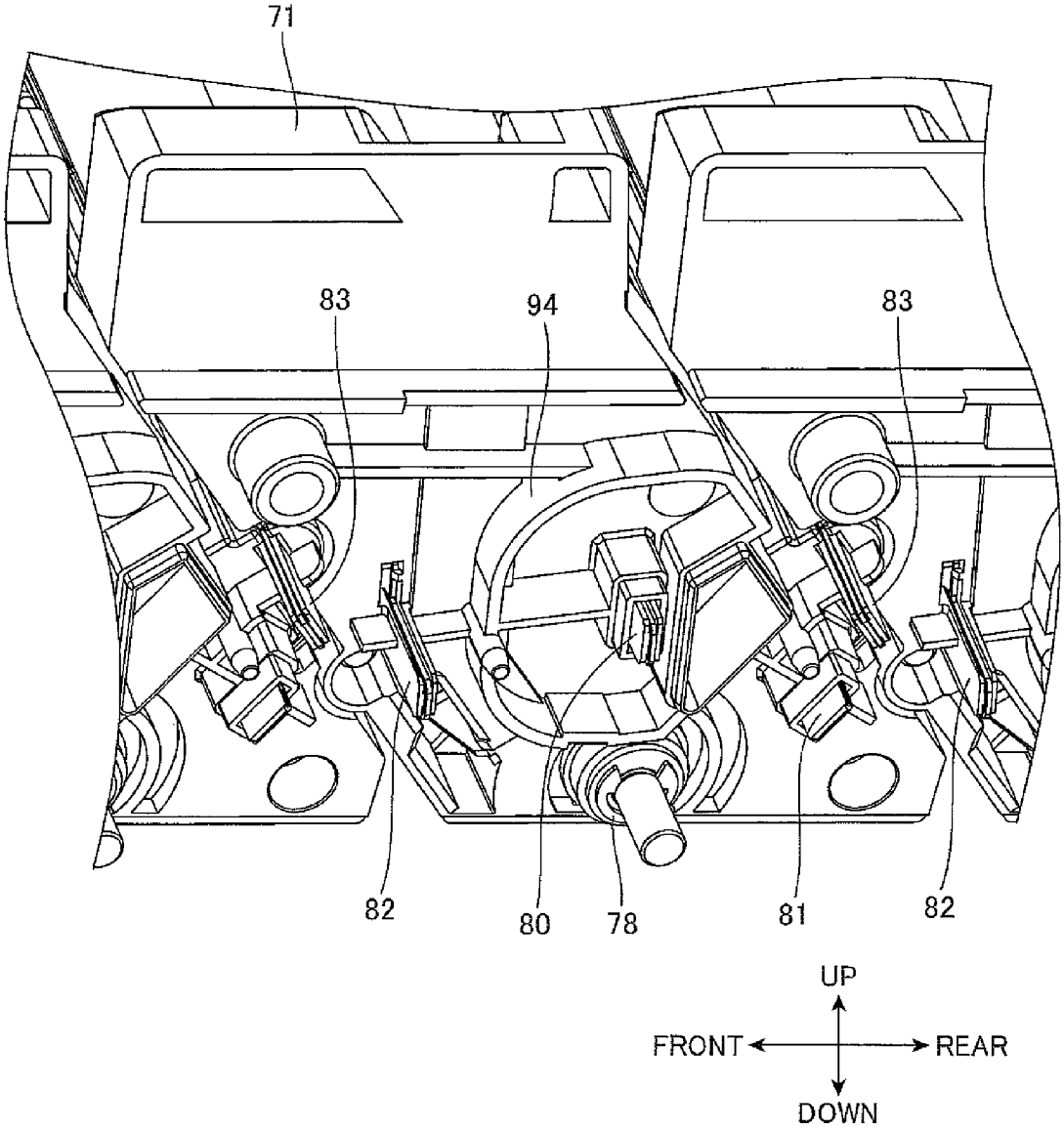
FIG. 12B is an enlarged view of FIG. 12A illustrating electrodes.
Figure 13A:
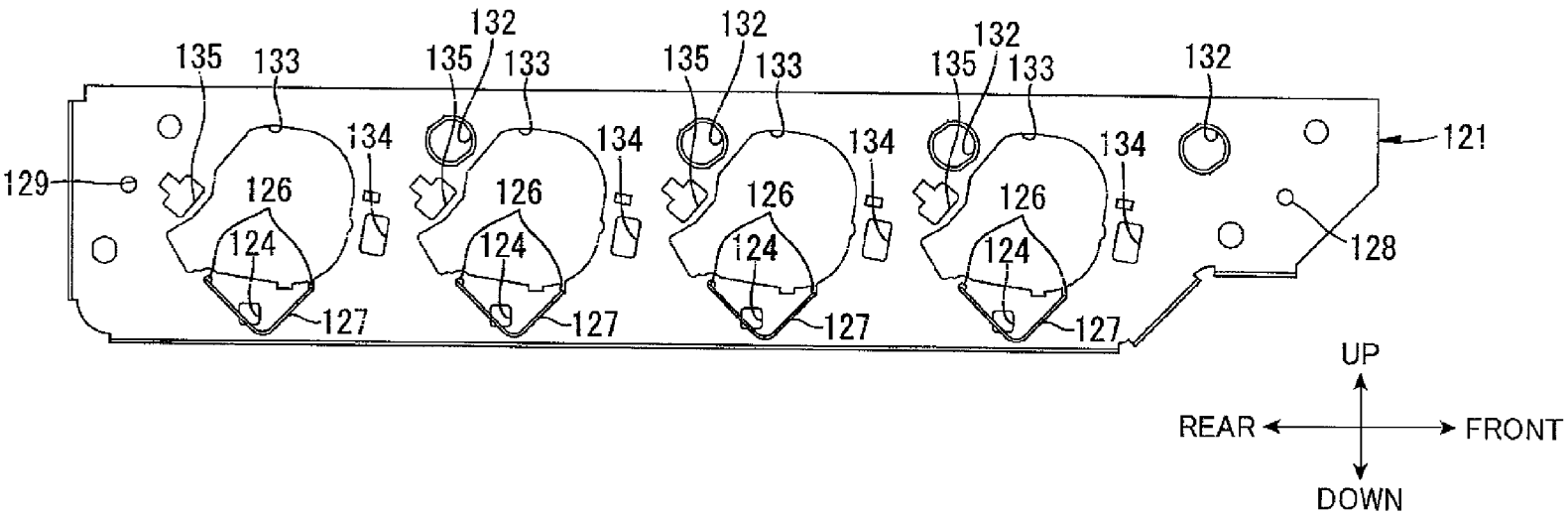
FIG. 13A is a side view illustrating the positioning of drum shafts in a side plate.
Figure 13B:
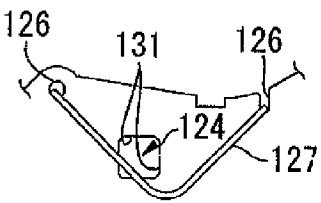
FIG. 13B is an enlarged view of FIG. 13A illustrating portions near a wire spring.
Figure 13C:
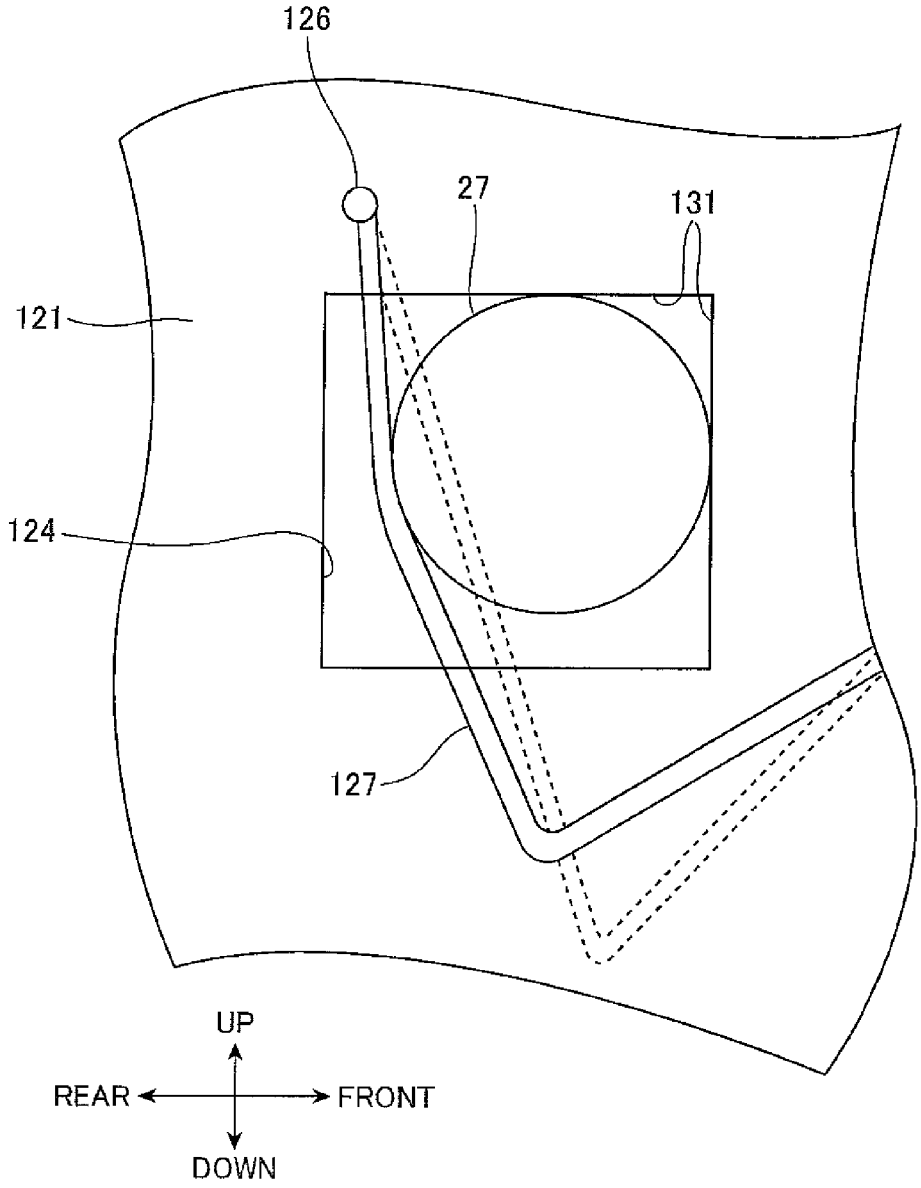
FIG. 13C is an explanatory diagram showing how the wire spring urges the drum shaft.
Figure 14:
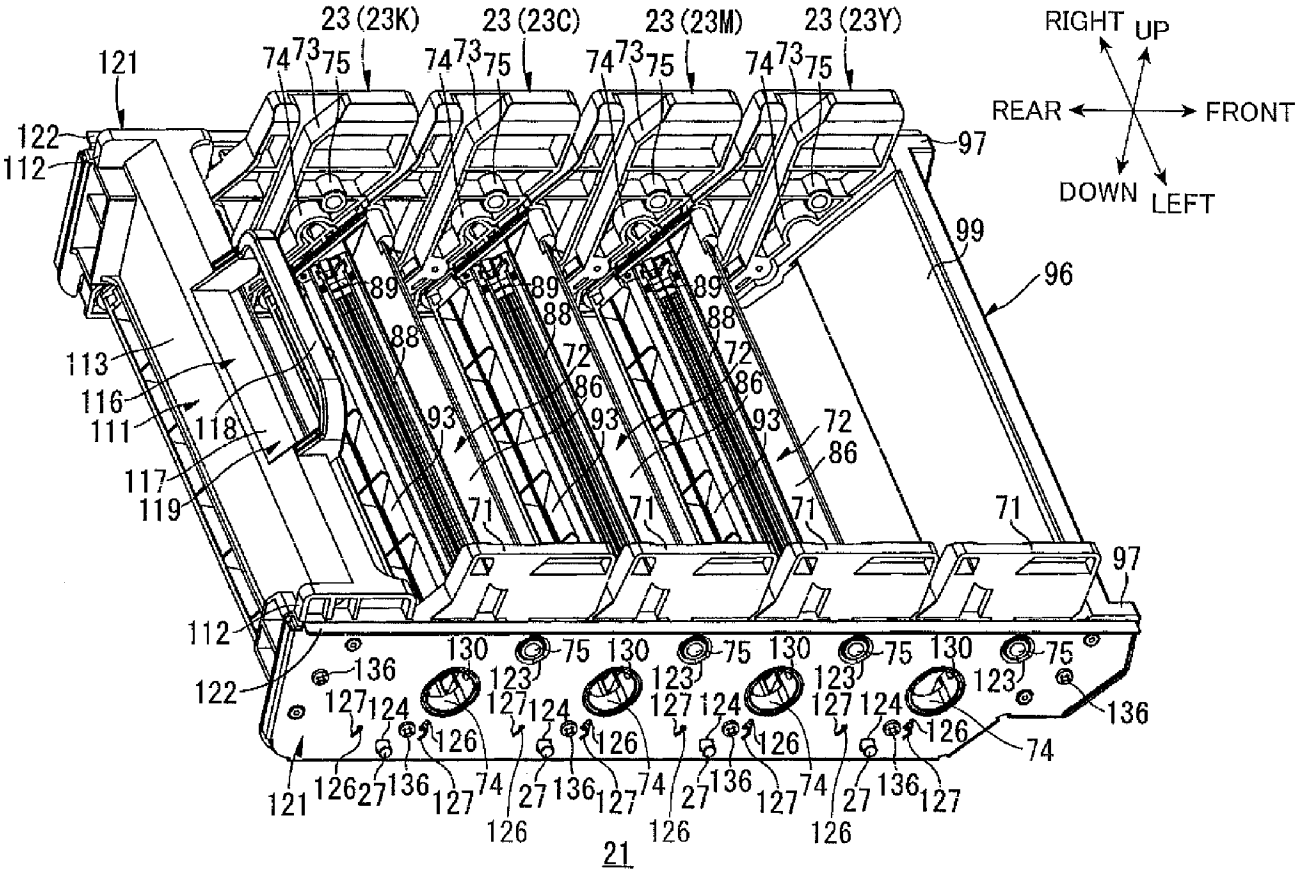
FIG. 14 is a perspective view from the left side illustrating the pair of side plates that have been assembled to the front beam, four drum subunits, and the rear beam in a juxtaposed relationship.
Figure 15A:
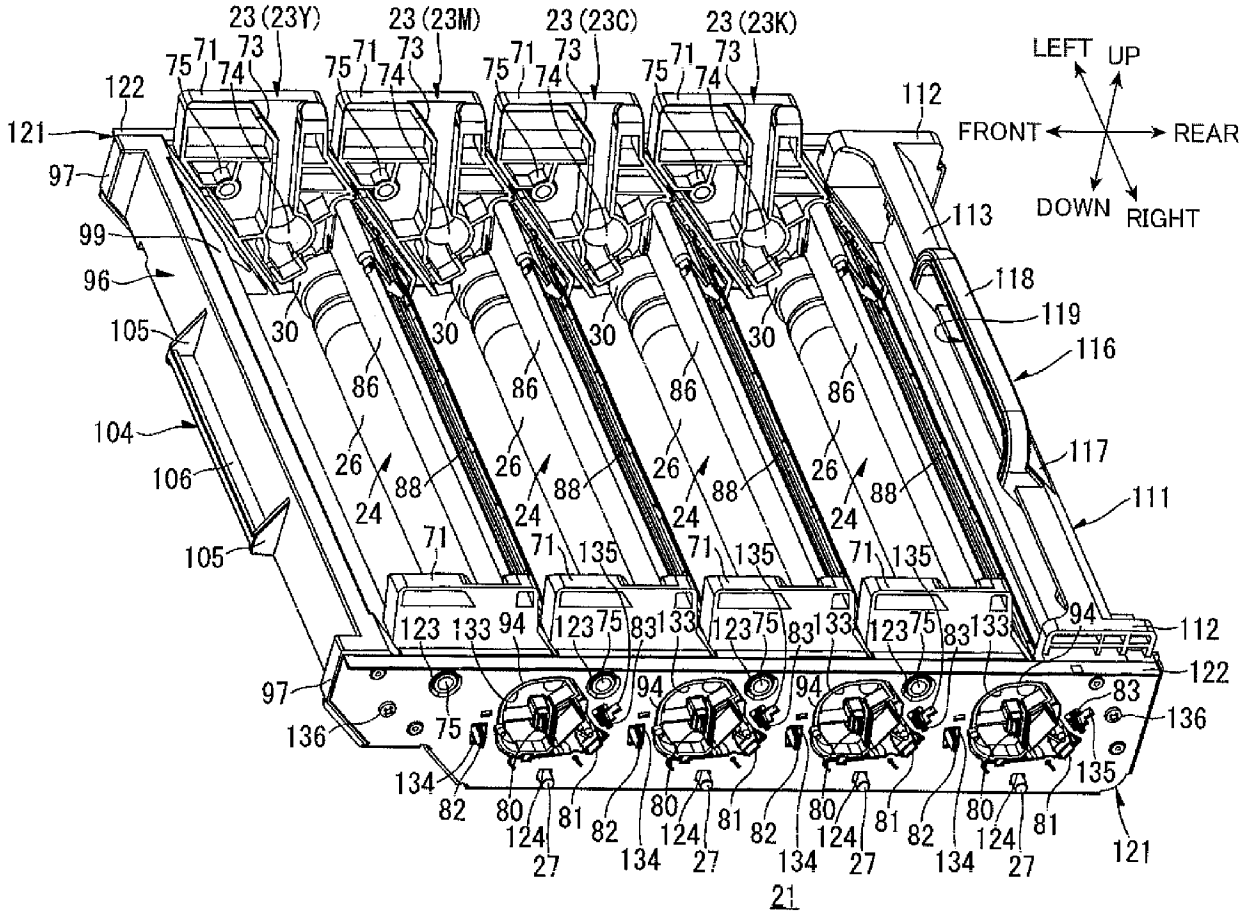
FIG. 15A is a perspective view from the right side illustrating the pair of side plates that have been assembled to the front beam, four drum subunits, and rear beam in a juxtaposed relationship.
Figure 15B:
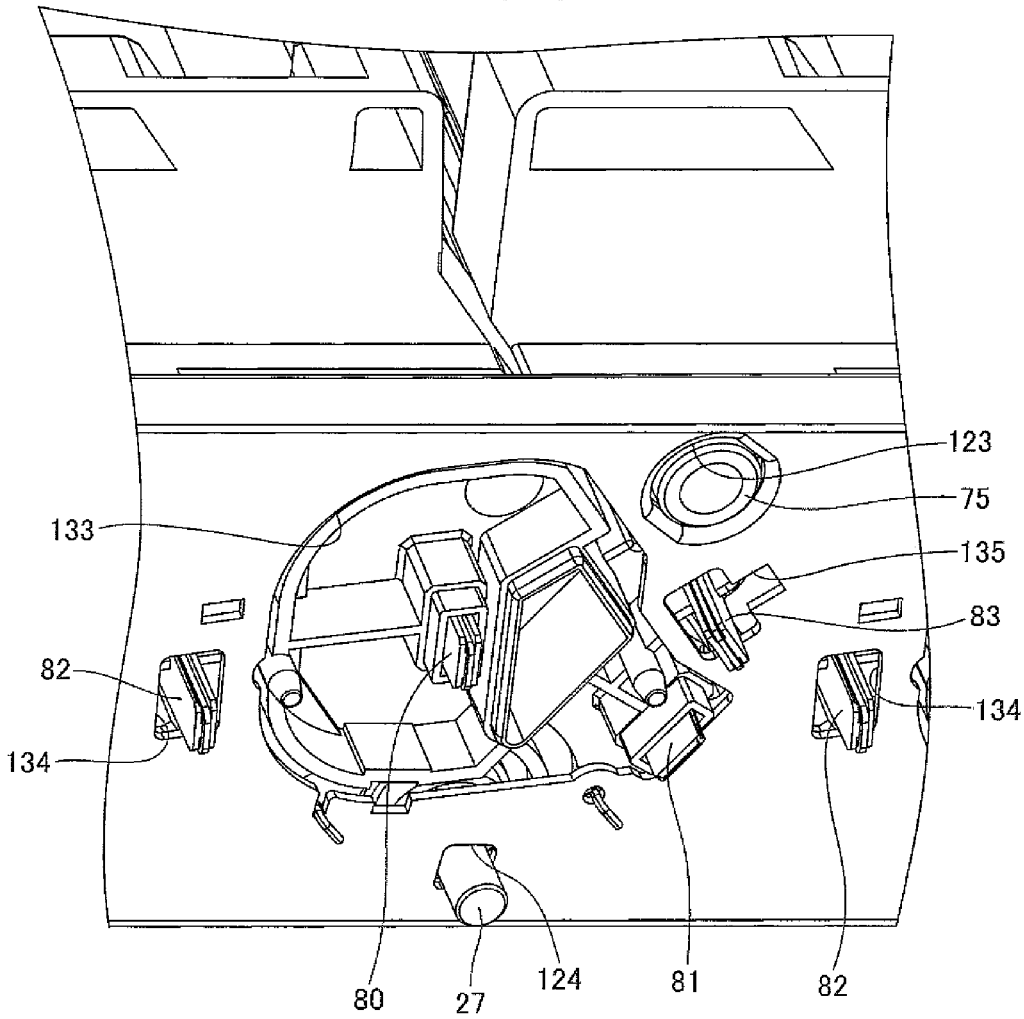
FIG. 15B is an enlarged view of FIG. 15A illustrating electrodes.

FIG. 4 is a perspective view from the left side of the drum unit 21 in which the developer cartridges 22 are mounted. FIG. 5 is a perspective view from the left side of the drum unit 21 in which one of the developer cartridges 22 has been removed. FIG. 6 is a plan view of the drum unit 21 shown in FIG. 4. FIG. 7 is a left side view of the drum unit 21 shown in FIG. 4. FIG. 8 is a cross-sectional view along a line VIII-VIII indicated in FIG. 7. FIG. 9 is an exploded perspective view of the drum subunit 21. FIG. 10 is a perspective view of the drum subunit 21. FIG. 11 is a perspective view from the left side illustrating the assembly of the pair of side plates 121 to a front beam 96, four drum subunits 23, and a rear beam 111 in a juxtaposed relationship. FIG. 12A is a perspective view from the right side illustrating the assembly of the pair of side plates 121 to the front beam 96, four drum subunits 23, and rear beam 111 in a juxtaposed relationship. FIG. 12B is an enlarged view of FIG. 12A illustrating electrodes. FIG. 13A is a side view illustrating the positioning of drum shafts 27 in the side plate 121. FIG. 13B is an enlarged view of FIG. 13A illustrating portions near a wire spring 127. FIG. 13C is an explanatory diagram showing how the wire spring 127 urges the drum shaft 27. FIG. 14 is a perspective view from the left side illustrating the pair of side plates 121 that have been assembled to the front beam 96, four drum subunits 23, and the rear beam 111 in a juxtaposed relationship. FIG. 15A is a perspective view from the right side illustrating the pair of side plates 121 that have been assembled to the front beam 96, four drum subunits 23, and rear beam 111 in a juxtaposed relationship. FIG. 15B is an enlarged view of FIG. 15A illustrating electrodes.

Next, the drum unit 21 will be described with reference to FIGS. 4 through 15B.

As shown in FIG. 4, the drum unit 21 includes the four drum subunits 23 corresponding to the four colors and juxtaposed in the front-to-rear direction; the front beam 96 and the rear beam 111 disposed on front and rear sides of the four drum subunits 23; and the pair of side plates 121 disposed on widthwise ends of the front beam 96, the four drum subunits 23, and the rear beam 111. The four drum subunits 23 (frame construction except for the photosensitive drums 24 and the like), the front beam 96, the rear beam 111, and the pair of side plates 121 constitute a unit frame.

The four drum subunits 23, the front beam 96, the rear beam 111, and the pair of side plates 121 constituting the drum unit 21 can be slidably mounted into or removed from the drum access opening 162 of the main casing 2 as an integrated unit.

(1) Drum Subunits

As shown in FIGS. 9 and 10, the drum subunit 23 includes the pair of side frame sections 71 disposed in opposition to each other over a distance in the width direction, and the center frame section 72 that spans between the side frame sections 71.

(1-1) Side Frame Sections

Each of the side frame sections 71 is formed of a synthetic resin material and has a substantially rectangular plate shape in a side view. More specifically, the side frame sections 71 are shaped substantially like parallelograms in a side view and slope downward and to the rear.

Guide grooves 73 are formed in the inner wall surfaces of the side frame sections 71 at positions opposing each other in the width direction for guiding the developer cartridge 22 as the developer cartridge 22 is mounted in or removed from the drum subunit 23.

Figure 16:
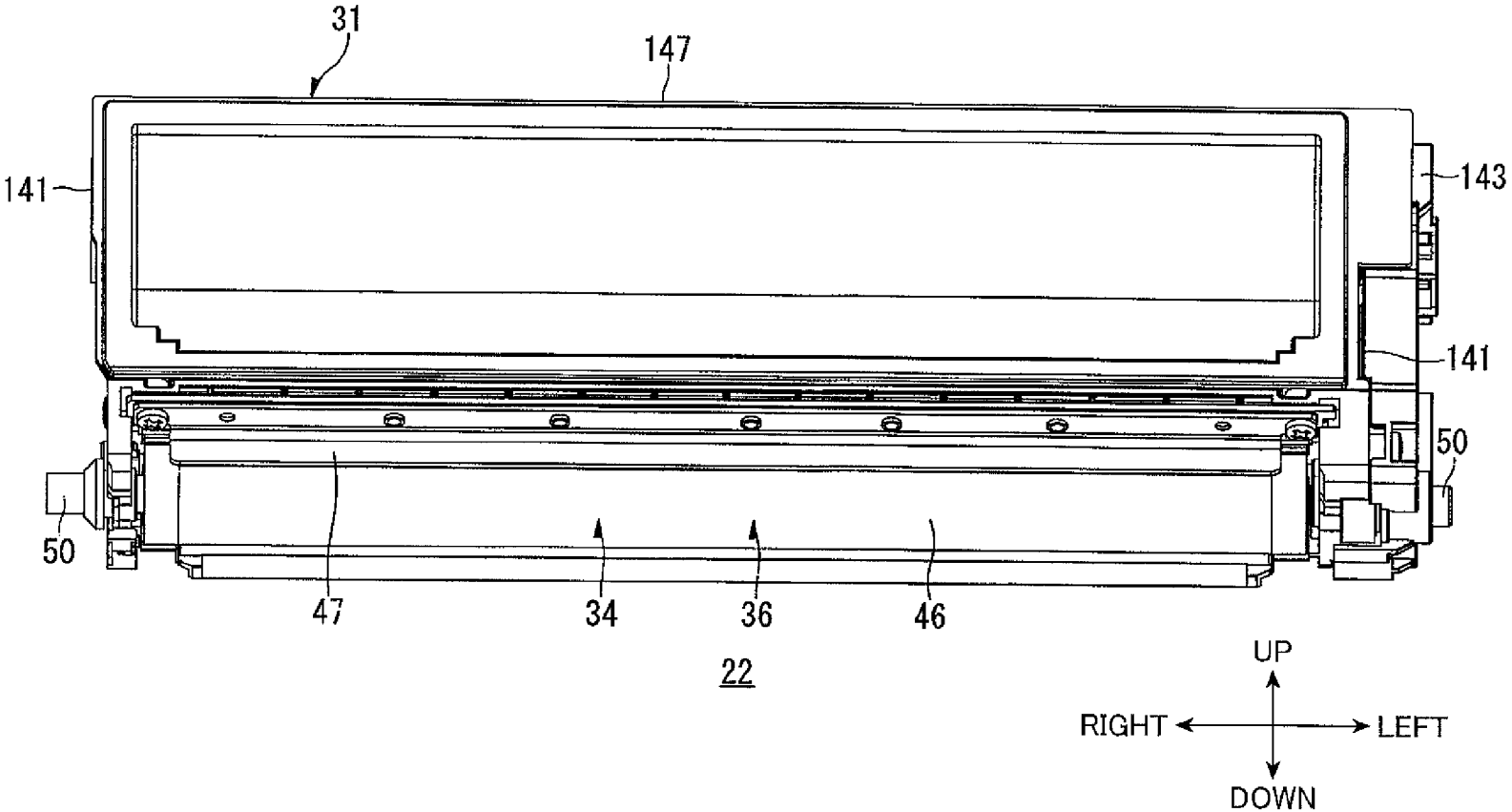
FIG. 16 is a rear view of the developer cartridge.

The guide grooves 73 in the inner wall surfaces of the side frame sections 71 are formed substantially in a vertical direction from the top edge near the rear side of the side frame section 71 to a point near the lower edge on the front side of the side frame section 71. The upstream ends of the guide grooves 73 are wider and open toward the top. The downstream ends of the guide grooves 73 (deepest parts) are disposed at positions corresponding to the developing roller shafts 45 when the developer cartridge 22 is mounted on the drum subunit 23 so that the developing roller 34 contacts the photosensitive drum 24. The guide grooves 73 are formed as depressions in the inner wall surfaces of the side frame section 71 depressed outward in the width direction. As shown in FIG. 16, electrically conductive collar members 50 are slidably received in the guide grooves 73 for covering both widthwise ends of the developing roller shaft 45.

As shown in FIG. 9, bosses 75 are formed in the upper side of the side frame sections 71 at positions forward of the guide grooves 73. The bosses 75 are cylindrical in shape and have a hollow that penetrates the side frame section 71. The bosses 75 protrude outward in the width direction from the outer wall of the side frame sections 71. When the developer cartridge 22 is mounted on the drum subunit 23, the windows 142 (see also FIG. 17) of the developer cartridge 22 oppose each other in the width direction through the bosses 75, as shown in FIG. 8.

Drum support units 76 (FIG. 9) are formed in the side frame sections 71 for supporting the photosensitive drum 24. Each drum support unit 76 includes a receiving part 77 formed in the inner wall surface of the side frame section 71 on the lower end of the same and having a cylindrical shape that is depressed outward in the width direction. The receiving part 77 receives a cylindrical axial insertion part 90 of the center frame section 72 described next. Axial insertion through-holes 78 are formed in the center of the receiving parts 77 and penetrate the side frame sections 71 in the thickness direction.

Two threaded through-holes 79 are formed in each side frame section 71 on the rear edge thereof, penetrating the side frame sections 71 in the thickness direction. Screws 92 are inserted into the threaded through-holes 79 for fixing the side frame sections 71 to the center frame section 72. One of the threaded through-holes 79 is formed in the lower rear edge of the side frame section 71, while the other is formed midway along the rear edge.

Protruding ridges 84 extending in the front-to-rear direction are formed on each side frame section 71 above the boss 75. The protruding ridges 84 are formed as narrow seams extending in the front-to-rear direction and protruding outward in the width direction from the outer wall surface of the side frame sections 71.

As shown in FIG. 9, a coupling inner through-hole 74 is formed in the side frame section 71 on the left side midway in the guide groove 73 at a position corresponding to the passive coupling gear 144 (FIG. 17) of the developer cartridge 22 in the width direction when the developer cartridge 22 is mounted on the drum subunit 23. The coupling inner through-hole 74 is a circular hole penetrating the left side frame section 71 in the width direction.

A screw receiving part 85 is also provided in the left side frame section 71 between the coupling inner through-hole 74 and axial insertion through-hole 78. A screw 136 (see FIG. 11) is screwed into the screw receiving part 85 to fasten the side plate 121 to the drum subunit 23. The screw receiving part 85 is cylindrical in shape and protrudes outward in the width direction from the outer wall surface of the side frame section 71.

As shown in FIG. 12B, the wire electrodes 80, grid electrodes 81, developing roller electrodes 82, and cleaning electrodes 83 are supported in the right side frame section 71 by being inserted through the side frame section 71 in the thickness direction so as to protrude outward in the width direction from the outer wall surface of the side frame section 71.

The wire electrodes 80 are disposed above the axial insertion through-holes 78 in substantially the vertical center and front-to-rear center of the side frame section 71.

The grid electrodes 81 are disposed diagonally above and rearward of the axial insertion through-holes 78 on the rear edge of the side frame sections 71 and in substantially the vertical middle thereof.

The developing roller electrodes 82 are disposed diagonally above and forward of the axial insertion through-holes 78 near the front edge of the side frame sections 71 and in the vertical middle thereof.

The cleaning electrodes 83 are disposed diagonally above and rearward of the axial insertion through-holes 78, above the grid electrodes 81, and near the rear edges of the side frame sections 71 in the vertical middle thereof.

Further, peripheral fitting walls 94 are provided at positions corresponding to each of the wire electrodes 80. Each fitting wall 94 protrudes outward in the width direction from the outer wall surface of the right side frame section 71 and forms a semicircular arc around the wire electrode 80.

(1-2) Center Frame Section

As shown in FIGS. 9 and 10, the center frame section 72 is molded from a synthetic resin material independently of the side frame sections 71. The center frame section 72 is integrally configured of a center plate 86 extending in the width direction, and side inner plates 87 disposed on both widthwise ends of the center plate 86.

A charger holding unit 88 having a substantially narrow plate shape in a plan view is provided in the vertical center of the center plate 86 extending in the width direction for holding the charger 25. The charger holding unit 88 holds the discharge wire 28 extending in the width direction, and the grid 29 below the discharge wire 28 (see FIG. 2). The charger holding unit 88 also holds a wire cleaner 89 that grips the discharge wire 28 and is capable of sliding over the discharge wire 28 in the width direction.

The center plate 86 is also provided with a brush holding unit 93 disposed below the charger holding unit 88 for holding the cleaning brush 68. The cleaning brush 68 held by the brush holding unit 93 spans the brush holding unit 93 in the width direction (see FIG. 2).

The inner plates 87 provided on the widthwise ends of the center plate 86 are formed by bending the center plate 86 in a forward direction. In a side view, each inner plate 87 has a substantially triangular shape that narrows toward the front. The cylindrical axial insertion part 90 is provided in this front end of the inner plate 87 for receiving the drum shaft 27.

Further, screw receiving parts 91 are formed in both upper and lower ends of each inner plate 87 on the rear edge thereof and extend from the outer wall surface of the inner plate 87 inward in the width direction along the center plate 86. The screws 92 are screwed into the screw receiving parts 91 to mount the side frame section 71 on the center frame section 72.

(1-3) Assembly of the Drum Subunit

As shown in FIG. 9, the side frame sections 71 are positioned on both widthwise ends of the center frame section 72. The center frame section 72 is interposed between the side frame sections 71 in the following way. First, the cylindrical axial insertion parts 90 of the center frame section 72 are inserted into the receiving parts 77 in the drum support units 76 of the side frame sections 71 in order to overlap the axial insertion through-holes 78 in the width direction. Simultaneously, the screw receiving parts 91 of the center frame section 72 overlaps the threaded through-holes 79 of the side frame sections 71 in the width direction. Next, the screws 92 are inserted through the threaded through-holes 79 and screwed into the screw receiving parts 91. As a result, the side frame sections 71 are mounted on both widthwise ends of the center frame section 72, as shown in FIG. 10, completing assembly of the drum subunit 23.

When the side frame sections 71 are mounted on both ends of the center frame section 72, the center plate 86 of the center frame section 72 contacts the side frame sections 71 in a region on the rear edge from the bottom end to a vertical midpoint and spans between both side frame sections 71.

When the side frame sections 71 are mounted on both widthwise ends of the center frame section 72, the wire electrode 80 and grid electrode 81 provided on the right side frame section 71 form a connection with the discharge wire 28 and grid 29 on the center frame section 72. Further, the cleaning electrode 83 is connected to the cleaning brush 68.

Further, the photosensitive drum 24 is retained in the drum subunit 23. Specifically, the main drum body 26 fitted into the rotational support members 30 (see FIG. 12A) and incapable of rotating relative to the same is disposed between the inner plates 87 so as to be parallel to but separated a distance from the charger 25. Next, the drum shaft 27 is inserted through the axial insertion through-holes 78 of the side frame section 71 and the cylindrical axial insertion parts 90 of the center frame section 72 along the axis of the main drum body 26 and is fixed so as to be incapable of rotating relative to the axial insertion through-holes 78. The drum shafts 27 rotatably support the rotational support members 30 supporting the main drum body 26, thereby retaining the photosensitive drum 24 in the drum subunit 23.

By supporting both axial ends of the drum shaft 27, the side frame sections 71 can be positioned relative to each other via the drum shaft 27.

(2) Front Beam

As shown in FIGS. 11 and 12A, the front beam 96 is disposed in front of the four drum subunits 23 juxtaposed in the front-to-rear direction and spans between the pair of side plates 121.

The front beam 96 includes a pair of side walls 97 opposing each other in the width direction, and a front wall 98 and a rear wall 99 spanning between the pair of side walls 97. The components of the front beam 96 are integrally molded from a synthetic resin material.

Each side wall 97 includes a side wall base part 100 substantially shaped like a parallelogram in a side view, and a side wall leg part 101 that extends diagonally downward and rearward from the lower end of the side wall base part 100. A front screw receiving part 103 is provided on the outer wall surface of the side wall base part 100. A screw 136 is screwed into the front screw receiving part 103 for attaching the side plate 121.

Front sloped surfaces 102 sloping downward to the rear are formed on rear endfaces of the side wall 97 linking the side wall base part 100 to the side wall leg part 101.

The front wall 98 has a substantially narrow rectangular shape in a front view and extends in the width direction. The front wall 98 is vertically oriented and extends between the pair of side walls 97.

A near side grip part (front side grip part) 104 is provided in the widthwise center of the front wall 98. The near side grip part 104 is configured of a pair of side plates 105 disposed in opposition to each other across a distance in the width direction, and a center plate 106 spanning between the side plates 105.

Each side plate 105 is formed substantially in a triangular plate shape when viewed from the side and protrudes forward from the front wall surface of the front wall 98. The front edge of the side plate 105 slopes diagonally forward and downward.

The center plate 106 spans between the lower edge portions of the side plates 105 and has a L-shaped cross-section that extends outward from the front wall surface of the front wall 98 and bends upward.

The near side grip part 104 is positioned so that the widthwise center matches the widthwise center of the front beam 96. Hence, after assembling the drum unit 21, the widthwise center of the near side grip part 104 is aligned with a straight line X1 passing through the widthwise center of the drum subunit 23 in the front-to-rear direction, as shown in FIG. 6.

As shown in FIG. 11, the rear wall 99 has an elongated rectangular plate shape in a rear view that extends in the width direction. The rear wall 99 is disposed to the rear of the front wall 98 and spans between the side walls 97 while sloping downward and rearward along the front sloped surface 102 of the side walls 97.

(3) Rear Beam

As shown in FIGS. 11 and 12A, the rear beam 111 is disposed on the rear side of the four drum subunits 23 juxtaposed in the front-to-rear direction and spans between the pair of side plates 121.

The rear beam 111 is integrally molded of a synthetic resin material and includes a pair of side walls 112 opposing each other in the width direction, and a bridging wall 113 spanning between the pair of side walls 112.

The side wall 112 has a substantially triangular plate shape in a side view that narrows toward the bottom. A screw receiving part 114 is provided in the outer wall surface of the side wall 112 for attaching the side plate 121 with a screw 136. A rear sloping surface 115 sloping downward and to the rear is formed on the front endface of the side wall 112.

The bridging wall 113 has a substantially elongated rectangular plate shape in a rear view and extends in the width direction. The bridging wall 113 is erected vertically and spans between the pair of side walls 112.

The front wall surface of the bridging wall 113 is a flat surface that slopes downward and rearward along the rear sloping surfaces 115 of the side walls 112.

A far side grip part (rear side grip part) 116 is disposed in the widthwise center of the bridging wall 113. The far side grip part 116 includes a depressed part 117 formed by depressing the top edge of the bridging wall 113 downward in a rear view, and a rear grip 118 forming three sides of a rectangle in a rear view and linked with the top edge of the bridging wall 113.

A ventilation hole 119 having a substantially elongated rectangular shape in a rear view is formed between the depressed part 117 and rear grip 118 to allow the passage of air in an air flow direction (front-to-rear direction), as will be described later.

The far side grip part 116 is positioned so that the widthwise center matches the widthwise center of the rear beam 111. Hence, after assembling the drum unit 21, the widthwise center of the far side grip part 116 is positioned on the straight line X1 that passes through the widthwise center of the drum subunit 23 in the front-to-rear direction, as shown in FIG. 6.

(4) Side Plates

As shown in FIGS. 11 and 12A, a pair of the side plates 121 is provided so as to be able to sandwich the front beam 96, the four drum subunits 23, and the rear beam 111 from both widthwise edges thereof.

The side plate 121 is formed of a material having a lower linear coefficient of expansion than that of the synthetic resin material used to form the drum subunits 23. For example, the side plates 121 are formed of metal or fiber reinforced resin, and preferably metal.

Each side plate 121 has a substantially elongated rectangular plate shape in a side view that extends in the front-to-rear direction. When assembling the drum unit 21, as will be described later, the side plates 121 are formed to oppose the front beam 96, drum subunits 23, and rear beam 111 juxtaposed in the front-to-rear direction so that the front edge opposes the front beam 96 and the rear edge opposes the rear beam 111. The side plates 121 are also formed so that the top edge opposes the protruding ridges 84 of the side frame sections 71 and the bottom edge opposes the lower edge of the side frame sections 71.

A flange part 122 serving as a fitting part is formed across the top edge of each side plate 121 in the front-to-rear direction and extends outward in the width direction. The flange part 122 is formed by bending the top edge of the side plate 121 outward in the width direction to form a L-shaped cross-section. The flange part 122 can be slidably fit in a rail 164 (see FIG. 20) of the drum-accommodating section 161 described later, serving as a guide part.

Four light transmitting through-holes 123 are formed in the top edge of each side plate 121 for receiving the boss 75 of each drum subunit 23 when the side frame sections 71 are mounted on the drum subunit 23.

Figure 17:
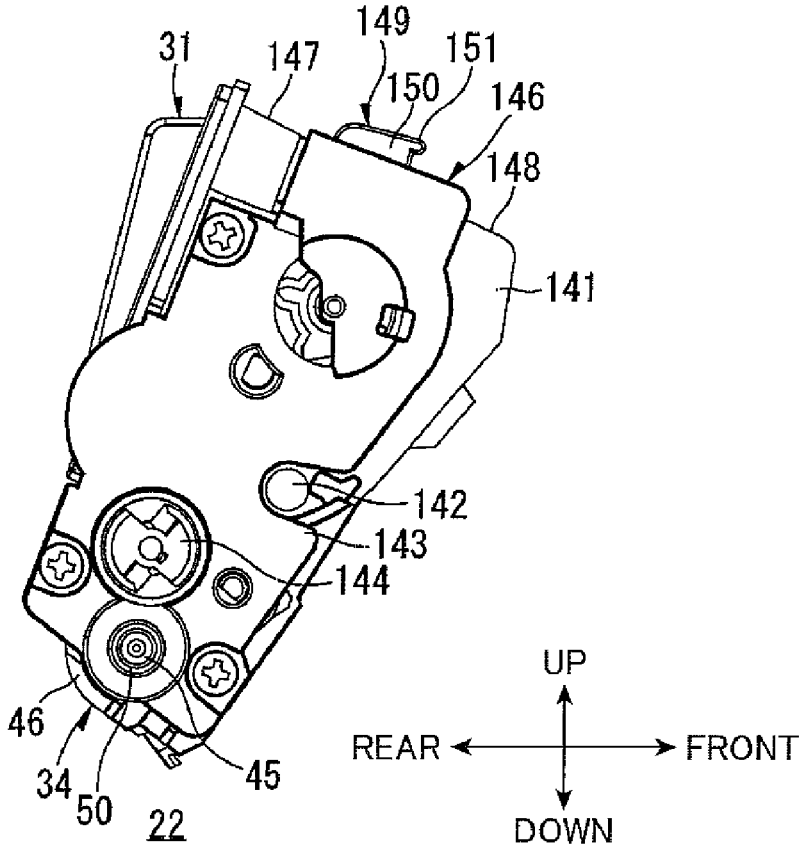
FIG. 17 is a left side view of the developer cartridge.

The four light transmitting through-holes 123 are formed in the top edge of the side plate 121 at intervals in the front-to-rear direction. The light transmitting through-holes 123 are formed as circular through-holes penetrating the side plate 121 in the thickness direction at positions aligned with the window 142 (FIG. 17) of the developer cartridge 22 and the bosses 75 in the width direction when the side frame sections 71 are mounted on the drum subunits 23 and the developer cartridges 22 are mounted on the drum subunits 23, as shown in FIG. 17.

As shown in FIG. 12A, four shaft through-holes 124 are formed along the lower edge of each side plate 121 for receiving the axial ends of each drum shaft 27 when the side frame sections 71 are mounted on the drum subunit 23.

Four of the shaft through-holes 124 are formed in the lower edge of the side plate 121 at intervals along the front-to-rear direction. The shaft through-holes 124 are square holes that penetrate the side plate 121 in the thickness direction at positions opposing the axial ends of the drum shafts 27 in the width direction when the side frame sections 71 are mounted on the drum subunit 23. More specifically, each shaft through-hole 124 is substantially rectangular in shape in a side view with sides parallel to the front-to-rear direction and the vertical direction, as shown in FIG. 13A. The top and front peripheral edges of the shaft through-hole 124 form two straight lines that intersect each other at approximately a right angle. These peripheral edges form contact surfaces 131 described later that are contacted by the drum shaft 27 at points.

A pair of engaging holes 126 are formed in each side plate 121 corresponding to each shaft through-hole 124 at positions slightly above and on either side in the front-to-rear direction of the shaft through-hole 124. One of the engaging holes 126 formed in the right side plate 121 is formed continuously with a center opening 133 described later.

As shown in FIGS. 13A, 13B, and 13C, at the inner wall surface of the right side plate 121, the wire spring 127 is engaged in the pair of engaging holes 126 for axial positioning. The wire spring 127 is configured of a substantially V-shaped wire in a side view, with both upper ends bent outward in the width direction.

Each wire spring 127 is arranged along the inner wall surface of the side plate 121 with the upper ends engaged in the pair of engaging holes 126. Hence, the wire spring 127 is retained on the side plate 121 between the pair of engaging holes 126 such that the center region is depressed downward in a V-shape when viewed from the side. Further, the wire spring 127 is positioned such that the rear side crosses diagonally through the shaft through-hole 124 upward and rearward.

As shown in FIGS. 11 and 12A, a front screw through-hole 128 is formed near the front edge of each side plate 121 at a position opposing the front screw receiving part 103 of the side wall base part 100 when the side plates 121 are mounted on the front beam 96. A screw 136 is inserted through the front screw through-hole 128.

Further, a rear screw through-hole 129 is formed near the rear edge of each side plate 121 at a position opposing the screw receiving part 114 of the side wall 112 when the side plates 121 are mounted on the rear beam 111. A screw 136 is inserted through the rear screw through-hole 129.

As shown in FIGS. 5, 7, 11, and 14, coupling inner through-holes 130 are formed in the left side plate 121 at positions corresponding to the passive coupling gears 144 of the developer cartridges 22 in the width direction when the side plates 121 are mounted on the drum subunit 23 and the developer cartridges 22 are mounted on the drum subunit 23.

Four of the coupling inner through-holes 130 are formed in the vertical center of the side plate 121 at intervals in the front-to-rear direction. The coupling inner through-holes 130 are circular holes penetrating the side plate 121 in the thickness direction at positions corresponding to the coupling inner through-holes 74 of the left side frame section 71 in the width direction when the side frame sections 71 are mounted on the drum subunit 23.

Four of center screw through-holes 132 (FIG. 11) are also formed in the left side plate 121 at positions corresponding to the screw receiving parts 85 of the left side frame section 71 when the side plates 121 are mounted on the drum subunit 23. The screws 136 are inserted through the center screw through-holes 132. Four of the center screw through-holes 132 are formed at intervals in the front-to-rear direction and at positions between the corresponding coupling inner through-hole 130 and shaft through-hole 124.

As shown in FIGS. 12A, 15A and 15B, the center openings 133 are formed in the right side plate 121. The center openings 133 expose the wire electrodes 80 and grid electrodes 81 provided on the right side frame section 71 outside of the right side plate 121 in the width direction when the side plates 121 are mounted on the drum subunit 23. Four of the center openings 133 are formed at intervals along the front-to-rear direction. The center openings 133 are large openings shaped to fit over the fitting walls 94 including the wire electrodes 80 and capable of receiving the grid electrodes 81.

Further, front side openings 134 are formed in the right side plate 121 on the front side of each center opening 133. The front side openings 134 function to expose the developing roller electrodes 82 outside the right side plate 121 in the width direction when the side plates 121 are mounted on the drum subunit 23. Four of the front side openings 134 are formed to correspond to the center openings 133 and are positioned to oppose the developing roller electrodes 82 in the width direction when the side plates 121 are mounted on the drum subunit 23.

Further, rear side openings 135 are formed in the right side plate 121 on the rear side of each center opening 133. The rear side openings 135 function to expose the cleaning electrodes 83 outside the right side plate 121 in the width direction when the side plates 121 are mounted on the drum subunit 23. Four of the rear side openings 135 are formed to correspond to the center openings 133 and are positioned to oppose the cleaning electrodes 83 in the width direction when the side plates 121 are mounted on the drum subunit 23.

(5) Assembly of the Drum Unit

First, the four drum subunits 23 are arranged adjacent to each other in the front-to-rear direction. As shown in FIGS. 11 and 12A, for adjacent drum subunits 23, the front surface of the side frame section 71 in the rear drum subunit 23 is placed in contact with the rear surface of the side frame section 71 in the front drum subunit 23. In this way, the drum subunits 23 are juxtaposed in the front-to-rear direction while sloping downward and rearward.

Next, the front beam 96 is disposed adjacent to the forward most drum subunit 23, and the rear beam 111 is disposed adjacent to the rearward most drum subunit 23. When disposing the front beam 96 adjacent to the forward most drum subunit 23, the front surface of the side frame section 71 in the forward most drum subunit 23 is placed in contact with the front sloped surface 102 of the front beam 96. Further, when disposing the rear beam 111 adjacent to the rearward most drum subunit 23, the rear surface of the side frame section 71 in the rearward most drum subunit 23 is placed in contact with the rear sloping surface 115 of the rear beam 111.

Next, the side plates 121 are disposed on both widthwise sides of the front beam 96, four of the drum subunits 23, and the rear beam 111 arranged in the front-to-rear direction and are fixed to these components via the screws 136.

When attaching the left side plate 121 to the left side of the front beam 96, four of drum subunits 23, and rear beam 111, the front screw through-hole 128 of the side plate 121 is aligned with the front screw receiving part 103 on the left side of the front beam 96, and the rear screw through-hole 129 of the left side plate 121 is aligned with the screw receiving part 114 on the left side of the rear beam 111 in the width direction, as shown in FIG. 11. The center screw through-holes 132 of the left side plates 121 are also aligned with the screw receiving parts 85 on the left side of the drum subunit 23 in the width direction.

Next, the inner wall surface of the left side plate 121 is placed in contact with the protruding ridges 84 on the left side frame section 71 so that the left ends of the drum shafts 27 are inserted through the shaft through-holes 124 of the left side plate 121. Simultaneously, the boss 75 of the side frame section 71 on the left side of each drum subunit 23 is fitted into the light transmitting through-holes 123 in the left side plate 121 such that the bosses 75 are exposed externally in the width direction. By fitting the bosses 75 of the left side frame sections 71 into the light transmitting through-holes 123 of the left side plate 121, the drum subunits 23 are restricted from rotating about the drum shafts 27 relative to the left side plate 121.

As shown in FIG. 11, the screw 136 is inserted through the front screw through-hole 128 and screwed into the front screw receiving part 103, while a separate screw 136 is inserted through the rear screw through-hole 129 and screwed into the screw receiving part 114. Still other screws 136 are inserted through the center screw through-holes 132 and screwed into the screw receiving parts 85. In this way, the left side plate 121 is attached to the left side of the front beam 96, drum subunits 23, and rear beam 111, as shown in FIG. 14.

When attaching the right side plate 121 to the right side of the front beam 96, four of drum subunits 23, and rear beam 111, as shown in FIG. 12A, the front screw through-hole 128 in the right side plate 121 is aligned in the width direction with the front screw receiving part 103 on the right side of the front beam 96. Simultaneously, the rear screw through-hole 129 in the right side plate 121 is aligned in the width direction with the screw receiving part 114 on the right side of the rear beam 111.

Next, the inner wall surface of the right side plate 121 is placed in contact with the protruding ridges 84 of the side frame sections 71 on the right side of the drum subunits 23 so that the right ends of the drum shafts 27 are inserted into the shaft through-holes 124 in the right side plate 121 and the bosses 75 of the right side frame sections 71 are fitted into the light transmitting through-holes 123 of the right side plate 121 such that the bosses 75 are exposed externally in the width direction. Further, the fitting walls 94 of the drum subunits 23 are fitted into the center openings 133 formed in the right side plate 121. By fitting the bosses 75 of the right side frame section 71 into the light transmitting through-holes 123 of the right side plate 121, the drum subunits 23 are restricted from rotating about the drum shafts 27 relative to the right side plate 121.

As shown in FIG. 12A, screws 136 are inserted through the front screw through-hole 128 and rear screw through-hole 129 and screwed into the front screw receiving part 103 and screw receiving part 114, respectively. In this way, the right side plate 121 is attached to the right side of the front beam 96, drum subunits 23, and rear beam 111, as shown in FIG. 15A.

When the drum unit 21 is assembled as described above, the widthwise ends of the drum shaft 27 supported in the pair of side frame sections 71 for each drum subunit 23 are inserted into the respective shaft through-holes 124 of the side plates 121, as shown in FIGS. 14, 15A, and 15B. The diameter of the shaft through-holes 124 is greater than the diameter of the drum shafts 27 (the size in a cross-section taken orthogonal to the axial direction of the drum shaft 27). As shown in FIGS. 13A, 13B, and 13C, a portion of the wire spring 127 crosses the shaft through-hole 124 in a diagonal direction upward and rearward. When the widthwise end of the drum shaft 27 is inserted into the shaft through-hole 124, as shown in FIG. 13C, the drum shaft 27 contacts the wire spring 127 and slightly deforms the wire spring 127 diagonally downward and rearward. Here, in FIG. 13C, dotted lines show the shape of the wire spring 127 before inserting the drum shaft 27 into the shaft through-hole 124. Accordingly, the axial ends of the drum shaft 27 are urged diagonally forward and upward by the wire spring 127 toward the upper and forward contact surfaces 131 opposing the drum shaft 27. Hence, the wire springs 127 press the axial ends of the drum shaft 27 at a point of contact. The drum shaft 27 also contacts the upper and forward contact surfaces 131 at points of contact. In this way, the axial ends of the drum shaft 27 are accurately positioned between the pairs of side plates 121 through three points of contact.

When the drum unit 21 is assembled in this way, as shown in FIG. 14, the coupling inner through-holes 130 formed in the left side plate 121 oppose the coupling inner through-holes 74 of the left side frame section 71 in the width direction.

When the drum unit 21 is assembled as described above, as shown in FIGS. 15A and 15B, the grid electrodes 81 and wire electrodes 80 are exposed externally in the width direction through the center openings 133 formed in the right side plate. Further, the developing roller electrodes 82 are exposed externally in the width direction through the front side openings 134, and the cleaning electrodes 83 are exposed externally in the width direction through the rear side opening 135.

3. Developer Cartridge

FIG. 16 is a rear view of the developer cartridge 22. Next, the developer cartridge will be described in detail with reference to FIGS. 2 through 6, 16, and 17.

(1) Developer Cartridge

As described above in reference to FIG. 16, the developer cartridge 22 is configured so that the developing roller 34 is exposed from the bottom of the developer frame 31 via the opening 36. The developing roller shaft 45 (FIG. 17) of the developing roller 34 is rotatably supported in the side walls 141 of the developer frame 31, with the widthwise ends of the developing roller shaft 45 protruding from both side walls 141 in the width direction. The electrically conductive collar members 50 cover the widthwise ends of the developing roller shaft 45.

As shown in FIGS. 3 and 17, the windows 142 are embedded in both side walls 141 that define the toner-accommodating chamber 37 in order to detect the amount of toner remaining therein. An optical sensor 173 configured of a light-emitting element 174 and a light-receiving element 175 described later (see FIG. 8) emits a detection light for optically detecting the amount of toner remaining in the toner-accommodating chamber 37. The windows 142 allow the detection light to pass through the toner-accommodating chamber 37 in the width direction.

A gear mechanism (not shown) is provided in the developer cartridge 22 on the left side wall 141. The gear mechanism is covered by a gear cover 143 (FIG. 17). The gear mechanism includes the passive coupling gear 144 (FIG. 17) exposed through the gear cover 143, and a gear train (not shown) engaged with the passive coupling gear 144.

A coupling input shaft 145 (see FIG. 5) described later is provided in the main casing 2. The coupling input shaft 145 can be advanced and retracted in the axial direction of the rotational shaft 41 and can engage with the passive coupling gear 144 so as to be incapable of rotating relative to the same. The driving force from a motor (not shown) provided in the main casing 2 is transmitted to the coupling input shaft 145.

The gear train includes an agitator drive gear that engages with the rotational shaft 41 of the agitator 32, a supply roller drive gear that engages with the supply roller shaft 43 of the supply roller 33, and a developing roller drive gear that engages with the developing roller shaft 45 of the developing roller 34. These gears are engaged with the passive coupling gear 144 via intermediate gears or the like.

As shown in FIGS. 5 and 17, a developer cartridge grip part 146 is provided on the developer frame 31. The developer cartridge grip part 146 is disposed in the widthwise center of the developer frame 31 on an upper wall 147 and includes a depressed part 148 formed by depressing the upper wall 147 downward, and a grip 149 provided on the rear edge of the depressed part 148.

As shown in FIG. 6, the depressed part 148 is substantially rectangular shaped in a plan view and is formed by cutting out the front edge part, forming a recessed part that deepens toward the developer cartridge 22 adjacent on the front side when the developer cartridges 22 are mounted in the drum unit 21.

The grip 149 is provided on the rear edge of the depressed part 148 and extends in the width direction. The grip 149 includes side walls 150 positioned at both ends of the depressed part 148 in the width direction, and a center wall 151 that bridges the side walls 150.

Each of the side walls 150 is triangular in shape in a side view, narrowing toward the rear side. The side walls 150 extend upward from both widthwise ends of the depressed part 148. The center wall 151 spans between upper edges of the side walls 150. The grip 149 formed in this way allows a user to insert fingers through the depressed part 148 from the front side and grip the inner wall surface of the center wall 151 to pull the developer cartridge 22 upward.

The developer cartridge grip part 146 is positioned so that the widthwise center thereof is aligned with the widthwise center of the developer frame 31. In other words, as shown in FIG. 6, the widthwise center of the developer cartridge grip part 146 is positioned on the straight line X1 that passes through the widthwise center of the drum subunit 23 in the front-to-rear direction when the developer cartridges 22 are mounted in the drum unit 21.

(2) Mounting the Developer Cartridges in the Drum Unit

As shown in FIG. 5, when mounting the developer cartridges 22 of each color into the drum subunits 23 for each color in the drum unit 21, the developer cartridge 22 is first inserted from above the drum unit 21 into the drum subunit 23 corresponding to that developer cartridge 22.

More specifically, the collar members 50 on the axial ends of the developing roller shaft 45 are inserted into the guide grooves 73 formed in the side frame sections 71 of the corresponding drum subunit 23, and the developer cartridge 22 is pushed downward into the drum subunit 23 as the collar members 50 slide along the guide grooves 73. When the collar members 50 contact the deepest parts of the guide grooves 73, this contact restricts the developer cartridge 22 from being pushed deeper. In this state, the developing roller 34 is in contact with the photosensitive drum 24. Through this process, the developer cartridges 22 are mounted into the corresponding drum subunits 23, as shown in FIG. 4.

When the developer cartridge 22 is mounted in the corresponding drum subunit 23, the collar member 50 on the widthwise right end of the developing roller shaft 45 is connected to the developing roller electrode 82 provided on the right side frame section 71.

Figure 7:
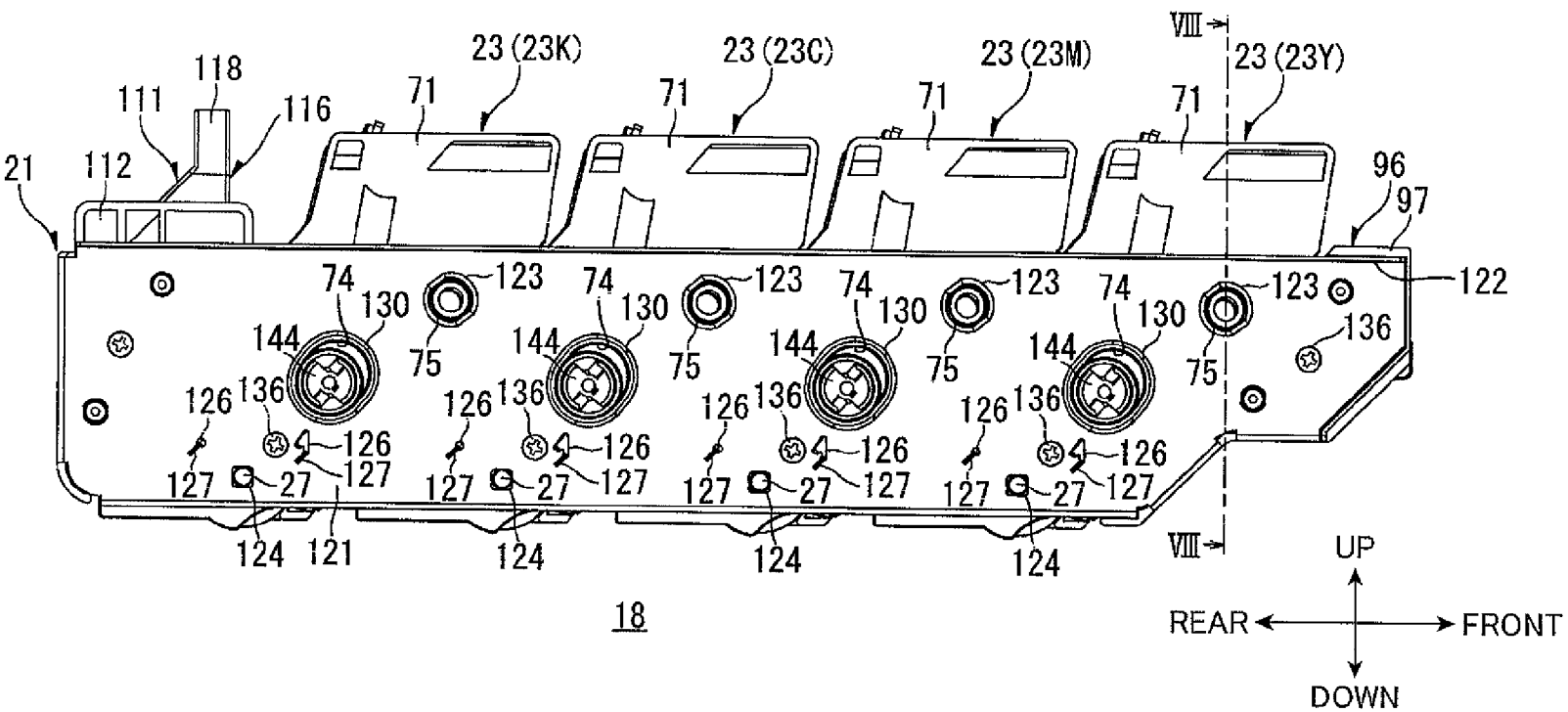
FIG. 7 is a left side view of the drum unit shown in FIG. 4.

Further, when the developer cartridge 22 is mounted in the corresponding drum subunit 23, as shown in FIGS. 7 and 8, the left window 142 embedded in the left side wall 141 of the developer frame 31 is aligned with the boss 75 formed in the left side frame section 71 and the light transmitting through-hole 123 formed in the left side plate 121 with respect to the width direction to allow passage of the detection light. Similarly, the right window 142 embedded in the right side wall 141 of the developer frame 31 is aligned in the width direction with the boss 75 formed on the right side frame section 71 and the light transmitting through-hole 123 formed in the right side plate 121 so as to allow the passage of detection light.

Further, as shown in FIG. 5, the passive coupling gear 144 exposed through the gear cover 143 provided on the left side wall 141 is aligned in the width direction with the coupling inner through-hole 74 formed in the left side frame section 71 and the coupling inner through-hole 130 formed in the left side plate 121, allowing the coupling input shaft 145 to be inserted and retracted therethrough.

When all the developer cartridges 22 are mounted in the drum subunits 23, as shown in FIG. 6, the near side grip part 104 of the front beam 96, the developer cartridge grip parts 146 of the developer cartridges 22, and the far side grip part 116 of the rear beam 111 are aligned in the front-to-rear direction. More specifically, the widthwise center of these components are positioned on the straight line X1 that passes through the widthwise center of the drum subunit 23 in the front-to-rear direction.

Further, when all the developer cartridges 22 are mounted in the drum subunits 23, each developer cartridge 22 can be pulled upward by inserting fingers through the depressed part 148 from the front side thereof, gripping the inner wall surface of the center wall 151, and pulling the grip 149 upward.

Hence, after mounting all the developer cartridges 22 in the drum subunits 23 of the drum unit 21, the drum unit 21 is mounted in the drum-accommodating section 161 described later of the main casing 2, as shown in FIG. 1. At this time, the printer 1 can form color images on the paper 3 according to the image-forming operation described above.

4. Main Casing

Figure 18:
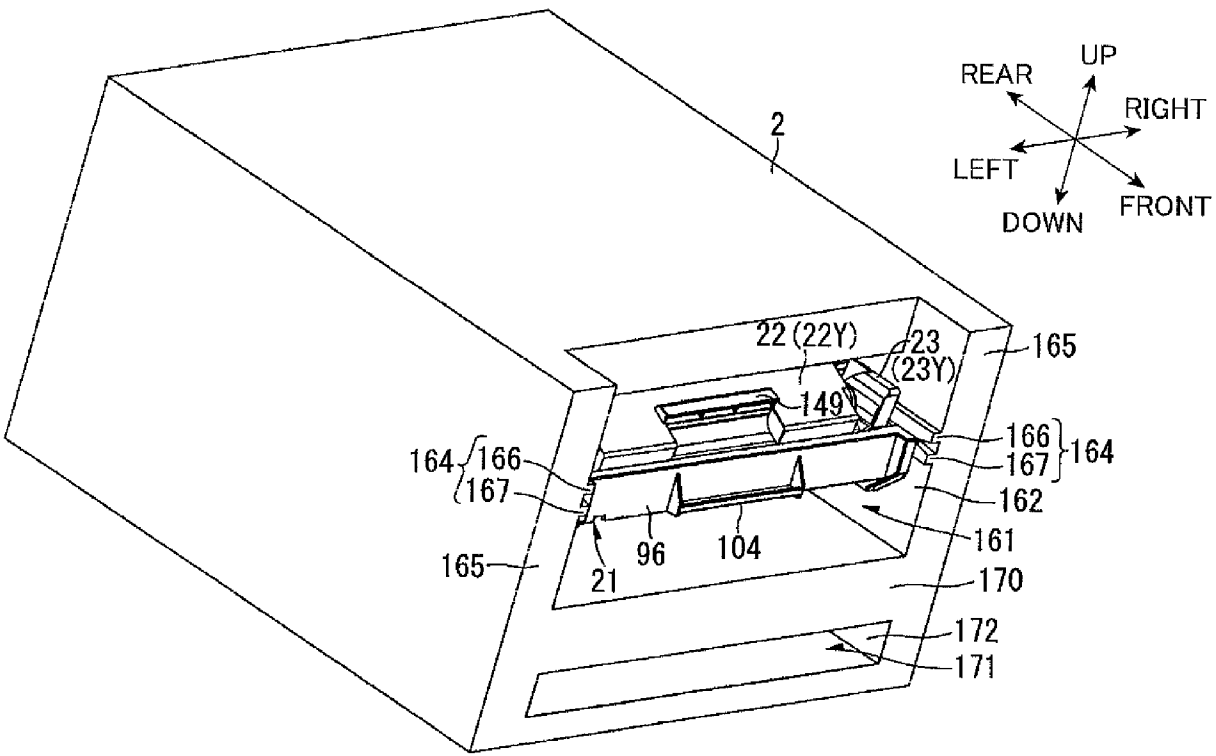
FIG. 18 is a perspective view showing a drum unit mounted in a main casing of the laser printer.
Figure 19:
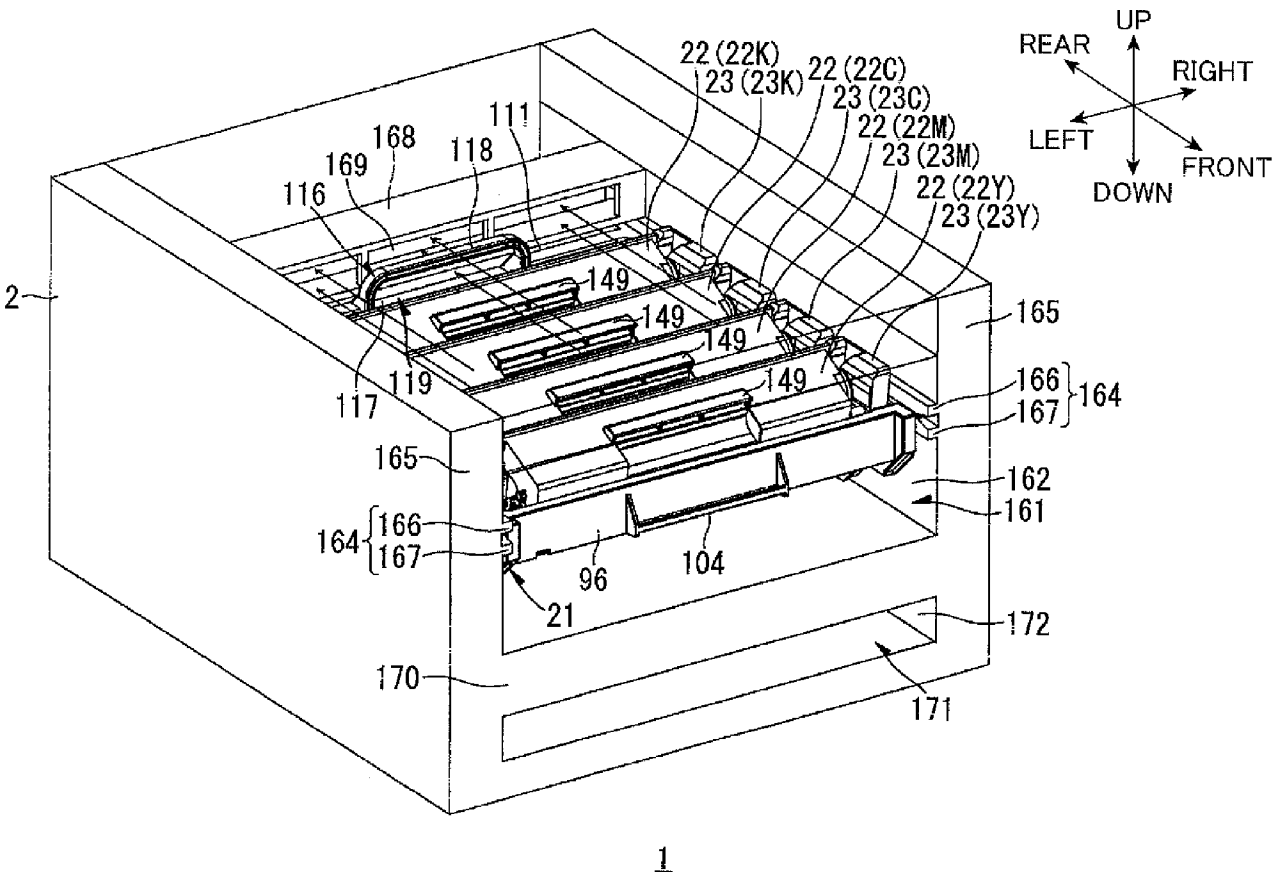
FIG. 19 is a perspective view of the laser printer in FIG. 18 with a portion cut out.
Figure 20:
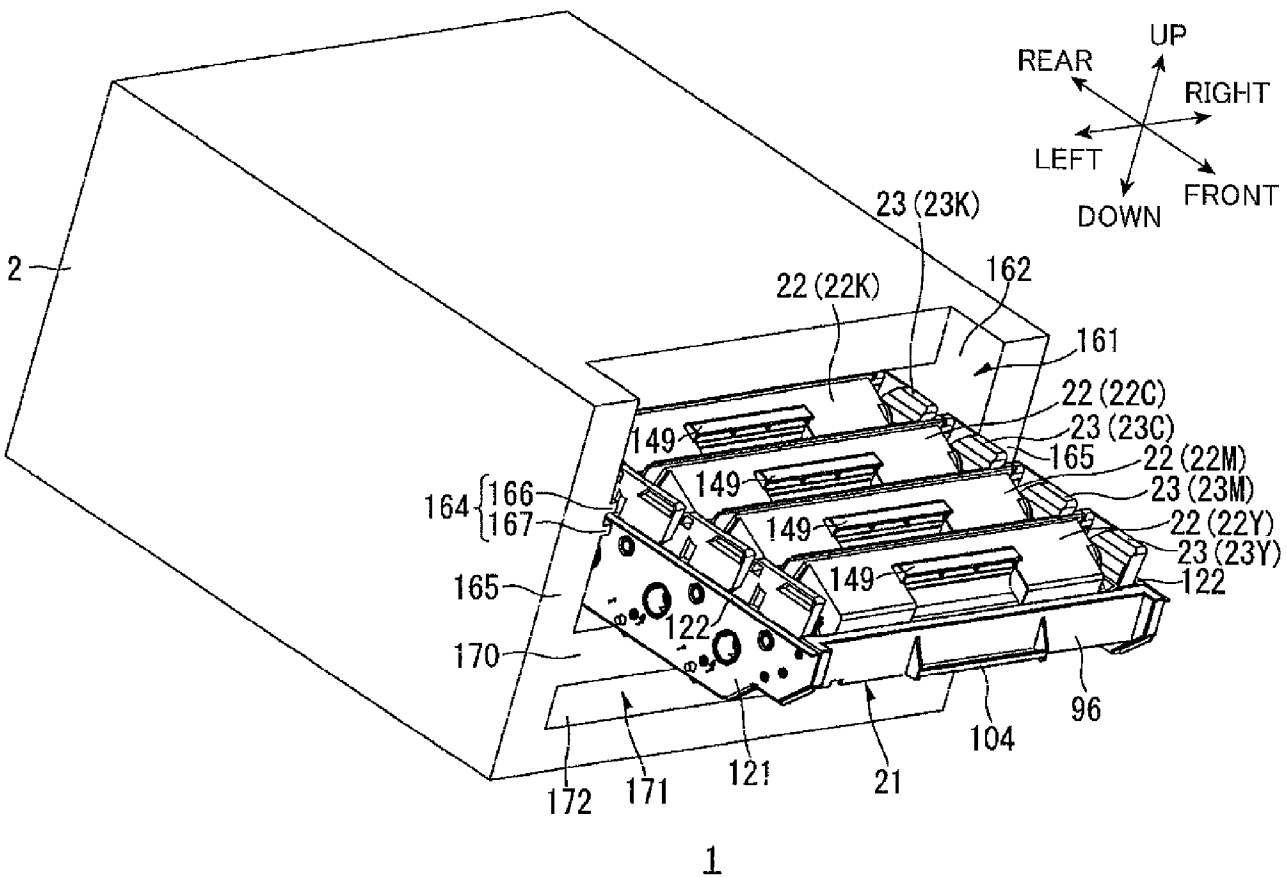
FIG. 20 is a perspective view showing the drum unit partially withdrawn from the main casing.
Figure 21:
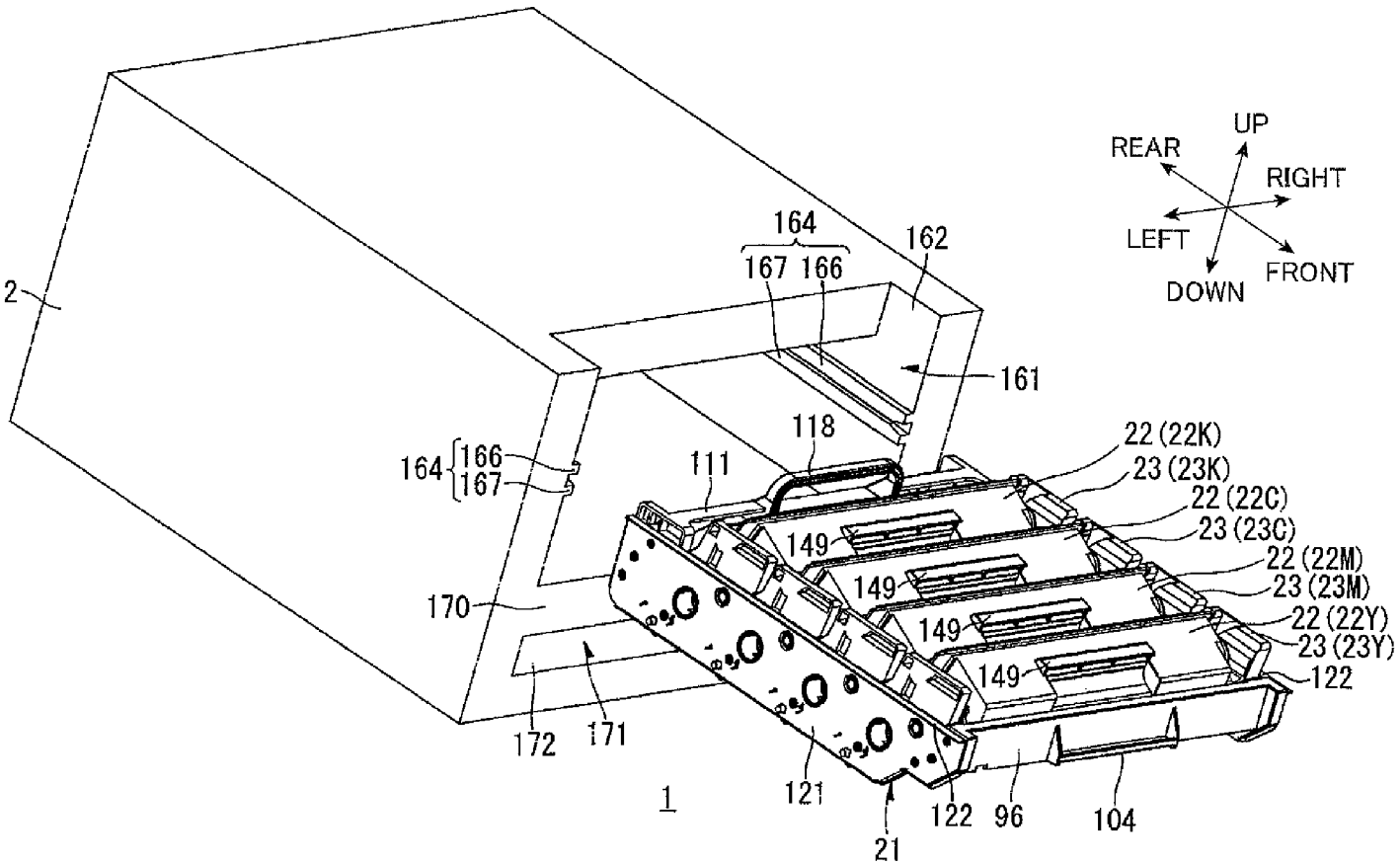
FIG. 21 is a perspective view showing the drum unit after being removed from the main casing.

FIG. 18 is a perspective view showing the drum unit 21 mounted in a main casing 2 of the laser printer 1. FIG. 19 is a perspective view of the laser printer 1 in FIG. 18 with a portion cut out. FIG. 20 is a perspective view showing the drum unit 21 partially withdrawn from the main casing 2. FIG. 21 is a perspective view showing the drum unit 21 after being removed from the main casing 2.

Next, the main casing 2 will be described with reference to FIGS. 18 through 21.

(1) Main Casing

As shown in FIG. 18, the main casing 2 has a substantially rectangular box shape in a side view and is open on the front side. The drum-accommodating section 161 is formed in the main casing 2 for accommodating the drum unit 21. The drum access opening 162 in communication with the drum-accommodating section 161 is formed in a front wall 170 of the main casing 2.

As shown in FIG. 1, a front cover 163 is provided on the front wall 170 of the main casing 2 for covering or exposing the drum access opening 162. The front cover 163 is rotatably supported via hinges (not shown) provided on the lower edge of the drum access opening 162 so as to be able to open and close over the main casing 2. Hence, the front cover 163 can be rotated closed about the hinges in order to cover the drum access opening 162 (closed position) and can be rotated open about the hinges in order to expose the drum access opening 162 (open position). When the drum access opening 162 is exposed, the drum unit 21 can be mounted in or removed from the drum-accommodating section 161 via the drum access opening 162 from the front side of the main casing 2.

As shown in FIGS. 19 and 20, the rails 164 are provided in the drum-accommodating section 161 for slidably fitting with the flange parts 122 of the side plates 121 provided on the drum unit 21. The main casing 2 has sidewalls 165 that oppose each other in the width direction. The rails 164 are disposed on the inner wall surfaces of the sidewalls 165 at positions opposing each other in the width direction and extend in the front-to-rear direction. Each rail 164 includes an upper rail 166 and a lower rail 167 that confront each other vertically over a gap large enough to insert the flange parts 122.

The main casing 2 also includes the tray-accommodating section 171 formed below the drum-accommodating section 161 for accommodating the paper tray 7. A tray access opening 172 in communication with the tray-accommodating section 171 is formed in the front wall 170 of the main casing 2. The paper tray 7 described above can be slidably inserted into the tray-accommodating section 171 in the rear direction. When mounted in the tray-accommodating section 171, the paper tray 7 can be pulled forward and removed therefrom.

As shown in FIGS. 1 and 19, a duct 168 is provided inside the main casing 2 for exhausting hot air in the main casing 2 and drawing out ozone generated by the charger 25. The duct 168 is formed on the rear side of the drum unit 21 when the drum unit 21 is mounted in the drum-accommodating section 161. Exhaust openings 169 are formed in the duct 168 at positions facing forward.

During an image-forming operation, air in the main casing 2 is drawn out through the exhaust openings 169 formed in the duct 168, generating an airflow from the front side to the rear side between the scanning unit 17 and drum unit 21, as indicated by arrows in FIGS. 1 and 19. Hot air in the main casing 2 and ozone generated from the charger 25 first rises to the space between the scanning unit 17 and drum unit 21 and are carried along the airflow out through the exhaust openings 169.

Since the ventilation hole 119 (FIG. 19) formed in the far side grip part 116 of the rear beam 111 between the depressed part 117 and rear grip 118 is open in the direction of airflow, the air can flow through the ventilation hole 119 and be exhausted through the exhaust openings 169.

When the drum unit 21 is mounted in the drum-accommodating section 161, as shown in FIG. 5, the coupling input shafts 145 corresponding to the passive coupling gears 144 are inserted through the corresponding coupling inner through-holes 130 formed in the left side plate 121 and the corresponding coupling inner through-holes 74 formed in the side frame 71 disposed inside the left side plate 121 in the width direction. The coupling input shafts 145 are coupled with the corresponding passive coupling gears 144 of each developer cartridge 22 so as to be incapable of rotating relative to the passive coupling gears 144.

When the drum unit 21 is mounted in the main casing 2, the end portions of the coupling input shafts 145 are inserted into grooves (not shown) cut into the passive coupling gears 144, thereby forming an engagement for transferring a driving force. Further, when the drum unit 21 is removed from the main casing 2, the end portions of the coupling input shafts 145 are extracted (disengaged) from the grooves in the passive coupling gears 144 by first pushing the coupling input shaft 145 toward the center of the drum unit 21 with respect to the left-to-right direction.

In the developer cartridge 22 having this construction, the coupling input shaft 145 transfers a driving force from a motor (not shown) to the passive coupling gear 144, and the passive coupling gear 144 drives the agitator 32, supply roller 33, and developing roller 34 to rotate via the gear train.

The coupling input shafts 145 are provided in the main casing 2 at positions corresponding to each passive coupling gear 144. The coupling input shafts 145 are extended toward or retracted from the passive coupling gear 144 in association with the opening and closing operation of the front cover 163. Specifically, when the front cover 163 is opened, the coupling input shafts 145 are retracted from the passive coupling gears 144 and, hence, uncoupled therefrom. When the front cover 163 is closed, the coupling input shafts 145 are advanced toward and coupled with the passive coupling gears 144.

As shown in FIG. 8, the optical sensor 173 is provided for each developer cartridge 22 in order to detect the amount of toner remaining in the toner-accommodating chamber 37. Each optical sensor 173 includes the light-emitting element 174 and the light-receiving element 175 disposed in opposition to each other on either side of the drum unit 21 (the light-emitting element 174 on the right side and the light-receiving element 175 on the left).

When the corresponding developer cartridge 22 is mounted in the drum unit 21 and the drum unit 21 is mounted in the drum-accommodating section 161, the light-emitting element 174 and light-receiving element 175 are positioned on the outside of the pair of light transmitting through-holes 123 in the width direction and confront the light transmitting through-holes 123 in the width direction.

With this construction, detection light emitted from the light-emitting element 174 passes through the boss 75 fitted into the right light transmitting through-hole 123, enters the toner-accommodating chamber 37 via the right window 142, and passes through the toner-accommodating chamber 37. The detection light then exits the toner-accommodating chamber 37 via the left window 142, passes through the boss 75 fitted into the left light transmitting through-hole 123, and is detected by the light-receiving element 175.

The optical sensor 173 determines the amount of toner remaining in the toner-accommodating chamber 37 based on the frequency of detections. When the optical sensor 173 determines that very little toner remains in the toner-accommodating chamber 37, the printer 1 displays an out-of-toner warning on a control panel (not shown).

Terminals connected to the high-voltage circuit board (not shown) provided in the main casing 2 are connected to each of the wire electrodes 80 and grid electrodes 81 exposed through the center opening 133 formed in the right side plate 121, the developing roller electrode 82 exposed through the front side openings 134, and the cleaning electrode 83 exposed through the rear side opening 135.

(2) Removing the Drum Unit from the Main Casing

To remove the drum unit 21 from its mounted state in the drum-accommodating section 161, first, the front cover 163 shown in FIG. 1 is opened about its hinges to expose the drum access opening 162. As shown in FIG. 18, the near side grip part 104 is provided on the near side (front side and downstream side in the pulling direction) of the front beam 96 in the pulling direction of the drum unit 21 (forward direction) so that the near side grip part 104 can be exposed in and operated through the drum access opening 162.

When the drum unit 21 is mounted in the drum-accommodating section 161, the far side grip part 116 is provided on the far side (rear side and upstream side in the pulling direction) of the rear beam 111 with respect to the pulling direction for the drum unit 21. Hence, the far side grip part 116 is not exposed in the drum access opening 162 when the front cover 163 is opened and, therefore, cannot be operated.

As shown in FIG. 20, when the operator grips the near side grip part 104 and pulls the drum unit 21 forward, the flange parts 122 are guided along the rails 164. Specifically, the flange parts 122 slide forward between the upper rails 166 and lower rails 167 as the drum unit 21 is pulled forward.

After pulling the drum unit 21 farther forward, the flange parts 122 separate from the rails 164, as shown in FIG. 21 so that the drum unit 21 can be pulled free from the drum-accommodating section 161. When the drum unit 21 is pulled forward to the point of separating from the drum-accommodating section 161, the far side grip part 116 provided on the far side of the drum unit 21 in the pulling direction is exposed in the drum access opening 162 and can be gripped at this time.

Hence, when the drum unit 21 is separated from the drum-accommodating section 161, the operator can grip both the far side grip part 116 and the near side grip part 104 and can lift and carry the drum unit 21 in one motion.

5. Operations and Effects of the Drum Unit Assembly

In the printer 1 of the above described aspect, the drum unit 21 having four drum subunits 23 can be mounted in and removed from the main casing 2 as a unit. Therefore, the structure of the printer 1 can prevent confusion, such as the user mistakenly replacing a drum subunit 23 corresponding to a different color. Further, interposing the drum subunits 23 between a pair of side plates 121 simplifies the structure of the drum subunits 23, thereby simplifying the manufacturing process and reducing costs. During repair work, it is possible to replace only the drum subunit 23 requiring repair, thereby reducing repair costs. Moreover, the structure is easy to disassemble and is convenient for recycling.

Further, when neighboring drum subunits 23 are linked to each other, it is conceivable that errors in positioning between the photosensitive drums 24 accumulate. However, when coupling the independent drum subunits 23 with the pair of side plates 121 as in the structure of the aspect, the error in positioning of the photosensitive drums 24 does not accumulate, thereby improving the accuracy in positioning the photosensitive drums 24.

When the widthwise ends of the drum shaft 27 are inserted into the respective shaft through-holes 124 of the side plates 121, a portion of the wire spring 127 crosses the shaft through-hole 124, as shown in FIG. 13C, in a diagonal direction upward and rearward. When the widthwise end of the drum shaft 27 is inserted into the shaft through-hole 124, the drum shaft 27 contacts the wire spring 127 and deforms the wire spring 127 to shift diagonally downward and rearward. Accordingly, the axial ends of the drum shaft 27 are urged diagonally forward and upward by the wire spring 127 toward the upper and forward contact surfaces 131. Hence, the wire springs 127 press the axial ends of the drum shaft 27 at a point of contact. And the axial ends of the drum shaft 27 also contact the upper and forward contact surfaces 131 at points of contact. In this way, the axial ends of the drum shaft 27 are accurately positioned between the pairs of side plates 121 through three points of contact. Therefore, the accuracy in positioning each of the photosensitive drums 24 can be further improved. Further, this configuration can achieve accurate positioning through a simple structure.

Further, the side plates 121 are formed of material having a lower linear coefficient of expansion than that of the synthetic resin material used to form the drum subunits 23. For example, the side plates 121 are formed of a metal or fiber reinforced resin, and preferably a metal. Therefore, the side plates 121 can ensure the rigidity of the drum unit 21, and can achieve more accurate positioning for the photosensitive drums 24. Further, forming the side plates 121 of metal or fiber reinforced resin simplifies the manufacturing process and can reduce costs. Since the widthwise ends of the drum shaft 27 are inserted through shaft through-holes 124 formed in the side plate 121 and positioned in contact with the side plate 121 at the shaft through-holes 124, the side plate 121 can be used as a ground for the photosensitive drums 24 when formed of metal. This construction eliminates the need for a special grounding part, thereby reducing the number of required parts.

In the printer 1 of the above described aspect, the flange parts 122 of the side plates 121 fit between the upper rails 166 and lower rails 167 of the rails 164 when mounting the drum unit 21 into or removing the drum unit 21 from the drum-accommodating section 161 in the main casing 2. The rails 164 guide the flange parts 122 so that the developer cartridges 22 can be slid in the front-to-rear direction between the upper rails 166 and lower rails 167, thereby facilitating maintenance operations needed for clearing paper jams and replacing parts.

The front beam 96 and rear beam 111 span between the pair of side plates 121 on the front and rear sides of the drum unit 21, respectively. Hence, the front beam 96 and rear beam 111 can improve the rigidity of the drum unit 21.

Further, the near side grip part 104 and far side grip part 116 are provided on the front beam 96 and rear beam 111, respectively. Therefore, the drum unit 21 can be operated by gripping the near side grip part 104 and far side grip part 116. As a result, this construction enhances operability.

Further, the developer cartridge 22 corresponding to each color is detachably mounted in drum subunits 23 corresponding to each color in the drum unit 21. Accordingly, it is possible to replace only the corresponding developer cartridge 22 of each drum subunit 23 to reduce running costs.

When the drum unit 21 is mounted in the drum-accommodating section 161 of the main casing 2, the coupling input shaft 145 corresponding to each passive coupling gear 144 is inserted through the coupling inner through-hole 130 formed in the left side plate 121 and the coupling inner through-hole 74 formed in the left side frame section 71 provided inside the side plate 121 in the width direction and is coupled to the corresponding passive coupling gear 144 of the developer cartridge 22 so as to be incapable of rotating relative to the passive coupling gear 144. Therefore, this structure can reliably drive the agitator 32, supply roller 33, and developing roller 34 of each developer cartridge 22 to rotate by transmitting a driving force from the motor (not shown) provided in the main casing 2 from the coupling input shaft 145 to the passive coupling gear 144.

Further, each drum subunit 23 has a pair of side frame sections 71 supporting the photosensitive drum 24, and the center frame section 72 spanning between the side frame sections 71 for supporting the charger 25. The charger 25 can be reliably arranged along the axial direction of the photosensitive drum 24. And the charger opposes the photosensitive drum 24 over a prescribed gap. This structure ensures that a reliable charge can be applied to the photosensitive drum 24.

The developer cartridge 22 is mounted in the drum subunit 23 by fitting the collar members 50 disposed on both widthwise ends of the developing roller shaft 45 in the developer cartridge 22 into the guide grooves 73 formed in the side frame sections 71 of the drum subunit 23, and by sliding the collar members 50 along the guide grooves 73. Accordingly, the developer cartridges 22 can be reliably mounted in the drum subunits 23.

In the right side plate 121 of the drum unit 21 described above, the wire electrode 80 and grid electrode 81 are exposed through the center opening 133, the developing roller electrode 82 is exposed through the front side opening 134, and the cleaning electrode 83 is exposed through the rear side opening 135. Hence, this structure enables a reliable connection to be performed with each terminal connected to the high-voltage circuit board (not shown) provided in the main casing 2.

Further, the pair of side frame sections 71, and the center frame section 72 are all formed separately in the drum subunit 23 described above. If the side frame sections 71 and center frame section 72 were formed integrally, a complex mold would be required due to the difficulties in removing the components from the mold and the molding operation would become more involved, inevitably leading to an increase in cost.

However, by forming the side frame sections 71 and center frame section 72 separately and subsequently assembling these components as described above to form the drum subunit 23, it is possible to simplify the mold structure and improve the efficiency of molding operations, thereby making it possible to reduce costs.

In the drum subunit 23 described above, the relative positions of the pair of side frame sections 71 are determined through the drum shaft 27 of the photosensitive drum 24. Hence, since the side frame sections 71 and center frame section 72 are assembled with the drum shaft 27 of the photosensitive drum 24 as reference, the positioning precision of the drum shaft 27 relative to the drum subunit 23 is improved.

Further, as shown in FIG. 15B, when assembling the drum unit 21, the bosses 75 of the side frame sections 71 for each drum subunit 23 are fitted into the light transmitting through-holes 123 in the pair of side plates 121 for restricting rotation of the drum subunit 23 about the drum shaft 27 relative to the pair of side plates 121. Accordingly, the drum subunit 23 can be accurately positioned relative to the pair of side plates 121.

Further, as shown in FIG. 8, by fitting the bosses 75 of the side frame sections 71 into the light transmitting through-holes 123 of the side plates 121, the detection light emitted from the light-emitting element 174 passes through the boss 75 fitted into the right light transmitting through-hole 123, enters the toner-accommodating chamber 37 via the right window 142, and passes through the toner-accommodating chamber 37. Subsequently, the detection light exits the toner-accommodating chamber 37 via the left window 142, passes through the boss 75 fitted into the left light transmitting through-hole 123, and is detected by the light-receiving element 175. Accordingly, this structure can accurately detect the amount of toner remaining in the toner-accommodating chamber 37.

6. Operations and Effects of the Drum Unit Mounting and Removal

In the printer 1 described above, the drum unit 21 equipped with four drum subunits 23 can be mounted in and removed from the main casing 2 as a unit. More specifically, the operator can pull the drum unit 21 from the main casing 2 so that the drum unit 21 slides along the discharge trays 64 in the front-to-rear direction by gripping the near side grip part 104 provided on the front wall 98 of the front beam 96. The near side grip part 104 is on the near side of the drum unit 21 in the pulling direction. Subsequently, the operator can lift the drum unit 21 by gripping the far side grip part 116 provided on the bridging wall 113 of the rear beam 111 in addition to the near side grip part 104. The far side grip part 116 is provided on the far side of the drum unit 21 in the pulling direction. Accordingly, the user need not release the near side grip part 104 of the drum unit 21 between the step of pulling the drum unit 21 out of the main casing 2 and the step of lifting and removing the drum unit 21. The user also need not release a grip on the near side grip part 104 when mounting the drum unit 21 in the main casing 2. Hence, this construction reduces the danger of the user dropping the drum unit 21, facilitating mounting and removal of the same.

Further, the near side grip part 104 is disposed in the widthwise center of the front wall 98 described above, while the far side grip part 116 is similarly disposed in the widthwise center of the bridging wall 113 so that the near side grip part 104 and far side grip part 116 are disposed at equivalent positions in the width direction. Specifically, the positions of the near side grip part 104 and far side grip part 116 in the width direction are aligned with the widthwise center position of the drum unit 21, that is, the straight line X1 passing through the center of gravity of the drum unit 21. Therefore, the user can easily stabilize the drum unit 21 by gripping the near side grip part 104 and far side grip part 116, thereby further facilitating mounting and removal of the drum unit 21.

Further, when the drum unit 21 is mounted in the drum-accommodating section 161, the duct 168 provided in the main casing 2 is positioned rearward of the drum unit 21, and the exhaust openings 169 formed in the duct 168 face forward. The ventilation hole 119 is formed in the far side grip part 116 between the depressed part 117 and rear grip 118 in a position opposing the exhaust openings 169 of the duct 168 in the front-to-rear direction. An airflow formed when air in the main casing 2 is drawn out through the exhaust openings 169 in the duct 168 (indicated by arrows in FIGS. 1 and 19) follows a direction that passes through the ventilation hole 119. Hence, the ventilation hole 119 reduces the amount of fluid resistance that the far side grip part 116 applies to the flow of air. As a result, hot air in the main casing 2 and ozone generated from the chargers 25 can follow the airflow and drawn smoothly out through the duct 168, without disturbance of the airflow.

In the drum unit 21 described above, developer cartridges 22 corresponding to each color are detachably mounted in corresponding drum subunits 23. Accordingly, when one of the developer cartridges 22 needs replacing, it is possible to replace only the relevant developer cartridge 22 in the corresponding drum subunit 23.

Further, the developer cartridge grip part 146 is disposed in the widthwise center of the developer cartridge 22 at a position in the width direction equivalent to the widthwise positions of the near side grip part 104 and the far side grip part 116. In other words, the developer cartridge grip part 146 is centered on the straight line X1 passing through the center of gravity of the drum unit 21. Therefore, when gripping the developer cartridge 22, the user can easily find and grip the developer cartridge grip part 146.

Further, the depressed part 148 in the developer cartridge grip part 146 is formed by cutting out the front edge of the developer cartridge grip part 146 in a substantially rectangular-shaped depression when seen in a plan view. Accordingly, the depressed part 148 opens toward the neighboring developer cartridge 22 on the front side when the developer cartridges 22 are mounted in the drum subunits 23. The depressed parts 148 function as a space for inserting fingers when gripping the developer cartridge grip part 146 and facilitate the handling of the developer cartridge grip part 146 without forming needless space between neighboring developer cartridges 22.

Further, the near side grip part 104 provided on the front beam 96 is disposed on the near side of the drum unit 21 in the pulling direction when the drum unit 21 is mounted in the drum-accommodating section 161 of the main casing 2. Therefore, the near side grip part 104 is exposed in the drum access opening 162 and can be gripped easily. In contrast, the far side grip part 116 provided on the rear beam 111 is disposed on the far side of the drum unit 21 in the pulling direction when the drum unit 21 is mounted in the drum-accommodating section 161. Hence, the far side grip part 116 is not exposed in the drum access opening 162 when the front cover 163 is opened and cannot be operated at this time. However, the near side grip part 104 is exposed and can be operated while the drum unit 21 is in a mounted state, enabling the user to grip the near side grip part 104 and pull the drum unit 21 toward the user (forward) until the flange parts 122 of the side plates 121 disengage from the rails 164 in the main casing 2 and the drum unit 21 separates from the drum-accommodating section 161. The far side grip part 116 disposed on the far side of the drum unit 21 in the pulling direction is exposed in the drum access opening 162 when the drum unit 21 is about to separate from the drum-accommodating section 161 and can be operated at this time. This construction restricts the drum unit 21 from being removed from the drum-accommodating section 161 at a point between the mounted state and the separated state, thereby preventing the user from pulling out the drum unit 21 carelessly.

In the printer 1 described above, the front wall 170 of the main casing 2 is provided with the tray access opening 172 in communication with the tray-accommodating section 171, which accommodates the paper tray 7, and the drum access opening 162 in communication with the drum-accommodating section 161, which accommodates the drum unit 21. With this construction, the paper tray 7 and drum unit 21 can be removed from the main casing 2 in the same direction, improving the operability of the printer 1.

7. Variations of the Drum Unit

Figure 22:
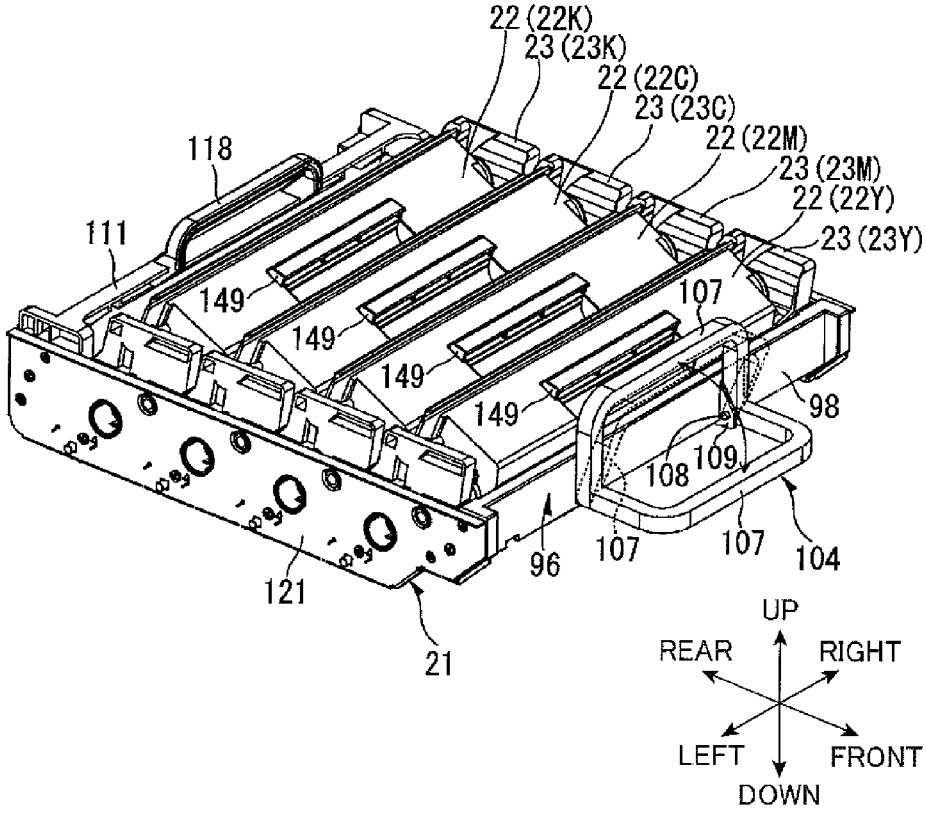
FIG. 22 is a perspective view from the left side of the drum unit (with a rotatable nearside grip part)
Figure 23:
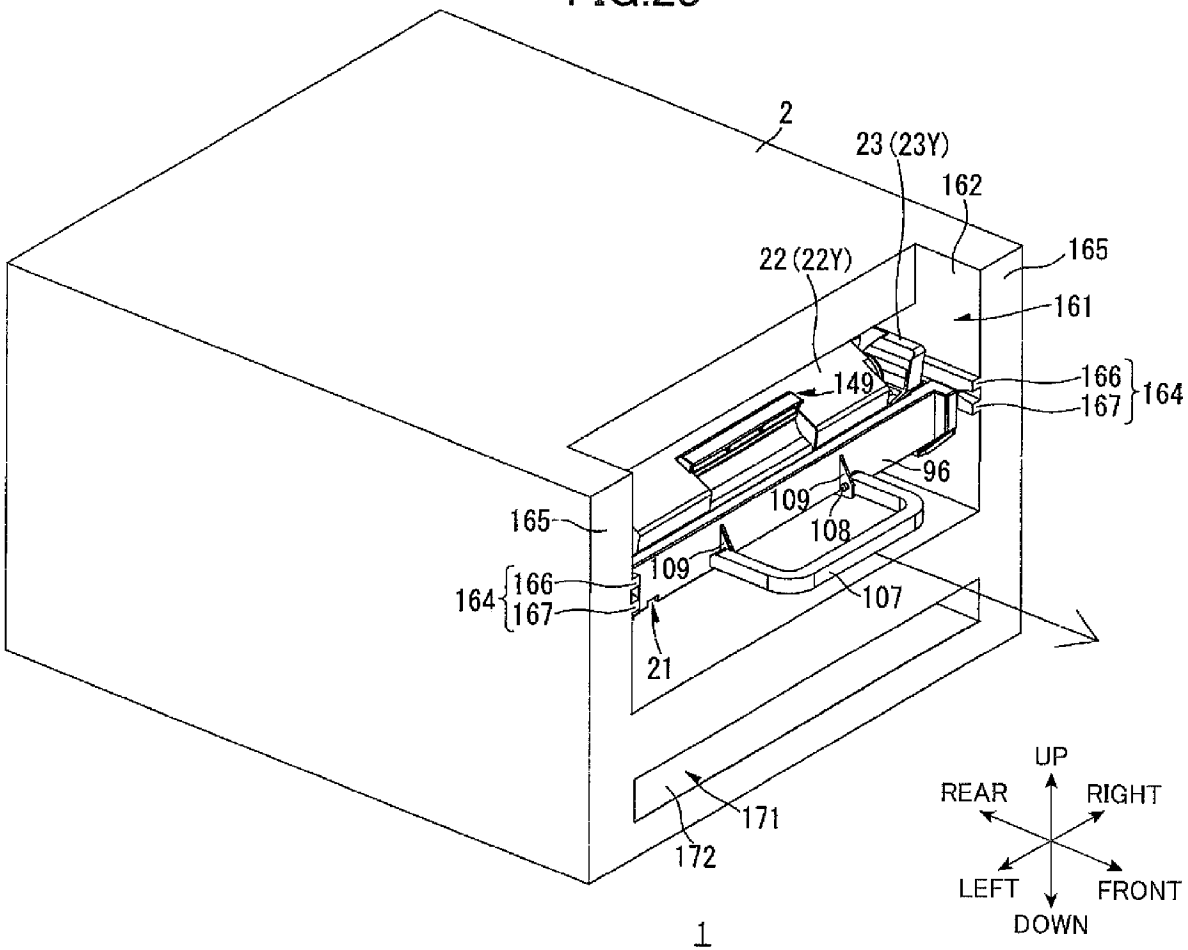
FIG. 23 is a perspective view showing the drum unit mounted in the main casing.
Figure 24:
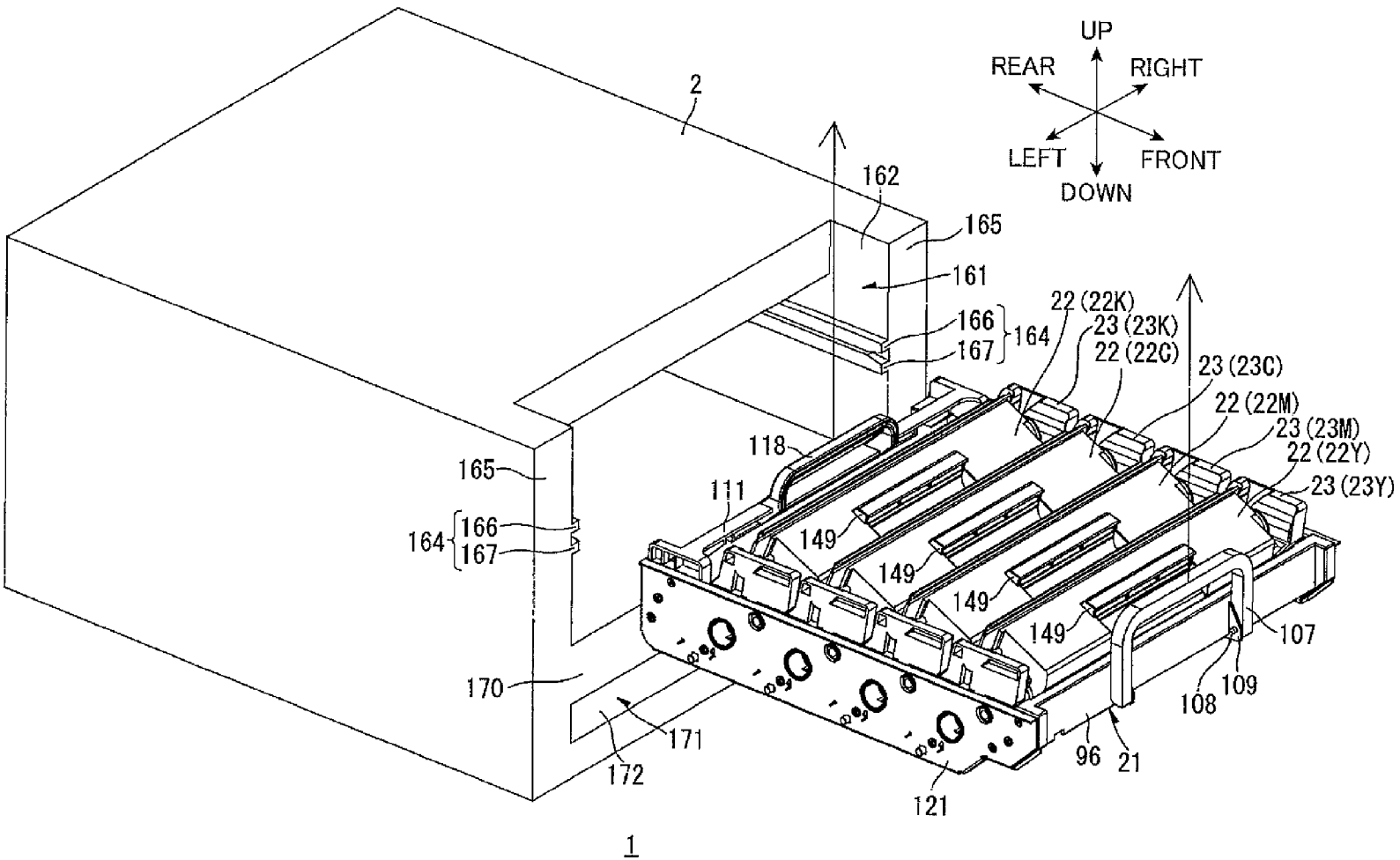
FIG. 24 is a perspective view showing the drum unit removed from the main casing.
Figure 25:
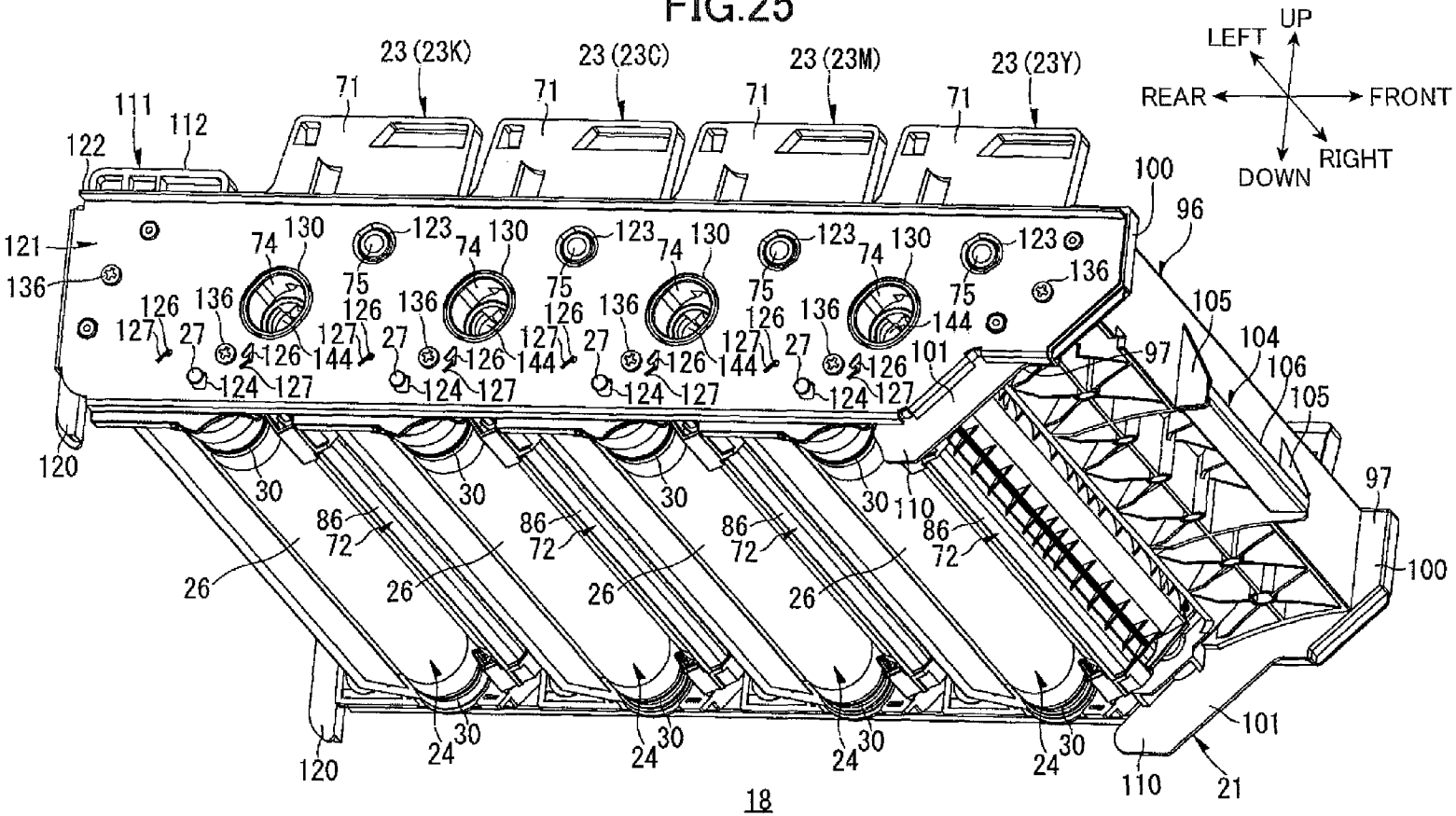
FIG. 25 is a perspective view from the bottom left side of the drum unit provided with front feet and rear feet.
Figure 26:
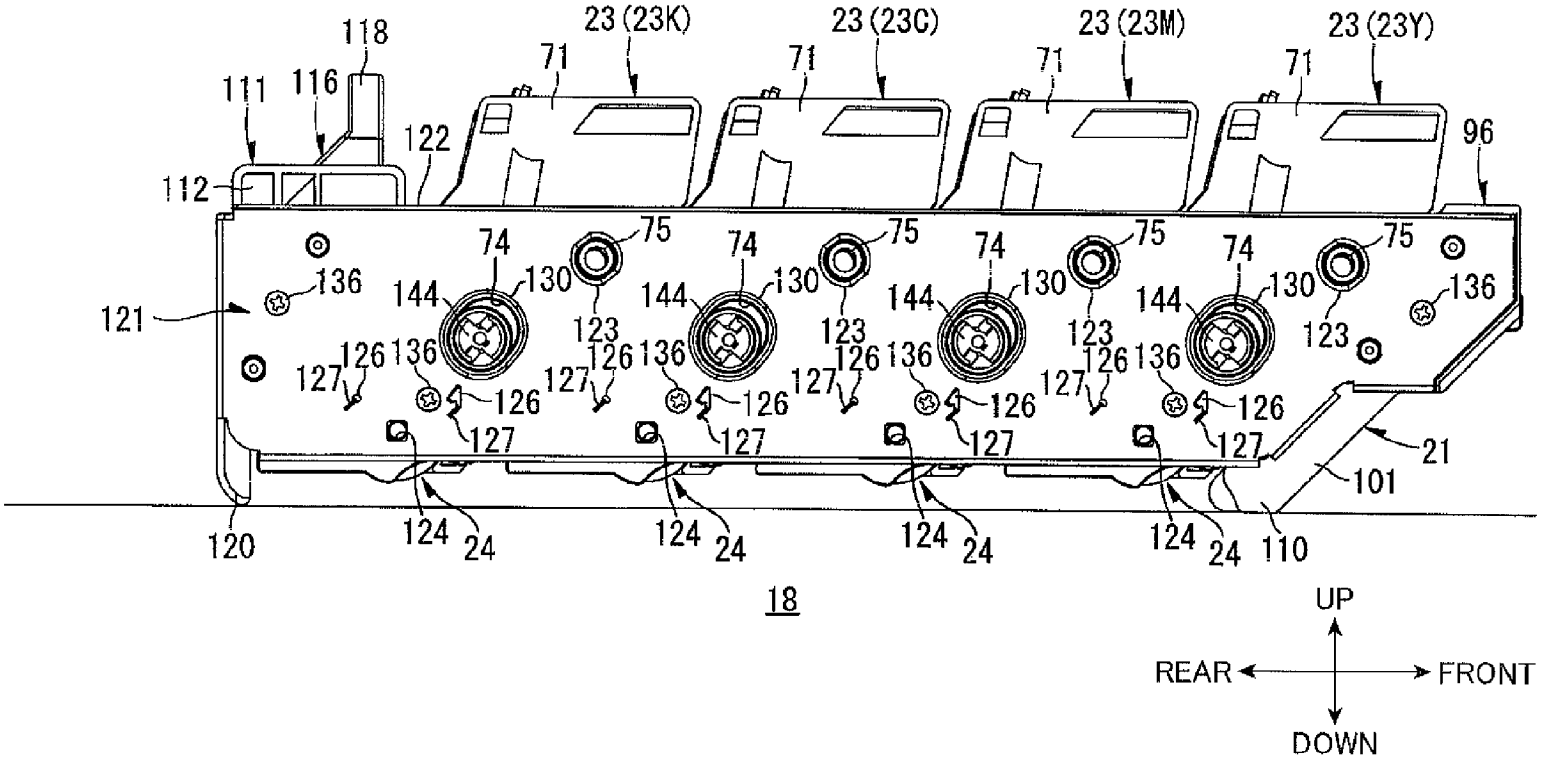
FIG. 26 is a left side view of the drum unit shown in FIG. 25.
Figure 27A:
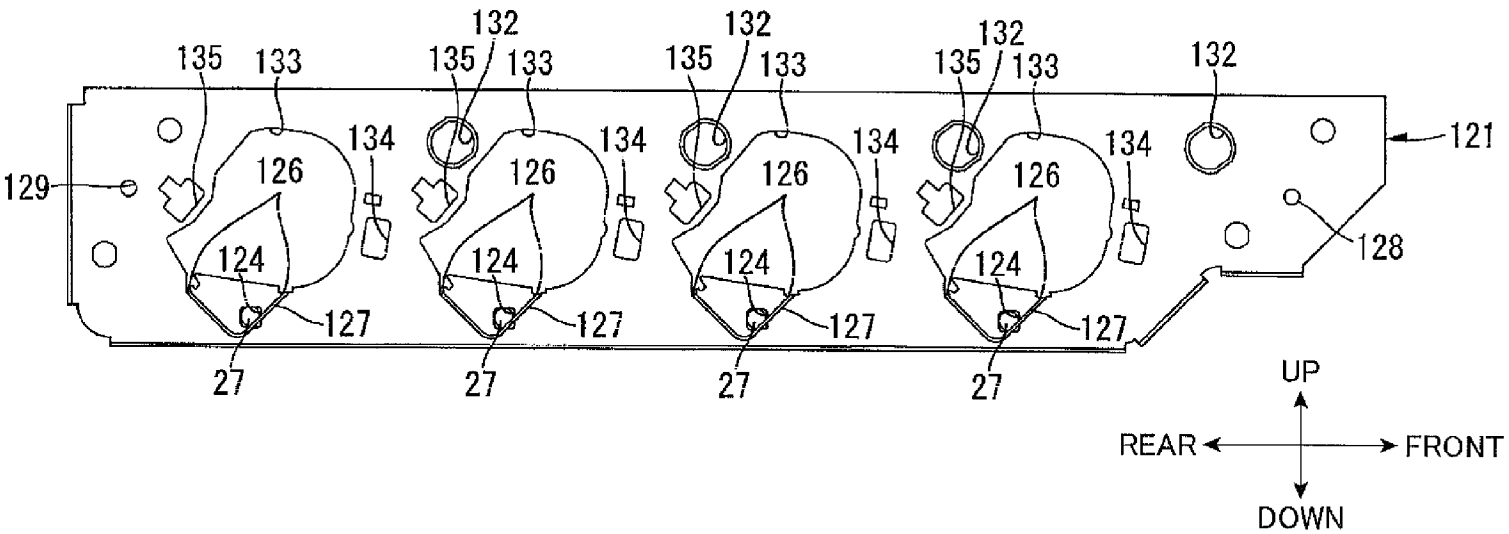
FIG. 27A is a side view of a side plate illustrating the positioning of drum shafts in the side plate according to a first variation.
Figure 27B:
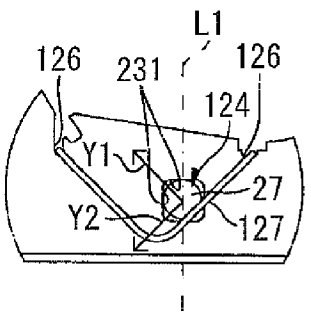
FIG. 27B is a enlarged view of FIG. 27A showing how the wire spring urges the drum shaft.

FIG. 22 is a perspective view from the left side of the drum unit 21 (with a rotatable nearside grip part). FIG. 23 is a perspective view showing the drum unit 21 mounted in the main casing 2. FIG. 24 is a perspective view showing the drum unit 21 removed from the main casing 2. FIG. 25 is a perspective view from the bottom left side of the drum unit 21 provided with front feet 110 and rear feet 120. FIG. 26 is a left side view of the drum unit 21 shown in FIG. 25. FIG. 27A is a side view of a side plate 121 illustrating the positioning of drum shafts 27 in the side plate 121 according to a first variation. FIG. 27B is a enlarged view of FIG. 27A showing how the wire spring 127 urges the drum shaft 27.

Next, variations of the drum unit will be described with reference to FIGS. 22 through 32C, wherein like parts and components are designated with the same reference numerals to avoid duplicating description.

(1) First Variation

FIG. 22 shows a possible variation of the near side grip part 104. This variation includes mounting plates 109 fixed to the front wall 98 of the front beam 96, hinges 108, and a grip 107 rotatably supported on the mounting plates 109 via the hinges 108.

Each of the mounting plates 109 is a thin plate substantially L-shaped in a front view and is configured of two pieces. One vertically extended piece is a substantially triangular-shaped thin plate that tapers toward the top in a side view. A hole is formed through the lower portion of the substantially triangular plate, penetrating the plate in the thickness direction (left-to-right direction). The other piece constituting the mounting plate 109 is bent substantially at a right angle to the first piece from the lower end thereof and extends outward in the width direction.

The grip 107 is substantially U-shaped in a plan view and includes base ends confronting each other over a gap, and a free end portion bridging the base ends. The hinges 108 are disposed at opposing positions on the inside surfaces of the base parts.

Two of the mounting plates 109 are fixed to the front beam 96 so as to be symmetrical about the widthwise center of the front beam 96, so as to be substantially L-shaped in a front view, and so as to be arranged such that the holes formed in the lower portions of the triangular plate oppose each other in the left-to-right direction. The hinges 108 are fitted into these holes, and the grip 107 is mounted on the mounting plates 109 via the hinges 108. Through this construction, the free end portion of the grip 107 is rotatably supported relative to the mounting plates 109 (that is, the drum unit 21 including the front beam 96) about the hinges 108 on the base ends. However, the base ends of the grip 107 contact the other pieces of the L-shaped mounting plates 109 and are thus restricted from rotating lower than a horizontal orientation. Hence, the grip 107 is restricted to rotating about the hinge 108 within the range indicated by an arrow in FIG. 22. More specifically, in a left side view, the grip 107 can rotate clockwise from 0° (hereinafter referred to as a vertical state) to 90° (hereinafter referred to as a horizontal state), where 0° is the upward orientation.

With this configuration, as shown in FIG. 23, the grip 107 to be gripped by the user is in the horizontal state when the user pulls the drum unit 21 from the drum-accommodating section 161 of the main casing 2. Hence, the pulling force is efficiently transferred to the drum unit 21, enabling the user to smoothly pull the drum unit 21 from the main casing 2. When the user lifts the drum unit 21 after pulling the drum unit 21 from the main casing 2, the grip 107 is rotated about the hinges 108 to the vertical state shown in FIG. 24. In this way, the lifting force can be efficiently transmitted to the drum unit 21. By gripping both the rear grip 118 of the far side grip part 116 and the grip 107, the user can easily lift the drum unit 21.

Further, the front side grip part configured of the grip 107, hinges 108, and mounting plates 109 causes no interference when pulling the drum unit 21 from the main casing 2, while facilitating the user in lifting the drum unit 21.

(2) Second Variation

FIG. 25 shows a variation in which front feet 110 have been added to the bottom ends of the side wall leg parts 101. In the above-described aspect, the side wall leg parts 101 form part of the side walls 97 of the front beam 96. This variation also includes rear feet 120 disposed on the bottom ends of the side walls 112, which constitute part of the rear beam 111.

The front feet 110 are formed continuously with the side wall leg parts 101 and continue to protrude diagonally downward and rearward from the side wall leg parts 101. The rear feet 120 are formed continuously with the side walls 112 and protrude farther downward from the bottom edges of the side walls 112 on the rear side thereof.

As illustrated in FIG. 26, when the user places the drum unit 21 on a desk or other surface after removing the drum unit 21 from the main casing 2, the front feet 110 and rear feet 120 contact the surface so that a gap is maintained between the surface and the photosensitive drums 24. Accordingly, the front feet 110 and rear feet 120 can prevent damage to the photosensitive drums 24 caused by the photosensitive drums 24 contacting the surface. Hence, this construction facilitates operations on the drum unit 21 by enabling the drum unit 21 to be placed on a desk or other surface.

(3) Third Variation

In the drum unit 21 of the above-described aspect, wire springs 127 urge the widthwise ends of the drum shafts 27 diagonally upward and forward toward top and front contact surfaces 131 opposing the drum shafts 27 so that the drum shafts 27 are positioned between the pair of side plates 121 through three points of contact. However, as shown in FIGS. 27A and 27B, the wire springs 127 may instead be configured to urge the axial ends of the drum shaft 27 diagonally upward and rearward toward top and rear contact surfaces 231 opposing the drum shaft 27, similarly positioning the drum shaft 27 between the pair of side plates 121 through three points of contact.

Specifically, as shown in FIGS. 27A and 27B, the shaft through-holes 124 formed in the side plates 121 are substantially rectangular in shape in a side view having sides that are parallel in the front-to-rear direction and sides that are parallel in the vertical direction. Accordingly, top and rear peripheral edges of the shaft through-hole 124 follow two straight lines that intersect at substantially a right angle and constitute the contact surfaces 231 that contact the drum shaft 27 at points.

The wire springs 127 are retained in the side plate 121 between the pair of engaging holes 126 with the center bent downward to form a V-shape in a side view. The front side of the wire spring 127 crosses diagonally through the shaft through-hole 124 in an upward and forward direction.

In the drum unit 21 having this construction, the wire springs 127 that intersect the shaft through-holes 124 diagonally upward and forward urge the widthwise ends of the drum shaft 27 diagonally upward and rearward toward the top and rear contact surfaces 231 opposing the drum shaft 27 when the ends of the drum shaft 27 are inserted through the shaft through-holes 124. Hence, the widthwise ends of the drum shaft 27 are pressed by the wire spring 127 at a point of contact and contact the top and rear contact surfaces 231 at points of contact. Accordingly, the widthwise ends of the drum shaft 27 are accurately positioned between the pair of side plates 121 through three points of contact.

Further, by setting the urging direction of the wire spring 127 diagonally upward and rearward as shown in FIGS. 27A and 27B, the urging direction Y1 of the wire spring 127 passes through the axial center of the drum shaft 27 in a radial direction so that both the urging direction Y1 of the wire spring 127 and a mounting direction Y2 for mounting the developer cartridge 22 are directed toward the rear side of a vertical imaginary plane L1 with respect to the front-to-rear direction. That is, the urging direction Y1 is directed toward the same side as the mounting direction Y2 with respect to the vertical imaginary plane L1 perpendicular to the front-to-rear direction. Hence, the straight line Y1 of the wire spring 127 can be set to the same side as the direction in which the developing roller 34 presses against the photosensitive drum 24, thereby further improving the accuracy for positioning the photosensitive drums 24.

(4) Fourth Variation

In the drum unit 21 of the above-described aspect, the pair of side frame sections 71 and the center frame section 72 constituting each of the drum subunits 23 are formed as separate units, as shown in FIG. 9. However, as shown in FIG. 28, it is possible to form one of the side frame sections 71, such as a left side frame section 71L, integrally with a center frame section 172.

Figure 28:
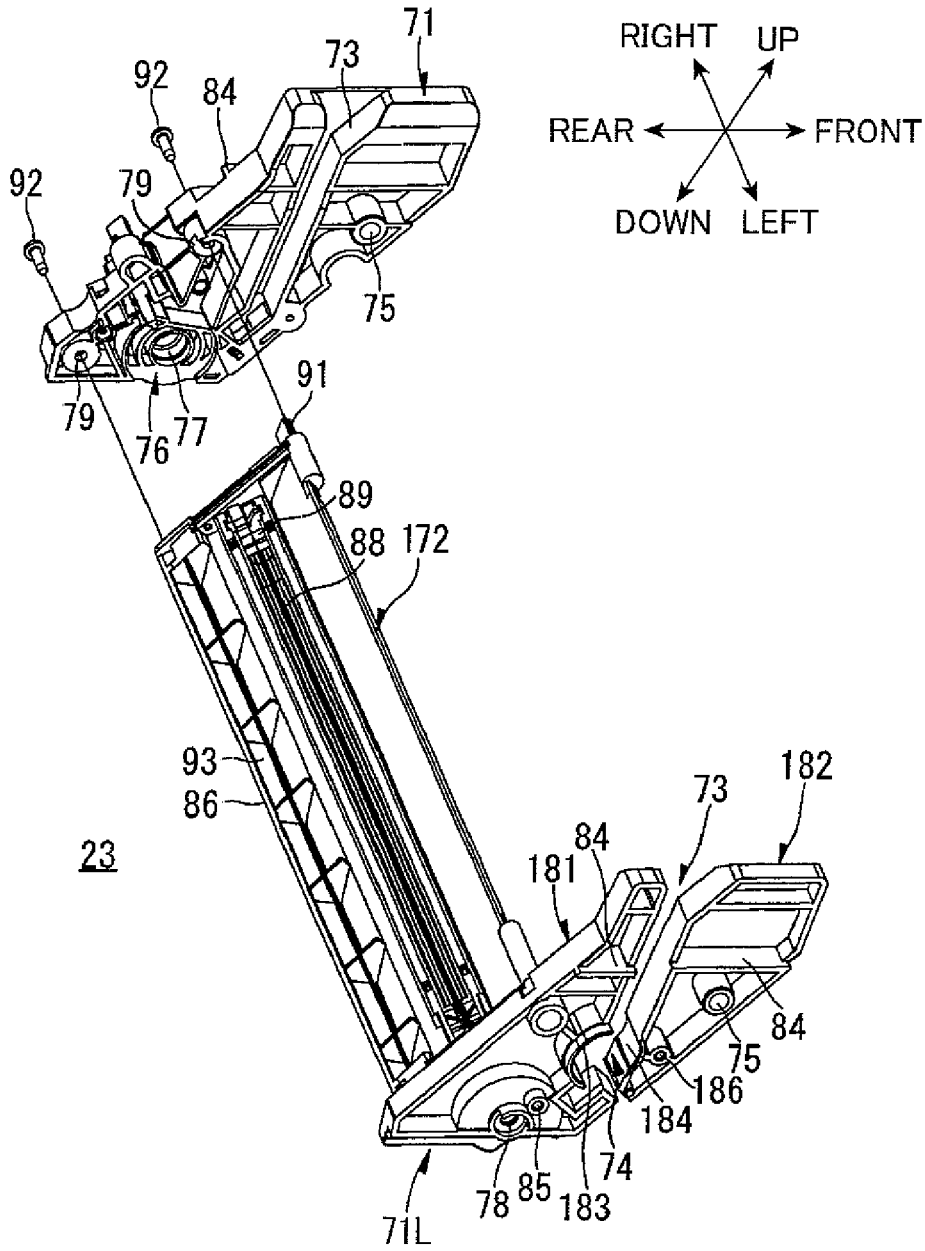
FIG. 28 is an exploded perspective view of a drum subunit according to a second variation.

In the drum subunit 23 shown in FIG. 28, the center frame section 172 and the left side frame section 71L are integrally molded of a synthetic resin material, while the right side frame section 71 is molded separately of a synthetic resin material.

(4-1) Side Frame Sections

The right side frame section 71 is formed identically to the right side frame section 71 of the aspect described above.

The left side frame section 71L is configured of a rear side frame section 181 formed integrally with the center frame section 172, and a front side frame section 182 formed separately from the rear side frame section 181.

The rear side frame section 181 is substantially triangular plate shaped in a side view, growing narrower toward the top. The front endface of the rear side frame section 181 on the upper side forms the guide groove 73 together with the rear endface of the front side frame section 182, described next, for guiding the developer cartridge 22 when the developer cartridge 22 is mounted in or removed from the drum subunit 23.

While not shown in the drawings, the drum support unit 76 is formed in the rear side frame section 181 for supporting the photosensitive drum 24 described above, and the axial insertion through-hole 78 is formed in the center of the drum support unit 76 and penetrates the rear side frame section 181 in the thickness direction thereof. One of the protruding ridges 84 described above is formed in the upper region of the rear side frame section 181 extending in the front-to-rear direction.

A rear side recessed part 183 is provided midway in the front endface of the rear side frame section 181, forming an arc shape that recesses in the rear direction. Together with a front side recessed part 184 of the front side frame section 182 described next, the rear side recessed part 183 forms the coupling inner through-hole 74 positioned opposite the passive coupling gear 144 of the developer cartridge 22 described above.

The rear side frame section 181 also includes the screw receiving part 85 described above positioned between the rear side recessed part 183 and the axial insertion through-hole 78 for receiving the screw 136 (see FIG. 29) used to attach the rear side frame section 181 to the side plate 121.

The front side frame section 182 has a substantially triangular plate shape in a side view and narrows toward the bottom. Together with the front endface of the rear side frame section 181, the rear endface of the front side frame section 182 on the upper side thereof forms the guide groove 73 for guiding the developer cartridge 22 when the developer cartridge 22 is mounted in or removed from the drum subunit 23.

The other protruding ridge 84 described above is formed in the upper region of the front side frame section 182 extending in the front-to-rear direction.

The boss 75 described above is formed on the front side frame section 182 below the protruding ridge 84. As in the aspect, the boss 75 is arranged so as to oppose the window 142 of the developer cartridge 22 in the width direction when the developer cartridge 22 is mounted in the drum subunit 23.

The front side recessed part 184 is formed in the rear endface of the front side frame section 182 on the lower side thereof and has an arc shape that is depressed in the forward direction. Together with the rear side recessed part 183 of the rear side frame section 181, the front side recessed part 184 forms the coupling inner through-hole 74 that opposes the passive coupling gear 144 of the developer cartridge 22 described above.

A screw-receiving part 186 is also provided on the front side frame section 182. A screw 185 (see FIG. 29) is screwed into the screw-receiving part 186 for attaching the front side frame section 182 to the side plate 121 in front of the front side recessed part 184. The screw-receiving part 186 is cylindrical in shape and protrudes outward in the width direction from the outer wall surface of the front side frame section 182.

(4-2) Center Frame Section

The center frame section 172 is integrally molded with the rear side frame section 181 described above and is integrally provided with the center plate 86 extending in the width direction, and the inner plate 87 (not shown in FIG. 28; see FIG. 9) provided on the right end of the center plate 86 in the width direction.

As in above-described aspect, the charger holding unit 88 is provided on the center plate 86; the discharge wire 28 is extended in the charger holding unit 88; and the grid 29 is held below the discharge wire 28. The wire cleaner 89 that grips the discharge wire 28 is held by the charger holding unit 88 so as to be capable of sliding in the width direction.

Further, as in the above-described aspect, the brush holding unit 93 is provided on the center plate 86 below the charger holding unit 88 for holding the cleaning brush 68.

As shown in FIG. 9, the inner plate 87 is formed so as to bend from the center plate 86 on the widthwise right end thereof and to extend forward. The inner plate 87 is substantially triangular in shape and narrows toward the front in a side view. The cylindrical axial insertion part 90 is provided on the front edge of the inner plate 87 for receiving the drum shaft 27.

Further, the screw receiving parts 91 are formed in the rear edge of the inner plate 87 at both vertical ends thereof and extend inward in the width direction from the outer wall surface of the inner plate 87 along the center plate 86. The screws 92 are screwed into the screw receiving parts 91 for attaching the right side frame section 71 to the center frame section 172.

(4-3) Assembly of the Drum Subunit

As shown in FIG. 28, the right side frame section 71 is disposed on the widthwise right side of the center frame section 172. And the cylindrical axial insertion part 90 (see FIG. 9) of the center frame section 172 is inserted into the receiving part 77 of the right side frame section 71. Concurrently, the cylindrical axial insertion part 90 is aligned with the insertion through-hole 78 in the width direction. The right side frame section 71 is positioned relative to the center frame section 172 so that the threaded through-holes 79 of the side frame section 71 is aligned with the screw receiving parts 91 of the center frame section 172 in the width direction. Subsequently, the screws 92 are inserted through the threaded through-holes 79 and screwed into the screw receiving parts 91, thereby attaching the right side frame section 71 to the widthwise right side of the center frame section 172 to complete assembly of the drum subunit 23 having a similar structure to that in the above-described aspect. Through this assembly process, the right side frame section 71, the center frame section 172, and the rear side frame section 181 of the left side frame section 71L are assembled together (hereinafter referred to as the integrated part of the drum subunit 23), while the front side frame section 182 of the left side frame section 71L is provided separately.

The photosensitive drums 24 are retained in this drum unit 21 as described above in the above-described aspect.

(4-4) Assembly of the Drum Unit

Figure 29:
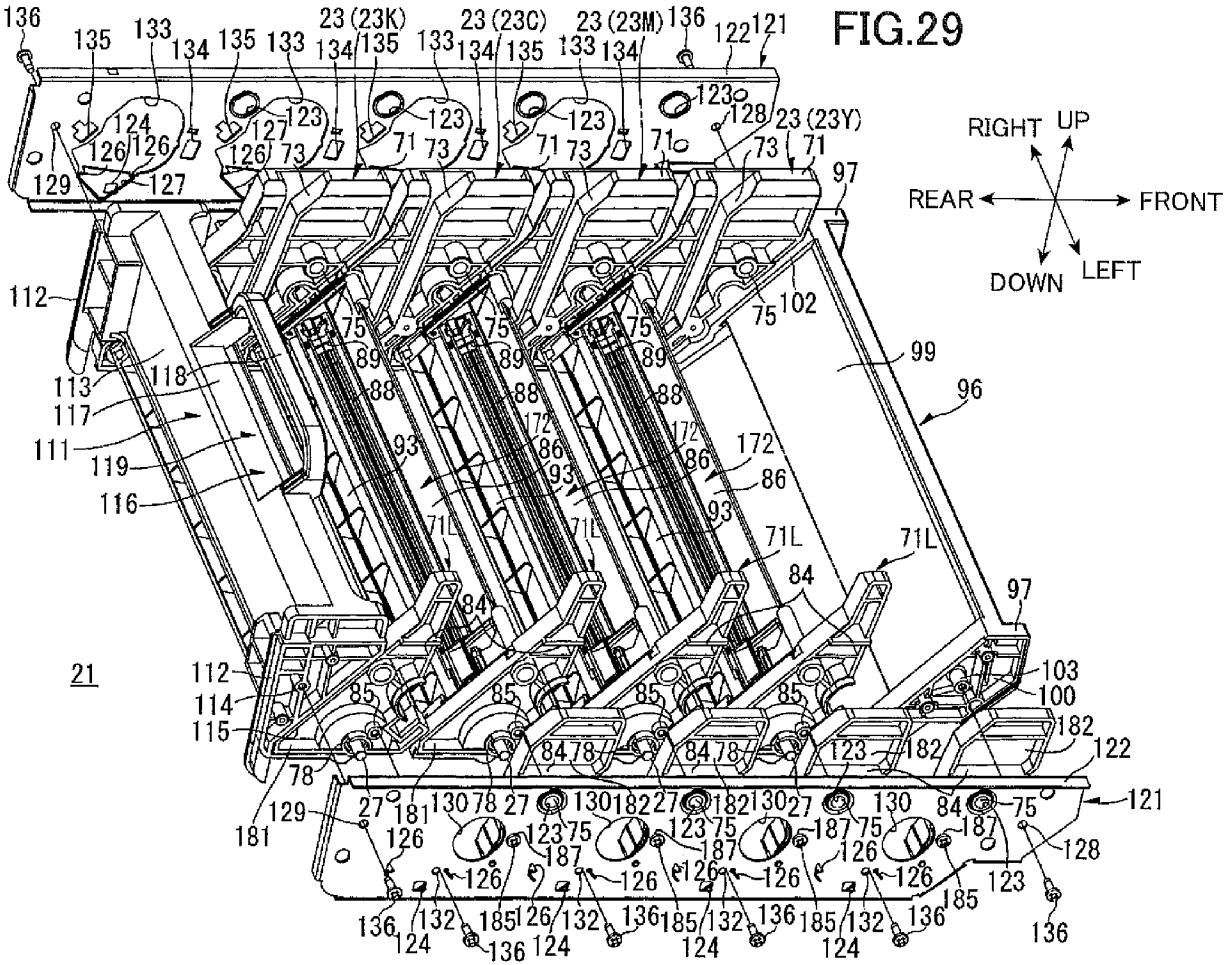
FIG. 29 is a perspective view from the left side illustrating the assembly of a pair of side plates to a front beam, four drum subunits according to the second variation shown in FIG. 28, and a rear beam in a juxtaposed relationship.

When assembling the drum unit 21 using the drum subunits 23 shown in FIG. 29, the front side frame sections 182 of the left side frame sections 171 are mounted on the left side plate 121 corresponding to each drum subunit 23. In mounting each front side frame section 182 on the left side plate 121, the front side frame section 182 is positioned on the inside of the left side plate 121 in the width direction so that the protruding ridge 84 of the front side frame section 182 contacts the inner wall surface of the left side plate 121 and the boss 75 of the front side frame section 182 is fitted into the light transmitting through-hole 123 of the side plate 121 so that the boss 75 is exposed externally in the width direction.

At this time, the screw-receiving part 186 of the front side frame section 182 is positioned opposite an auxiliary screw insertion hole 187 formed in the left side plate 121 in front of the coupling inner through-hole 130. The screw 185 is inserted through the auxiliary screw insertion hole 187 and screwed into the screw-receiving part 186, thereby fixing the front side frame section 182 to the left side plate 121.

Next, the integrated parts of four drum subunits 23 assembled as described above are arranged adjacent to one another in the front-to-rear direction. When arranging the integrated parts of the four drum subunits 23, the rear endface of the right side frame section 71 in the integrated part of the front-side drum subunit 23 is placed in contact with the front endface of the right side frame section 71 in the integrated part of the rear-side drum subunit 23, and the rear endface in the lower part of the rear side frame section 181 of the front side drum subunit 23 is placed in contact with the front endface on the lower part of the rear side frame section 181 of the rear-side drum subunit 23. With this construction, the integrated parts for the drum subunits 23 can be juxtaposed in the front-to-rear direction in an orientation downward to the rear.

Next, similar to the above-described aspect, the front beam 96 is disposed adjacent to the integrated part for the forward most drum subunit 23, and the rear beam 111 is disposed adjacent to the integrated part for the rearward most drum subunit 23. Further, the side plates 121 are positioned on the widthwise sides of the front beam 96, the integrated parts of the four drum subunits 23, and the rear beam 111 that are juxtaposed in the front-to-rear direction. As described in the above-described aspect, the side plates 121 are assembled to the front beam 96, integrated parts of the drum subunit 23, and the rear beam 111 using screws 136.

When assembling the side plate 121 to the left side of the integrated parts, the center screw through-holes 132 formed in the left side plate 121 are aligned in the width direction with the screw receiving parts 85 formed in the rear side frame sections 181 of the integrated parts. Subsequently, the inner wall surface of the left side plate 121 is placed in contact with the protruding ridge 84 of the rear side frame section 181 in the integrated parts so that the left ends of the drum shafts 27 are inserted through the shaft through-holes 124 formed in the left side plate 121.

Figure 30:
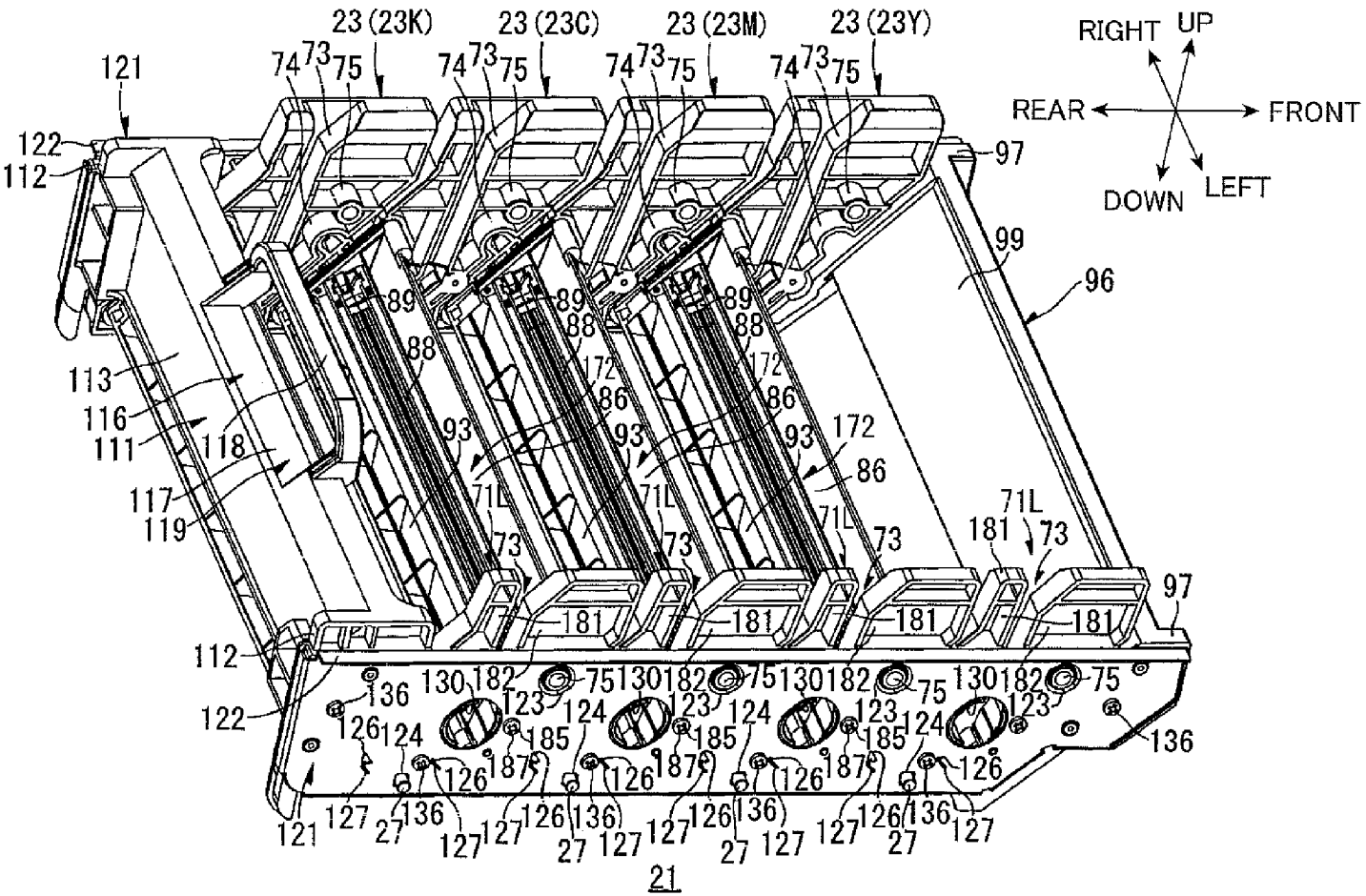
FIG. 30 is a perspective view from the left side illustrating the pair of side plates after being assembled to the front beam, the four drum subunits shown in FIG. 28, and the rear beam in a juxtaposed relationship.

Next, screws 136 are inserted through the center screw through-holes 132 and screwed into the screw receiving parts 85, thereby completing assembly of the left side plate 121 on the left side of the drum subunits 23, as shown in FIG. 30. At this time, the rear side frame sections 181 and front side frame sections 182 are arranged alternately in the front-to-rear direction, forming the guide grooves 73 in the side frame sections 171 between the front endfaces of the rear side frame sections 181 and the rear endfaces of the front side frame sections 182. At the same time, the coupling inner through-holes 74 are formed between the rear side recessed parts 183 of the rear side frame sections 181 and the corresponding front side recessed parts 184 of the front side frame sections 182. In other words, the rear side frame sections 181 and the respective front side frame sections 182 are divided from each other in the front-to-rear direction by the coupling inner through-holes 74.

(4-5) Operations and Effects of the Fourth Variation

By forming the rear side frame section 181 of the left side frame section 71L and the center frame section 172 integrally, the drum subunit 23 shown in FIG. 28 reduces the number of required parts, thereby reducing manufacturing costs.

Further, since the left side frame section 71L is configured of the rear side frame section 181 formed integrally with the center frame section 172 and the front side frame section 182 formed separately from the rear side frame section 181, it is possible to reduce the number of required parts by forming the rear side frame section 181 integrally with the center frame section 172 and to improve the rigidity of the left side frame section 71L by forming the front side frame section 182 separately from the rear side frame section 181.

That is, when the left side frame section 71L is formed integrally, the strength of the side frame section 71L is reduced by pitting the coupling inner through-hole 74, inviting damage to the left side frame section 71L such as cracking along the edges of the coupling inner through-hole 74.

However, when the side frame section 71L is divided in the front-to-rear direction by the coupling inner through-hole 74 to form the rear side frame section 181 and front side frame section 182, the strength of the side frame section 71L is not reduced by the coupling inner through-hole 74, thereby ensuring the strength in the rear side frame section 181 and front side frame section 182.

Further, since the center frame section 172 is formed integrally with the rear side frame section 181 in the left side frame section 71L, the center frame section 172, which holds the charger 25, can be integrally positioned with the rear side frame section 181 relative to the side plate 121, thereby improving the accuracy of positioning.

In the drum subunit 23 shown in FIG. 28, the left side frame section 71L is formed integrally with the center frame section 172, while the right side frame section 71 is formed separately. However, it is possible to form the right side frame section 71 integrally with the center frame section 172 and the left side frame section 71L separately. Or it is possible to form the left side frame section 71L, right side frame section 71, and center frame section 172 integrally.

(5) Fifth Variation

In the drum unit 21 of the aspect described above, the developer cartridges 22 of each color are provided separately from the corresponding drum subunits 23 and are detachably mounted in the corresponding drum subunits 23. However, the developer cartridges 22 and respective drum subunits 23 may be formed integrally. In this case, it is possible to replace the toner, developing roller 34, and photosensitive drum 24 for each color all at once by replacing the drum unit 21.

(6) Sixth Variation

Figure 31:
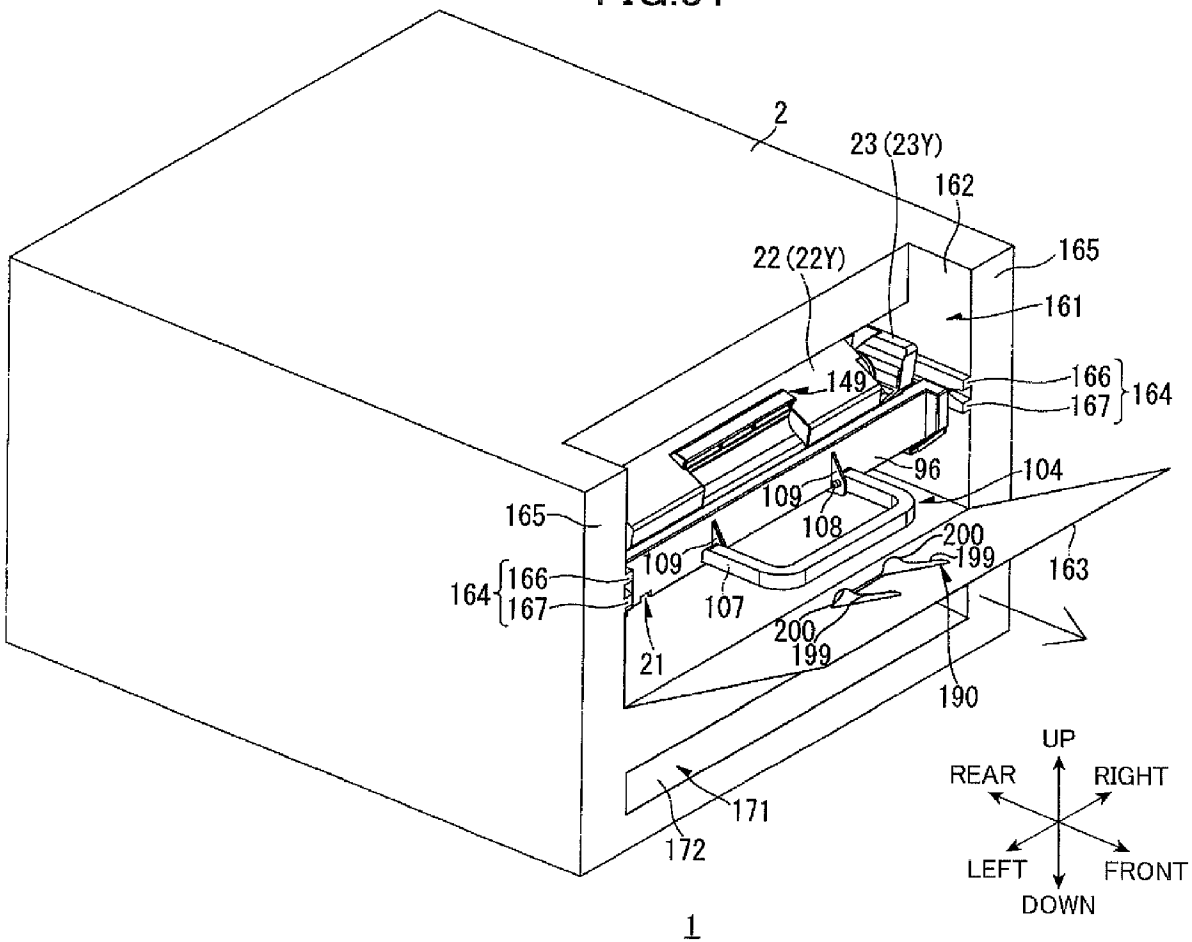
FIG. 31 is a perspective view showing a drum unit mounted in a main casing (with a rotatable near side grip part) of a printer according to a sixth variation.
Figure 32C:
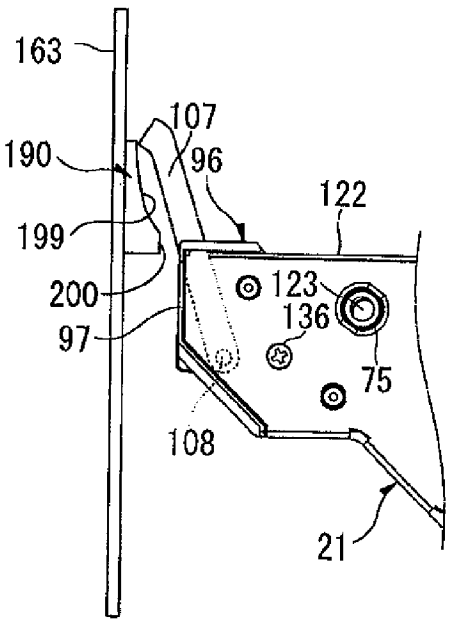
FIG. 32C is a side cross-sectional view of the printer according to the sixth variation, in which the front cover in the closed position and the handle in the stored position.
Figure 32B:
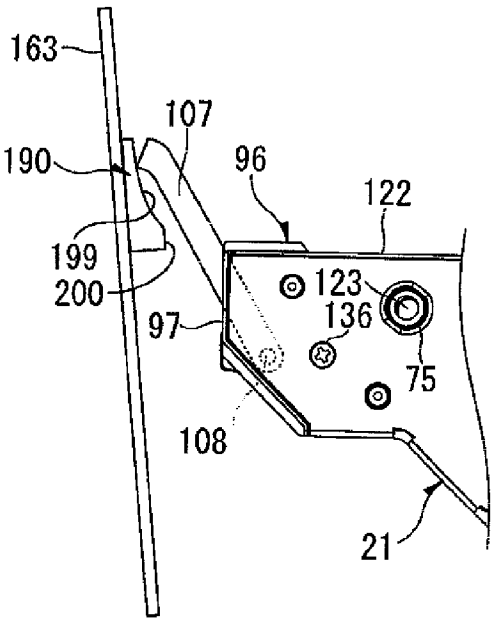
FIG. 32B is a side cross-sectional view of the printer according to the sixth variation, in which a parallel part of the guide is in contact with the distal end of the handle.
Figure 32A:
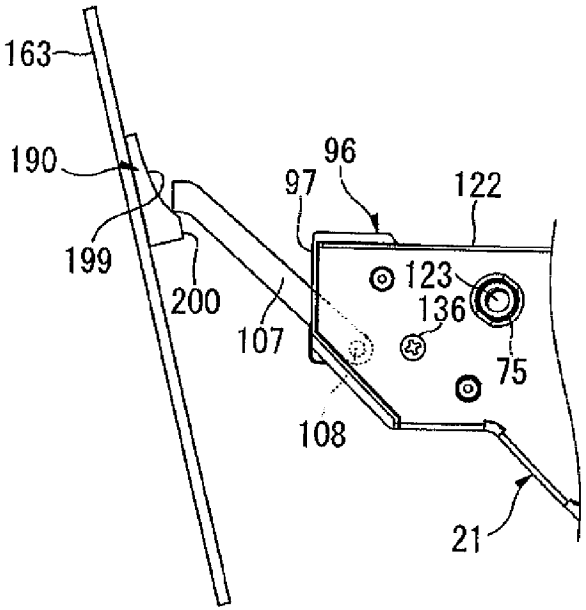
FIG. 32A is a side cross-sectional view of the printer according to the sixth variation in a region including a front cover and a handle to illustrate the movement of the front cover toward a closed position and the rotation of the handle toward a stored position, in which a protruding part of a guide on the front cover is in contact with a distal end of the handle.

FIG. 31 is a perspective view showing a drum unit mounted in a main casing (with a rotatable near side grip part) of a printer according to a sixth variation. FIGS. 32A through 32C are side cross-sectional views in a region including a front cover and a handle, illustrating movement of the front cover toward a closed position and rotation of the handle toward a stored position.

In the first variation described above, the rotation of the grip 107 about the hinges 108 is restricted to the range indicated by the arrow in FIG. 22. That is, the grip 107 can rotate from a vertical position at 0° to a horizontal operating position rotated 90° from the vertical position in a clockwise direction when viewed from the left side. However, it is possible to provide a stored position described next in place of the vertical position.

Specifically, a stored position may be set to a position indicated by a dotted line in FIG. 22 at which the grip 107 is at a position rotated slightly (20° for example) clockwise from the vertical position of 0°. Here, rotation of the grip 107 is restricted within a range from the stored position (20° position in this example) to the operating position (horizontal position) described above. In the stored position, a force component in the rotating direction from the weight of the grip 107 constantly urges the grip 107 to rotate toward the operating position. Hence, if the user is not supporting the grip 107, the grip 107 will immediately rotate from the stored position to the operating position.

As shown in FIG. 31, storing guides 190 are provided on the front cover 163 at positions opposing the grip 107 of the drum unit 21 accommodated in the drum-accommodating section 161. The storing guides 190 are positioned opposite each other in the width direction on both sides of the widthwise center of the front cover 163 and are configured of a pair of ribs elongated in a direction orthogonal to the width direction. Each storing guide 190 is integrally configured of a parallel part 199 extending substantially parallel to the surface of the front cover 163 in a vertical direction when the front cover 163 is in the closed position, and a protruding part 200 formed continuously with the bottom end of the parallel part 199 and protruding gently toward the drum unit 21.

Hence, as shown in FIG. 32A, when the front cover 163 is moved from the open position to the closed position, midway during this movement the protruding parts 200 of the storing guides 190 contact a distal end of the grip 107 in the operating position. At this time, the storing guides 190 apply pressure to the distal end of the grip 107. The pressure applied by the storing guides 190 opposes the urging force of the grip 107 caused by the rotational component in the weight of the grip 107, and the grip 107 begins rotating from the operating position toward the stored position.

As shown in FIG. 32B, as the front cover 163 is rotated farther toward the closed position, the distal end of the grip 107 slides along the parallel part 199 of the storing guide 190. Here, the storing guide 190 continues to apply pressure to the distal end of the grip 107 in a direction for rotating the grip 107 to the stored position.

As shown in FIG. 32C, the grip 107 completes its rotation to the stored position when the front cover 163 has rotated to the closed position. At this time, the storing guide 190 constantly applies pressure to the grip 107 in the stored position.

When the grip 107 is in the stored position and the front cover 163 is in the closed position and is subsequently moved from the closed position toward the open position, the pressure applied to the grip 107 by the storing guide 190 is removed, allowing the grip 107 to quickly rotate toward the operating position due to the urging force of its own weight described above.

With this construction, if the front cover 163 is rotated to the closed position when the drum unit 21 is mounted in the drum-accommodating section 161, the grip 107 rotates to the stored position in association with the movement of the front cover 163. Therefore, this construction eliminates the need to perform separate operations for moving the front cover 163 and rotating the grip 107, thereby improving the operability of the drum unit 21 and the printer 1.

Further, if the front cover 163 is rotated to the open position when the drum unit 21 is mounted in the drum-accommodating section 161, the grip 107 rotates to the operating position in association with the movement of the front cover 163. Therefore, this construction eliminates the need to perform separate operations for moving the front cover 163 and rotating the grip 107, thereby improving the operability of the drum unit 21 and the printer 1.

Further, the storing guides 190 in this construction smoothly link the opening and closing movement of the front cover 163 to the rotation of the grip 107 between the operating position and stored position, thereby improving the operability of the drum unit 21 and the printer 1.

8. Variation of the Color Laser Printer

The aspect described above relates to a tandem type color laser printer 1 for directly transferring images from the photosensitive drums 24 onto the paper 3, but the invention is not limited to this case. For example, the invention may be applied to an intermediate transfer type color laser printer configured to temporarily transfer toner images of each color onto an intermediate transfer member from photosensitive members and to subsequently transfer the composite image onto the paper at once.

What is claimed is:

1. A unit frame for use with a cartridge, the unit frame comprising:

a first side plate and a second side plate having through-holes; and a front beam and a rear beam, the front beam having a front-side grip and the rear beam having a rear-end grip, wherein a distance from an upper end of the front beam to an upper end of the front-side grip is smaller than a distance from an upper end of the rear beam to an upper end of the rear-end grip.

2. The unit frame according to claim 1, further comprising: an electrode that extends through the first side plate.

3. The unit frame according to claim 1, wherein the front-side grip has a depressed portion that opens upward.

4. The unit frame according to claim 1, further comprising:
a plurality of photosensitive drums rotatably supported between the first side plate and the second side plate.

5. The unit frame according to claim 1, further comprising:
a first guide member disposed on the first side plate and having:
a first guide groove configured to guide a cartridge; and
a first through-hole; and
a second guide member disposed on the second side plate and having a second guide groove configured to guide a cartridge;
wherein the first side plate has a second through-hole; and
wherein the first through-hole communicates to the second through-hole.

6. A unit frame comprising:
a first plate and a second plate;
a first beam extending between the first plate and the second plate, the first beam including a first grip; and
a second beam extending between the first plate and the second plate, the second beam including a second grip;
wherein the first grip is disposed between an upper end of the first beam and a lower end of the first beam, and
wherein the second grip is disposed on an upper end of the second beam.

7. The unit frame according to claim 6, further comprising:
an electrode that extends through the first plate.

8. The unit frame according to claim 6, wherein the first grip includes a depressed portion that opens upward.

9. The unit frame according to claim 6, further comprising:
a plurality of photosensitive drums rotatably supported between the first plate and the second plate.

10. The unit frame according to claim 6, further comprising:
a first guide member disposed on the first plate, the first guide member having a first guide groove configured to guide a cartridge and a first through-hole; and
a second guide member disposed on the second plate, the second guide member having a second guide groove configured to guide a cartridge,
wherein the first plate has a second through-hole,
wherein the first through-hole communicates to the second through-hole.

11. The unit frame according to claim 6, further comprising:
a first guide member disposed on the first plate, the first guide member having a first guide groove configured to guide a cartridge;
a second guide member disposed on the second plate, the second guide member having a second guide groove configured to guide a cartridge; and
an electrode that extends through the first plate and the first guide member.

12. A unit frame for use with a cartridge, the unit frame comprising:
a first plate and a second plate;
a first beam extending between the first plate and the second plate, the first beam including a first grip; and
a second beam extending between the first plate and the second plate, the second beam including a second grip,
wherein the first grip is disposed on an upper end of the first beam, and
wherein a distance from the upper end of the first beam to an upper end of the first grip is smaller than a distance from an upper end of the second beam to an upper end of the second grip.

13. The unit frame according to claim 12, further comprising:
an electrode that extends through the first plate.

14. The unit frame according to claim 12, wherein the first grip includes a depressed portion that opens upward.

15. The unit frame according to claim 12, further comprising:
a plurality of photosensitive drums rotatably supported between the first plate and the second plate.

16. The unit frame according to claim 12, further comprising:
a first guide member disposed on the first plate, the first guide member having a first guide groove configured to guide the cartridge and a first through-hole;
a second guide member disposed on the second plate, the second guide member having a second guide groove configured to guide the cartridge,
wherein the first plate has a second through-hole, and
wherein the first through-hole communicates to the second through-hole.

17. The unit frame according to claim 12, further comprising:
a first guide member disposed on the first plate, the first guide member having a first guide groove configured to guide the cartridge;
a second guide member disposed on the second plate, the second guide member having a second guide groove configured to guide the cartridge; and
an electrode that extends through the first plate and the first guide member.

18. An image forming apparatus comprising:
a casing;
a cartridge;
a unit frame for holding the cartridge, the unit frame including:
a first plate and a second plate; and
a first beam and a second beam, the first beam having a first-side grip and the second beam having a second-end grip; and
a rail for slidably hold the unit frame in the casing,
wherein a distance from an upper end of the rail to an upper end of the first-side grip is smaller than a distance from an upper end of the rail to an upper end of the second-end grip when the unit frame is disposed in the casing.

19. The image forming apparatus according to claim 18, wherein the unit frame further includes an electrode that extends through the first plate.

20. The image forming apparatus according to claim 18, wherein the first-side grip has a depressed portion that opens upward.

21. The image forming apparatus according to claim 18, the unit frame further includes a plurality of photosensitive drums rotatably supported between the first plate and the second plate.

* * * * *